US012043452B2

(12) United States Patent
Lane

(10) Patent No.: US 12,043,452 B2
(45) Date of Patent: Jul. 23, 2024

(54) LID ASSEMBLY FOR A BEVERAGE CONTAINER

(71) Applicant: Thermos L.L.C., Schaumburg, IL (US)

(72) Inventor: Marvin Lane, Brandon, MS (US)

(73) Assignee: Thermos L.L.C., Schaumburg, IL (US)

( * ) Notice: Subject to any disclaimer, the term of this patent is extended or adjusted under 35 U.S.C. 154(b) by 0 days.

(21) Appl. No.: 17/899,892

(22) Filed: Aug. 31, 2022

(65) Prior Publication Data

US 2023/0062840 A1 Mar. 2, 2023

Related U.S. Application Data

(60) Provisional application No. 63/239,872, filed on Sep. 1, 2021.

(51) Int. Cl.
*B65D 39/08* (2006.01)
*B65D 47/08* (2006.01)

(52) U.S. Cl.
CPC ..... *B65D 39/088* (2013.01); *B65D 47/0804* (2013.01); *B65D 2539/006* (2013.01); *B65D 2547/063* (2013.01)

(58) Field of Classification Search
CPC .... B65D 51/18; B65D 39/088; B65D 39/082; B65D 47/0804; B65D 47/08; B65D 47/06; B65D 2539/006; B65D 2547/063; B65D 2547/06; B65D 2251/0012; A47G 19/2272
USPC ..... 220/254.8, 254.7, 254.1, 259.3, 256.1, 220/212; 215/364, 356, 355; 217/106, 217/107, 98
See application file for complete search history.

(56) References Cited

U.S. PATENT DOCUMENTS

| | | | | |
|---|---|---|---|---|
| 2013/0248531 | A1 | 9/2013 | Lane | |
| 2014/0166654 | A1 | 6/2014 | Lane | |
| 2018/0050845 | A1 | 2/2018 | Chin et al. | |
| 2019/0161246 | A1 | 5/2019 | Lane et al. | |
| 2019/0269577 | A1 | 9/2019 | Reed | |
| 2020/0148433 | A1 * | 5/2020 | Lane | B65D 47/243 |

FOREIGN PATENT DOCUMENTS

| | | | | |
|---|---|---|---|---|
| JP | 3159974 U | * | 6/2010 | B65D 47/26 |

OTHER PUBLICATIONS

Taiwan Office Action issued Aug. 7, 2023, for Taiwan Application No. 111133204. English translation appended herein. 30 pages.
Taiwan Office Action issued Jun. 1, 2023, for Taiwan Application No. 111133203. English translation appended herein. 22 pages.

* cited by examiner

*Primary Examiner* — Robert J Hicks
(74) *Attorney, Agent, or Firm* — Polsinelli PC

(57) ABSTRACT

A lid for use with a beverage container is described. The lid includes a lid body to fit into an opening of the beverage container. The lid includes a stopper that threadably engages with the lid body. A fluid passage is formed between the lid body and the stopper. The rotation of the stopper relative to the lid body provides an indication that the stopper and the lid body are in the open configuration and/or the removable configuration. The indication may include an audible indication, a tactile indication, or an increase in resistance.

15 Claims, 42 Drawing Sheets

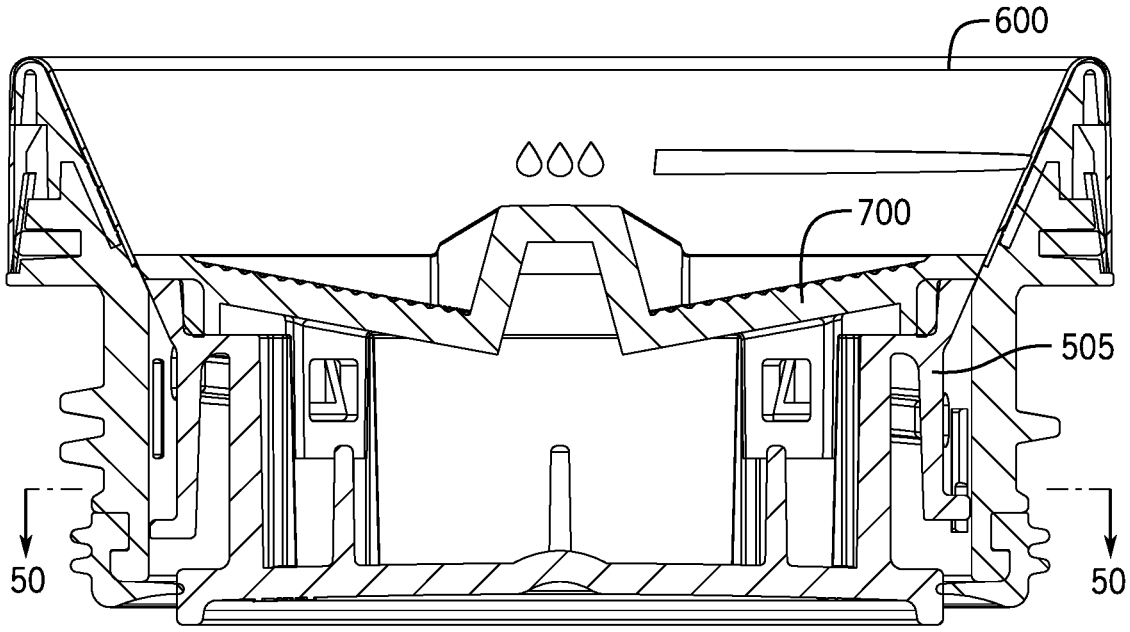
FIG. 49
FIG. 50
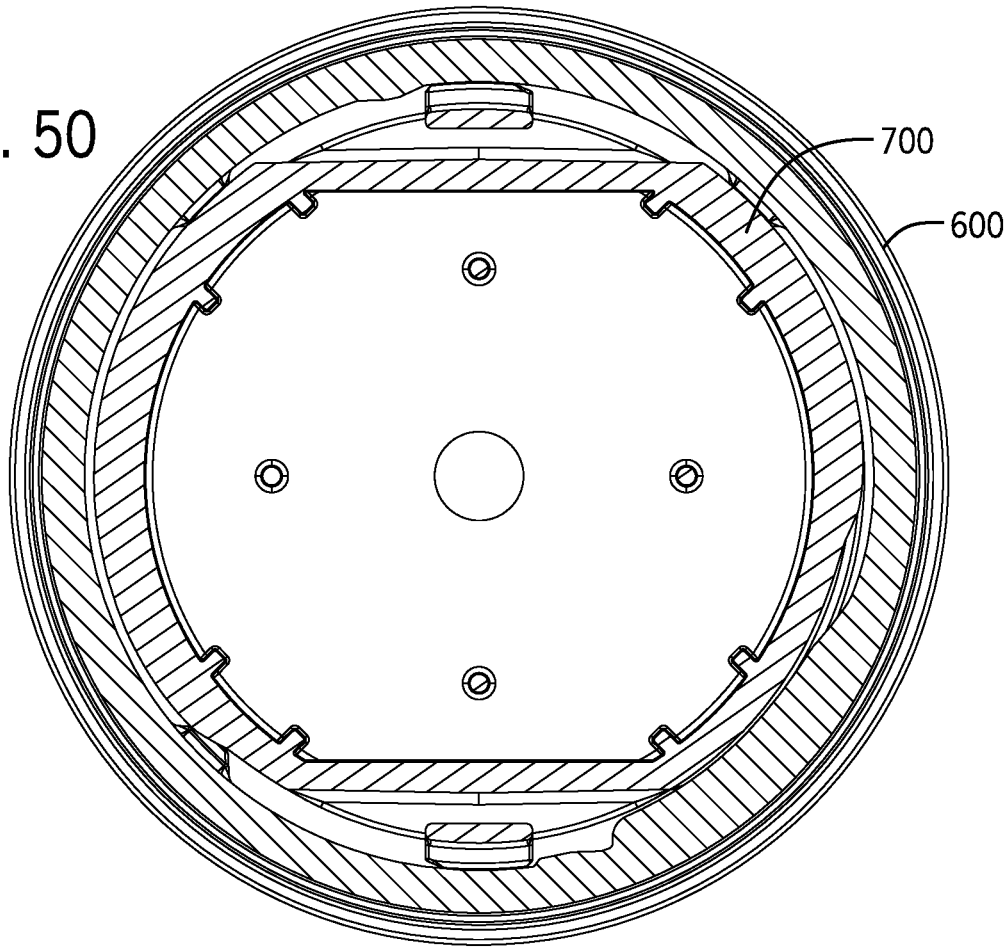

FIG. 51
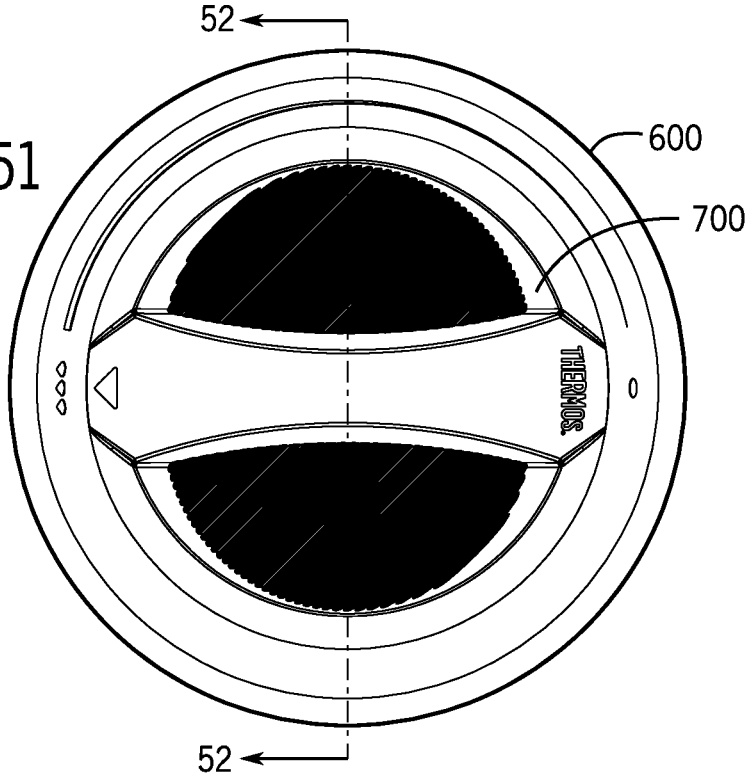
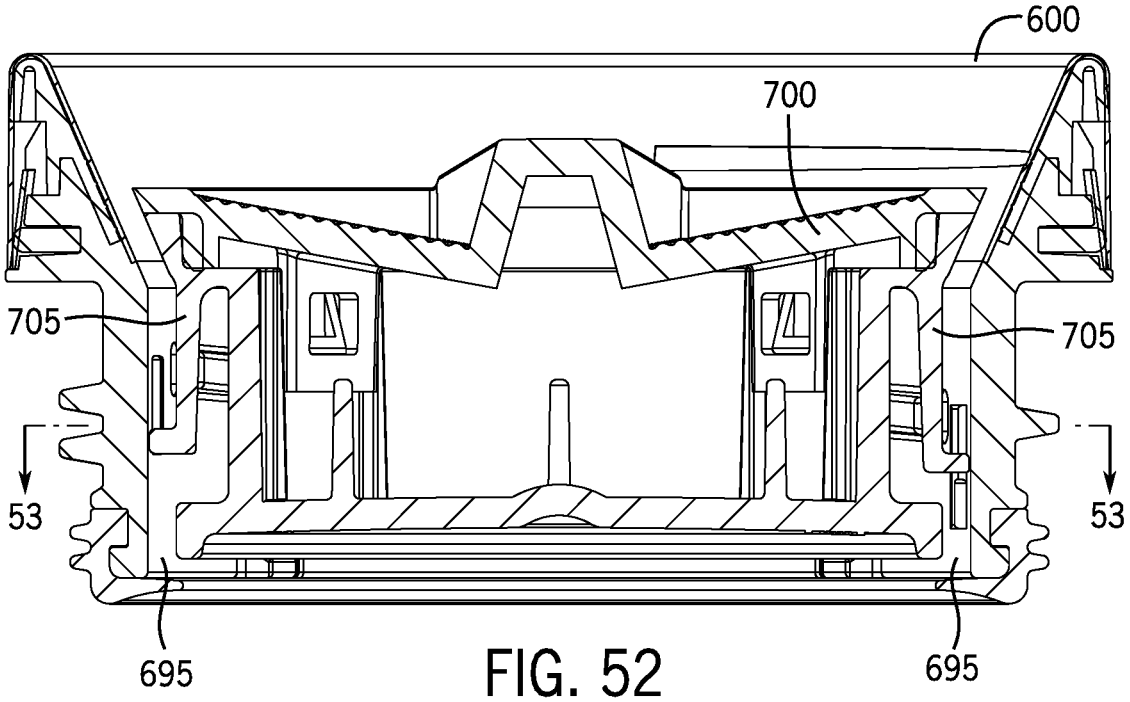
FIG. 52

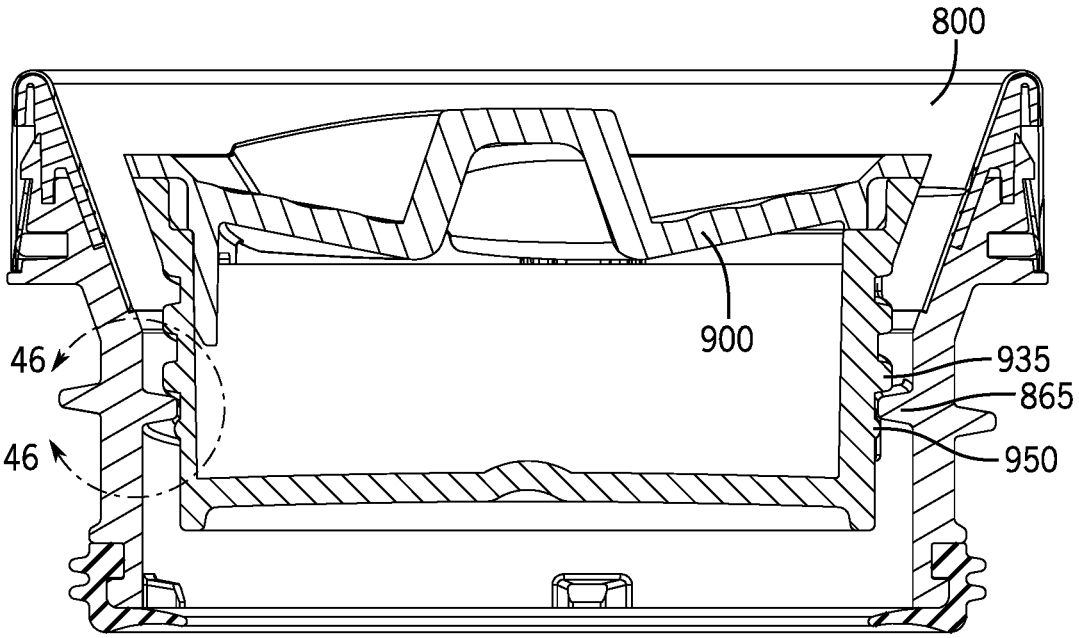
FIG. 66
FIG. 67
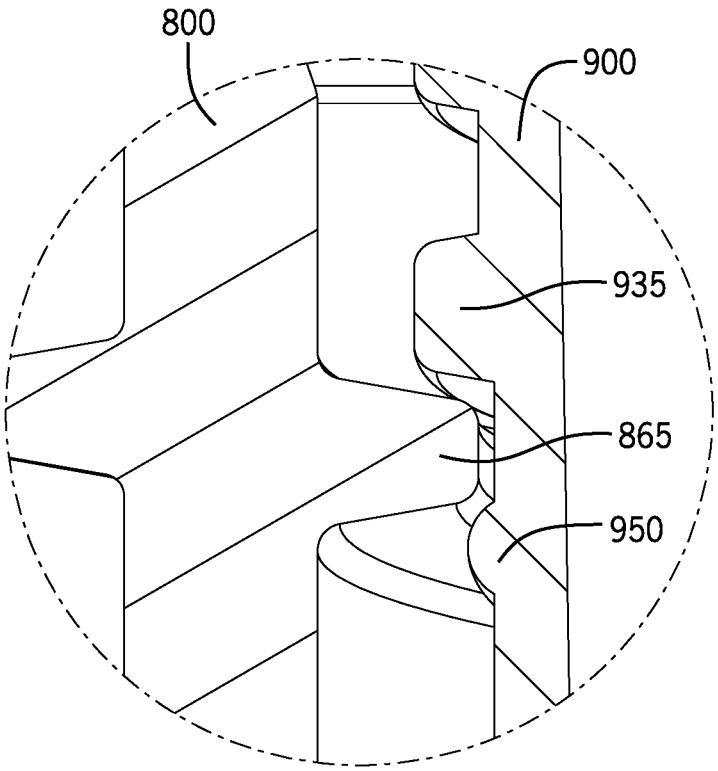

LID ASSEMBLY FOR A BEVERAGE CONTAINER

This application claims priority to U.S. Provisional Patent Application No. 63/239,872, filed Sep. 1, 2021, which is hereby incorporated by reference.

FIELD OF INVENTION

The present invention relates to a lid assembly with a stopper for use with a container, such as a beverage container.

BACKGROUND

Prior beverage lids of drinking containers may include a stopper that is openable and removable for drinking. However, it may not be apparent to the user that such a stopper is in a removable configuration, which may lead to accidental spills.

Prior beverage lids of drinking containers may also include a stopper that must be fully removed before drinking or pouring from the drinking container. This may be inconvenient for the user. Further, the fully removed stopper may be lost.

SUMMARY

Certain embodiments of a lid with a stopper for use with a beverage container are shown and described. The stopper selectively opens and closes the lid for drinking or pouring a beverage from the beverage container. The stopper threads or rotates to a closed position to close a fluid passage between the stopper and a lid body. The stopper also threads or rotates to open the fluid passage between the stopper and the lid body.

The stopper includes outer threads that engage with inner threads of the lid body. The stopper generally seals the lid body to a closed position to maintain the beverage in the beverage container. The entire stopper may be conveniently removed from the lid body for cleaning or filling of the beverage container and later returned to the lid body for further use.

In order to drink from the beverage container, there is no need to completely remove the lid body or the stopper from the beverage container. This helps to reduce accidental loss of the lid body or stopper. This also helps to maintain a sanitary condition of the lid body—as the lid body is not removed unnecessarily and exposed to dirt and other contamination. However, as described herein, the stopper may be completely removed from the lid body for cleaning. Of course, the user may also drink from the container with the stopper totally removed from the lid body.

The stopper threads or rotates relative to the lid body between a closed configuration, an open configuration, and a removable configuration. During an opening process, the user threads or rotates the stopper to the left relative to the lid body to open the fluid passage between the stopper and the lid body. During a closing process, the user threads or rotates the stopper to the right to close the fluid passage.

The threading or rotation of the stopper relative to the lid body provides an indication that the stopper and the lid body are in the open configuration and/or the removable configuration. For example, the indication may include an audible indication, a tactile indication, an increase in resistance, etc.

In one aspect, a lid for a beverage container is described. The lid includes a lid body configured to fit into an opening of a drink container. The stopper is configured to threadably engage with the lid body. The stopper rotates relative to the lid body between a closed configuration, an open configuration, and a removable configuration. A fluid passage is between the lid body and the stopper. The fluid passage is closed when the stopper and the lid body are in the closed configuration. The fluid passage is open when the stopper and the lid body are in the open configuration. The rotation of the stopper relative to the lid body provides an indication that the stopper and the lid body are in the open configuration.

In another aspect, a lid for a beverage container is described. The lid includes a lid body configured to fit into an opening of a drink container. A stopper is configured to threadably engage with the lid body. The stopper rotates relative to the lid body between a closed configuration, an open configuration, and a removable configuration. A fluid passage is between the lid body and the stopper. The fluid passage is closed when the stopper and the lid body are in the closed configuration. The fluid passage is open when the stopper and the lid body are in the open configuration. An inner surface of the lid body includes inner threads, which threadably engage with outer threads of the stopper. The inner surface of the lid body includes a first protrusion and a second protrusion. The outer threads include an extending portion. The rotation of the stopper relative to the lid body provides an indication that the lid body is in the open configuration when the extending portion contacts the first protrusion. The rotation of the stopper relative to the lid body provides an indication that the lid body is in the removable configuration when the extending portion contacts the second protrusion.

In another aspect, a beverage container assembly is described. The beverage container assembly includes a beverage container. A lid body is configured to fit into an opening of the beverage container. A stopper is configured to threadably engage with the lid body. The stopper rotates relative to the lid body between a closed configuration, an open configuration, and a removable configuration. A gasket is engaged to the lid body. The gasket includes an outward sealing portion to seal against an inner surface of the beverage container. The gasket includes an inward sealing portion to seal against the stopper. A fluid passage is between the lid body and the stopper. The fluid passage is closed when the stopper and the lid body are in the closed configuration. The fluid passage is open when the stopper and the lid body are in the open configuration.

BRIEF DESCRIPTION OF DRAWINGS

FIG. 49 is a sectional view of the third lid body and the third stopper in the closed position.

FIG. 50 a sectional view of the third lid body and the third stopper in the closed position.

FIG. 51 is an upper view of the third stopper engaged to the third lid body in the open position.

FIG. 52 is a sectional view of the third lid body and the third stopper in the open position.

FIG. 66 is a sectional view of the fourth stopper engaged to the fourth lid body.

FIG. 67 is a sectional view of the fourth stopper engaged to the fourth lid body.

DETAILED DESCRIPTION OF INVENTION

Figure 1:
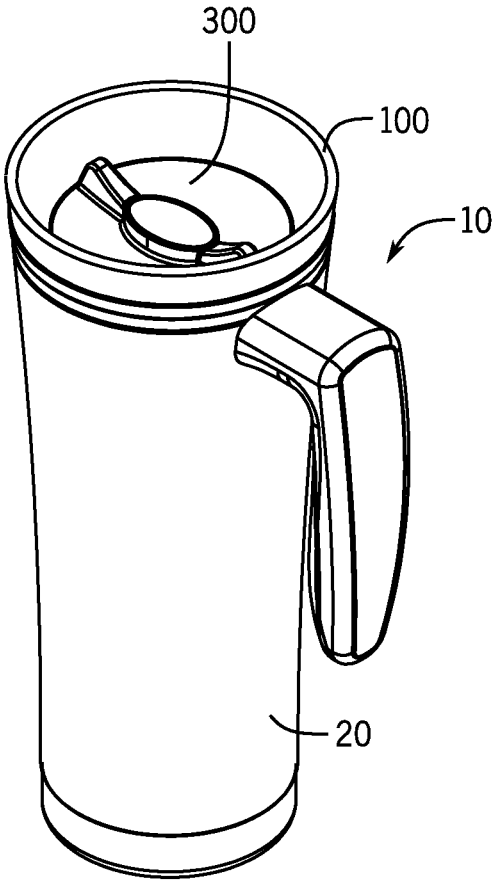
FIG. 1 is a perspective view of the beverage container assembly.

For purposes of this application, any terms that describe relative position (e.g., "upper", "middle" "lower", "outer", "inner", "above", "below", "bottom", "top", etc.) refer to an embodiment of the invention as illustrated, but those terms do not limit the orientation in which the embodiments can be used.

A beverage container assembly 10 will now be described with references to FIGS. 1-20. The beverage container assembly 10 includes a beverage container 20, a lid body 100, and a stopper 300. The beverage container 20 includes walls 22 defining an interior volume 26 to hold a beverage. The stopper 300 threadably engages into a central opening 110 of the lid body 100. The stopper 300 controls a flow of a drinking fluid through a fluid passage 370 between the lid body 100 and the stopper 300. A combination of the lid body 100 and the stopper 300 are inserted into an upper opening 30 of the beverage container 20 to provide a selective closure to the beverage container 20.

Figure 2:
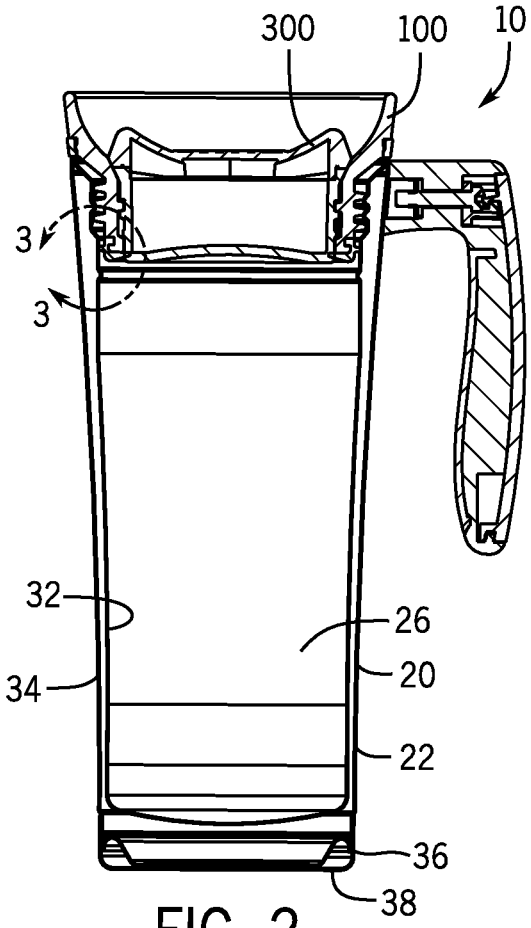
FIG. 2 is a sectional view of the beverage container assembly.

With respect to FIG. 2, a sectional view of the beverage container 20 is shown. In this aspect, a four-piece insulated beverage container 20 is illustrated, however, other types of beverage containers may be used with the lid body 100 and the stopper 300 described herein. With reference to FIG. 2, the beverage container 20 includes an inner shell 32 and an outer shell 34. The beverage container 20 further includes an inner bottom 36 and an outer bottom 38. The inner shell 32, the outer shell 34, the inner bottom 36, and the outer bottom 38 are welded or otherwise joined to form a thermally insulated space in the beverage container 20 to maintain a temperature of the beverage. In other aspects, the beverage container 20 includes a non-insulated construction or other insulated constructions. In other aspects, the beverage container 20 may be formed from stainless steel, other metals and metal alloys, plastics, and the like.

Figure 4:
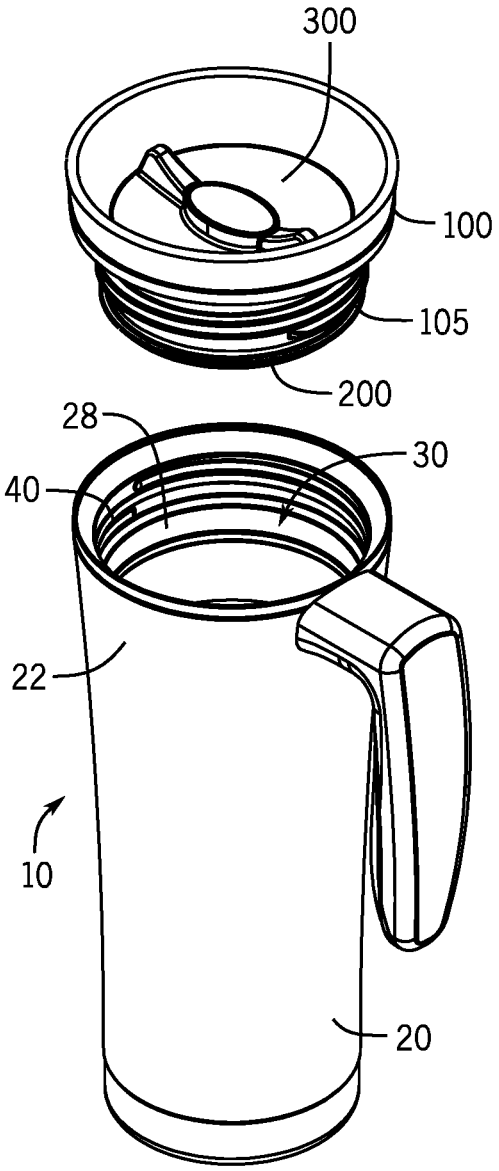
FIG. 4 is a perspective view of the lid assembly removed from the beverage container assembly.
Figure 6:
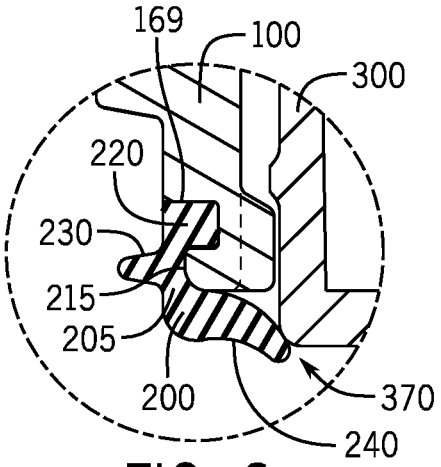
FIG. 6 is a detailed sectional view of the gasket of the beverage container assembly.
Figure 5:
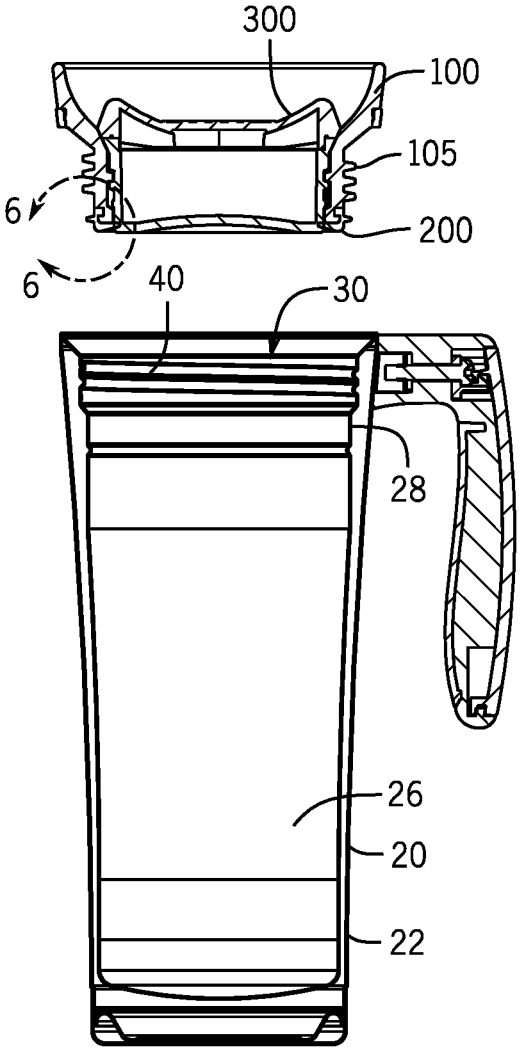
FIG. 5 is a sectional view of the beverage container assembly with the lid assembly removed.

In this aspect, the lid body 100 threadably engages to the beverage container 20. With reference to FIG. 4, the walls 22 of an upper portion of the beverage container 20 include an inner surface 28 having interior threads 40. The interior threads 40 of the beverage container 20 receive exterior threads 105 of the lid body 100 to engage the lid body 100 to the beverage container 20. The lid body 100 is inserted into the upper opening 30 of the beverage container 20. The exterior threads 105 of the lid body 100 threadably engage with the interior threads 40 of the beverage container 20 to screw the lid body 100 into and/over the upper opening 30 of the beverage container 20. As the lid body 100 is screwed to the upper opening 30, a gasket 200 of the lid body 100 is urged against the inner surface 28 of the beverage container 20. The engagement of the gasket 200 to the inner surface 28 generally seals the engagement between the lid body 100 and the beverage container 20.

Figure 10:
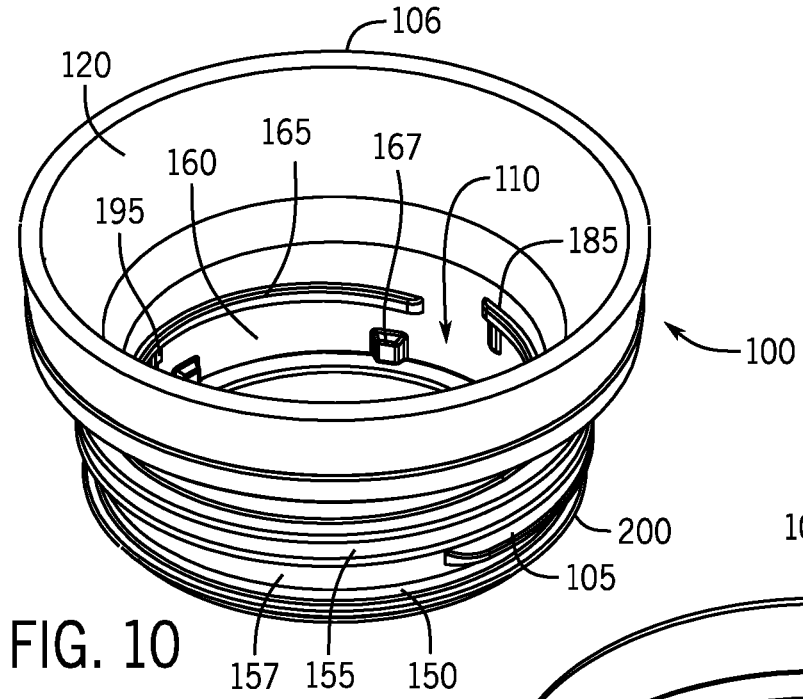
FIG. 10 is an upper perspective view of the lid body.
Figure 11:
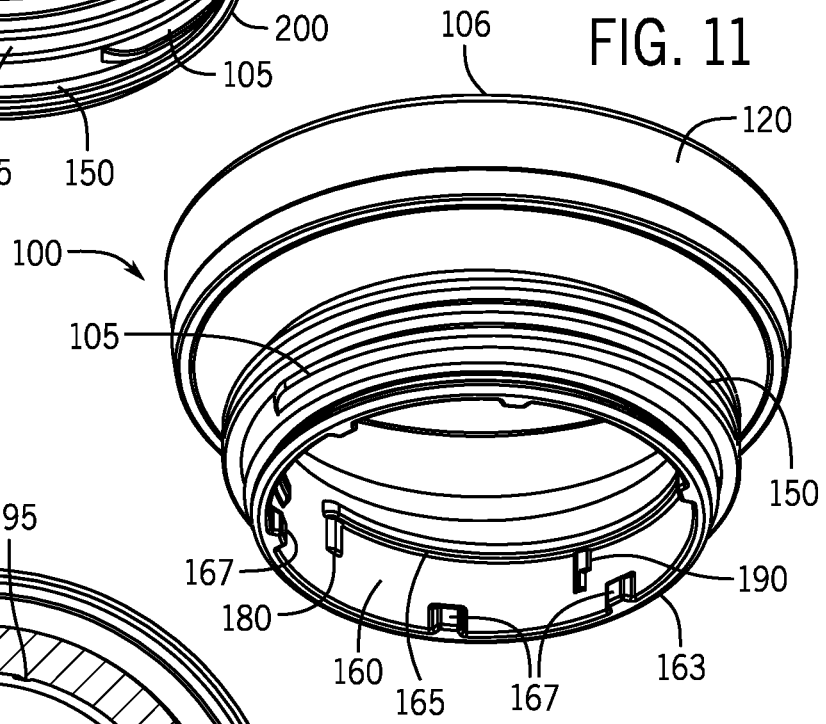
FIG. 11 is a lower perspective view of the lid body.
Figure 12:
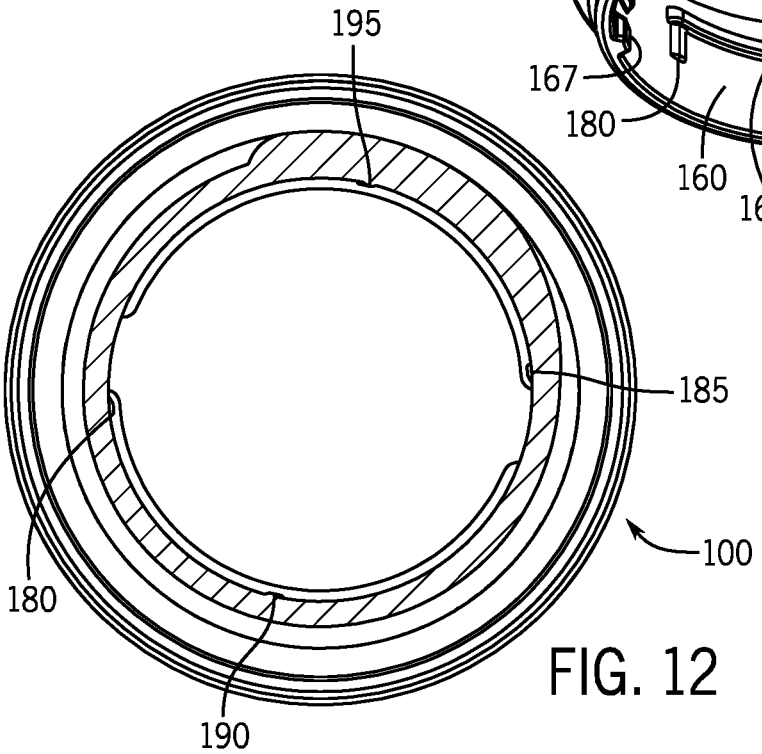
FIG. 12 is a bottom view of the lid body.
Figure 13:
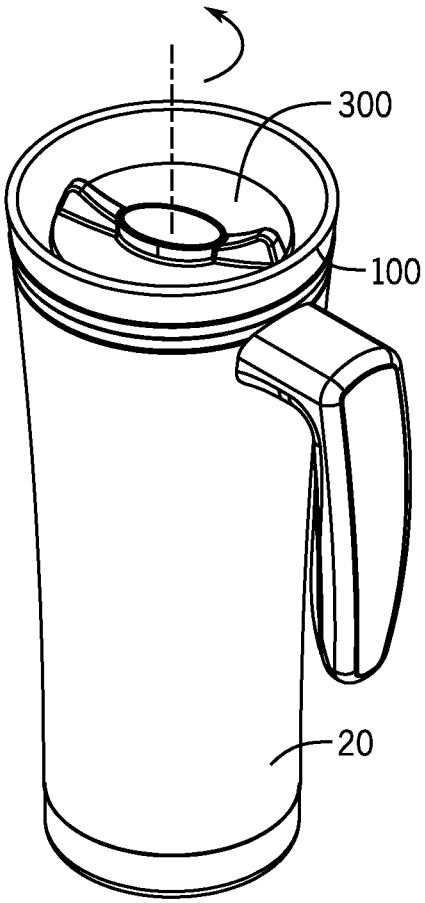
FIG. 13 is a perspective view of the beverage container assembly.

The lid body 100 will now be described with reference to FIGS. 10-12. The lid body 100 includes an upper rim 106 around the central opening 110. The upper rim 106 may come in contact with a mouth of a user when the user wishes to drink from the beverage container assembly 10. The upper rim 106 leads to or defines the central opening 110 that is generally open to receive the stopper 300.

The lid body 100 includes an upper portion 120 generally opposite of a lower portion 150. The lower portion 150 includes a sidewall 155. The sidewall 155 includes an outer surface 157 and an inner surface 160. In this aspect, the exterior threads 105 are formed or positioned on the outer surface 157 of the sidewall 155.

The gasket 200 is engaged to a bottom perimeter 163 of the lid body 100. In this aspect, bumps 167 are positioned on the inner surface 160 of the lid body 100 adjacent the bottom perimeter 163. An outer groove 169 assists in holding the gasket 200 to the lid body 100.

The inner surface 160 of the lid body 100 includes inner threads 165, which threadably engage with outer threads 335 of the stopper 300. The inner surface 160 of the lid body 100 includes a first major protrusion 180 and a second major protrusion 185. The inner surface 160 of the lid body 100 includes a first minor protrusion 190 and a second minor protrusion 195. In this aspect, the first major protrusion 180 and the second major protrusion 185 are generally larger or protrude further than the first minor protrusion 190 and the second minor protrusion 195.

The stopper 300 will now be described with reference to FIGS. 7-9. The stopper 300 includes an upper surface 310 generally opposite of a lower surface 320. The upper surface 310 includes an optional handle portion 312. The stopper 300 includes a central portion 323 that is generally solid without any openings or passages for fluid flow. The size and shape of the stopper 300 is configured to close the central opening 110 of the lid body 100.

A sidewall 330 joins the upper surface 310 and the lower surface 320. A lower outer perimeter 325 is formed between the sidewall 330 and the lower surface 320. An outer surface 333 of the sidewall 330 includes outer threads 335 that threadably engage with the inner threads 165 of the lid body 100. In this aspect, the outer threads 335 include first threads 340 and second threads 345 separated by depressions 360.

The first threads 340 include a first extending portion 350 positioned integral with or adjacent to the first threads 340. Similarly, the second threads 345 include a second extending portion 355 positioned integral with or adjacent to the second threads 345. In this aspect, the first extending portion 350 is generally perpendicular to the first threads 340 and the second extending portion 355 is generally perpendicular to the second threads 345.

The fluid passage 370 is formed between the lid body 100 and the stopper 300. The stopper 300 controls a flow of a drinking fluid through the fluid passage 370. As the stopper 300 rotates to a closed position, the fluid passage 370 is blocked. As the stopper 300 rotates to an open position, the fluid passage 370 is opened.

The gasket 200 extends around an outer diameter of the lid body 100. The gasket 200 is positioned below the upper rim 106 and is engaged to the outer groove 169 of the lid body 100. The gasket 200 includes a gasket body 205 defining a central opening. The gasket 200 includes an engaging portion 220 that fits into or engages to the outer groove 169 of the lid body 100.

The gasket 200 includes an outward sealing portion 230 to seal against the inner surface 26 of the beverage container 20 and an inward sealing portion 240 to seal against the stopper 300. As such, in this aspect, the gasket 200 seals against two different components. In this aspect, the gasket 200 seals against two different components in opposing directions. In this aspect, a groove 215 is formed between the inward sealing portion 240 and the engaging portion 220. The groove 210 fits over the bottom perimeter 163 of the lid body 100.

The inward sealing portion 240 forms a fin or wiper that bends or deflects to seal against the stopper 300. The inward sealing portion 240 may also provide a vent to reduce vacuum build-up in the container 20.

Figure 3:
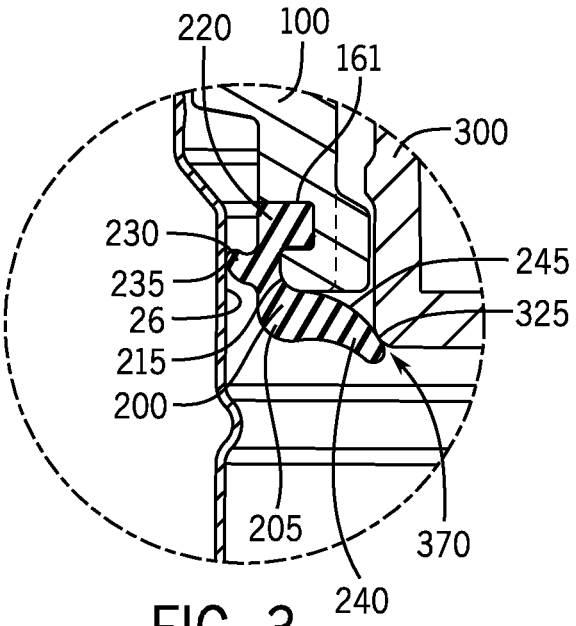
FIG. 3 is detailed view of the sealing of the gasket of the beverage container assembly.

With reference to FIG. 3, in this aspect, an outer edge 235 of the outward sealing portion 230 seals against the inner surface 26 of the beverage container 20. With continued reference to reference to FIG. 3, in this aspect, a sealing surface 245 of the inward sealing portion 240 seals against the lower outer perimeter 325 of the stopper 300. The bumps 167, positioned on the inner surface 160 of the lid body 100, help to maintain the proper position of the gasket 200. The bumps 167 may prevent the inward sealing portion 240 from rolling or flexing upward. In other aspects, the inward sealing portion 240 may also seal against one or both of the lower surface 320 of the stopper 300 or the outer surface 333 of the stopper 300.

The bumps 167 may further assist in aligning the stopper 300 with the lid body 100. The bumps 167 may reduce accidental cross-threading if the stopper 300 is accidentally inserted into the lid body 100 at too much of an angle.

In this aspect, the first major protrusion 180 is positioned on the inner surface 160 of the lid body 100 approximately 180 degrees apart from the second major protrusion 185. Similar, in this aspect, the first minor protrusion 190 is positioned on the inner surface 160 of the lid body 100 approximately 180 degrees apart from the second minor protrusion 195.

The stopper 300 rotates relative to the lid body 100 to move or change between a closed configuration, an open configuration, and removable configuration. In the closed configuration, the stopper 300 is generally sealed against the lid body 100 and fluid cannot generally flow through the fluid passage 370. In the open configuration, the stopper 300 has been unthreaded sufficiently to open the fluid passage 370 and permit fluid flow through the fluid passage 370. In the removable configuration, the stopper 300 has been unthreaded sufficiently to disengage the outer threads 335 of the stopper 300 from the inner threads 165 of the lid body 100 and the stopper 300 may be removed from the lid body 100.

As the stopper 300 rotates, the first extending portion 350 of the first threads 340 and the second extending portion 355 of the second threads 345 interact with the first major protrusion 180 of the lid body 100, the second major protrusion 185 of the lid body, the first minor protrusion 190 of the lid body 100, and the second minor protrusion 195 of the lid body 100 to signal to the user that the stopper 300 has moved from one of the closed configuration, the open configuration, and the removable configuration to another of the configurations. For example, after the stopper 300 is unthreaded a first amount of rotation from the closed position, the first extending portion 350 and the second extending portion 355 generally simultaneously click over the first minor protrusion 190 and the second minor protrusion 195 to indicate that the lid body 100 is now in an open state—where fluid may flow through the fluid passage 370. Further, for example, after the stopper 300 is further unthreaded another second amount of rotation from the open configuration, the first extending portion 350 and the second extending portion 355 generally simultaneously click over the first major protrusion 180 and the second major protrusion 185 to indicate that the stopper 300 is now in the removable configuration—where the stopper 300 may be removed from the lid body 100.

In certain aspects, the first amount of rotation to move from the closed configuration to the open configuration may range from approximately 5 degrees to approximately 40 degrees. The second amount of rotation to move from the open configuration to the removable configuration may range from approximately 40 degrees to approximately 320 degrees. In the aspect shown, the first amount of rotation from the close configuration to the open configuration is approximately 20 degrees, and the second amount of rotation from the open configuration to the removable configuration is approximately 160 degrees, although the amounts rotation may vary depending on the size of the threads, size of the beverage container, user preference, etc.

The interaction of the first extending portion 350 and the second extending portion 355 with the first minor protrusion 190, the second minor protrusion 195, the first major protrusion 180, and the second major protrusion 185 provides an audible, tactile, and/or otherwise noticeable sensation or feeling that the stopper 300 has moved from the closed configuration to the open configuration or from the closed configuration to the removable configuration and vice versa.

As the stopper 300 is rotated from the closed position to the open configuration, the first extending portion 350 and the second extending portion 355 generally simultaneously click over the first minor protrusion 190 and the second minor protrusion 195 to indicate that the lid body 100 is now in the open configuration. As the stopper rotates from the open configuration to the removable configuration, the first extending portion 350 and the second extending portion 355 generally simultaneously click over the first major protrusion 180 and the second major protrusion 185 to indicate that the stopper 300 is now in the removable configuration. In this aspect, the user generally exerts more force to rotate the first extending portion 350 and the second extending portion 355 over the first major protrusion 180 and the second major protrusion 185 than is required to rotate the first extending portion 350 and the second extending portion 355 over the first minor protrusion 190 and the second minor protrusion 195, which provides a reminder or indication to the user regarding which configuration the stopper 300 is in.

Figure 7:
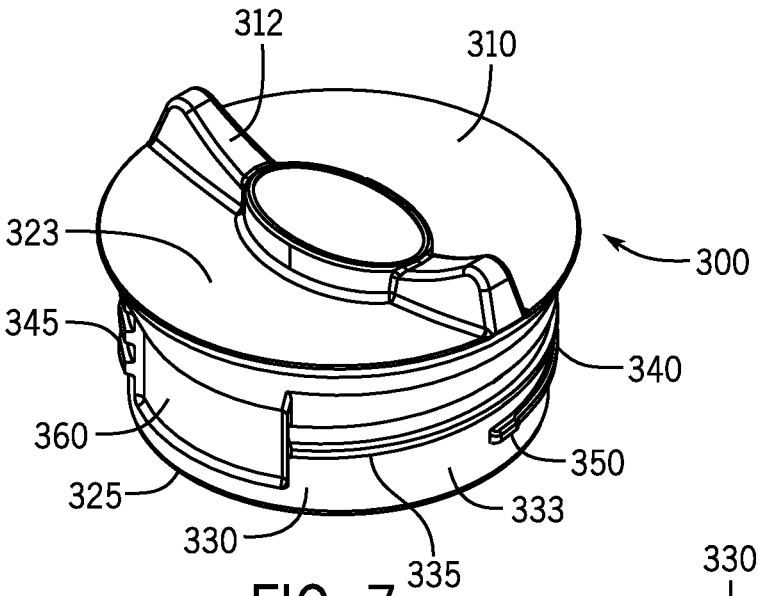
FIG. 7 is an upper perspective view of the stopper.
Figure 8:
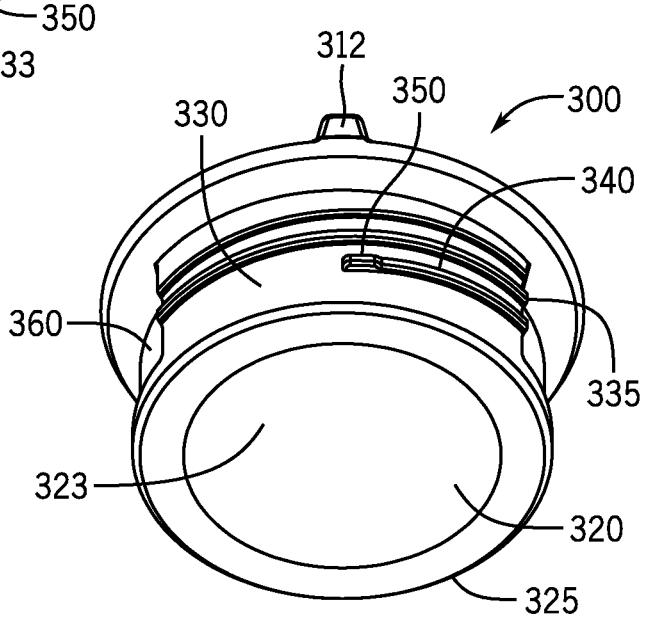
FIG. 8 is a lower perspective view of the stopper.
Figure 9:
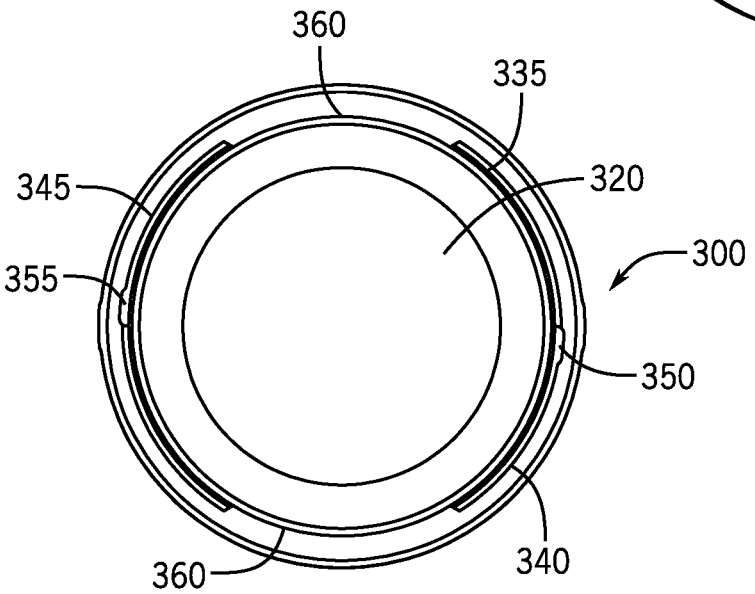
FIG. 9 is a bottom view of the stopper.

With reference to FIGS. 7-9, in this aspect, the first threads 340 and the second threads 345 are separated by the depressions 360. The depressions 360 are breaks, openings, voids, etc. between the first threads 340 and second threads 345 of the stopper 300. The depressions provide increased fluid flow when the stopper 300 is opened. The depressions 360 provide a region or space on the exterior of the stopper 300 having a small external diameter than an external diameter of the first threads 340 and second threads 345. The depressions 360 are oppositely disposed on the exterior of the stopper 300. The depressions 360 are approximately 180 degrees from each other. Although the lid body 100 is illustrated with two depressions 360, in other aspects, the stopper 300 may include one depression 360 or three or more depressions 360.

Figure 15:
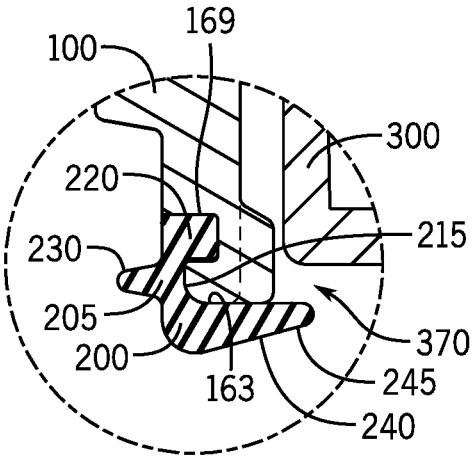
FIG. 15 is a detailed sectional view of the gasket of the beverage container assembly it the open position.
Figure 14:
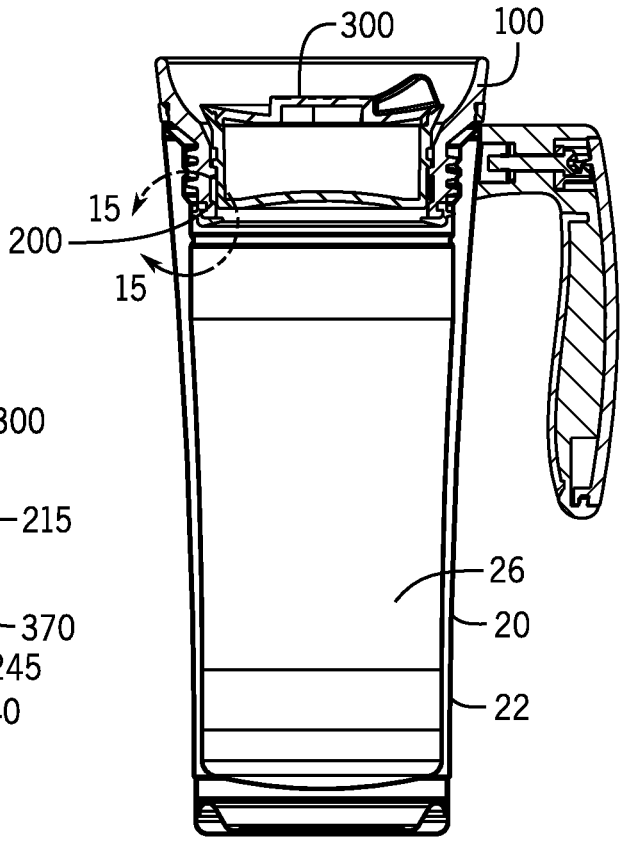
FIG. 14 is a sectional view of the beverage container assembly in the open position.
Figure 16:
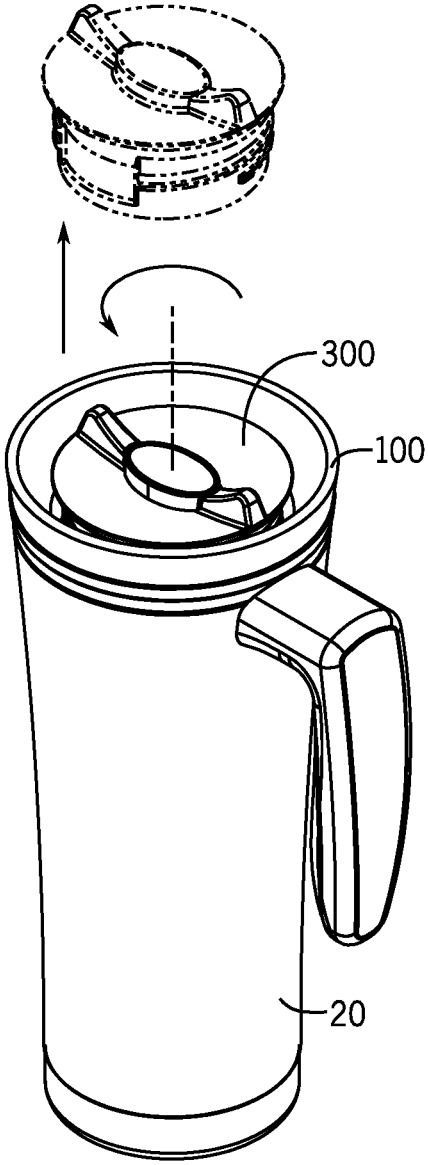
FIG. 16 is a perspective view showing the stopper separating from the lid body.
Figure 17:
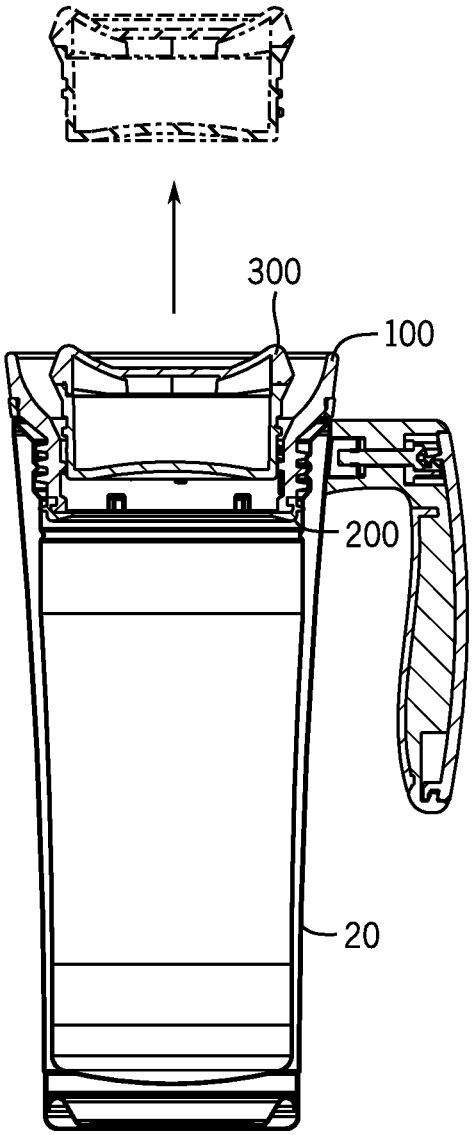
FIG. 17 is a sectional view of the stopper showing the stopper separating from the lid body.
Figure 18:
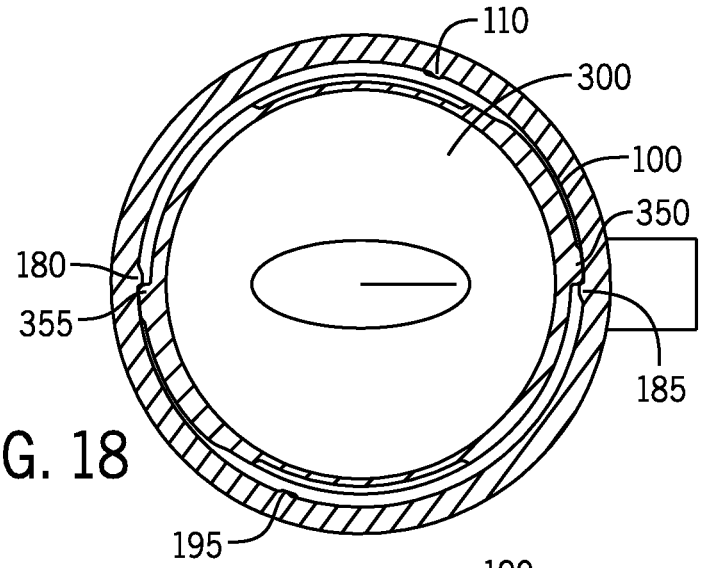
FIG. 18 is a sectional view showing the stopper and the lid body in the closed configuration.
Figure 19:
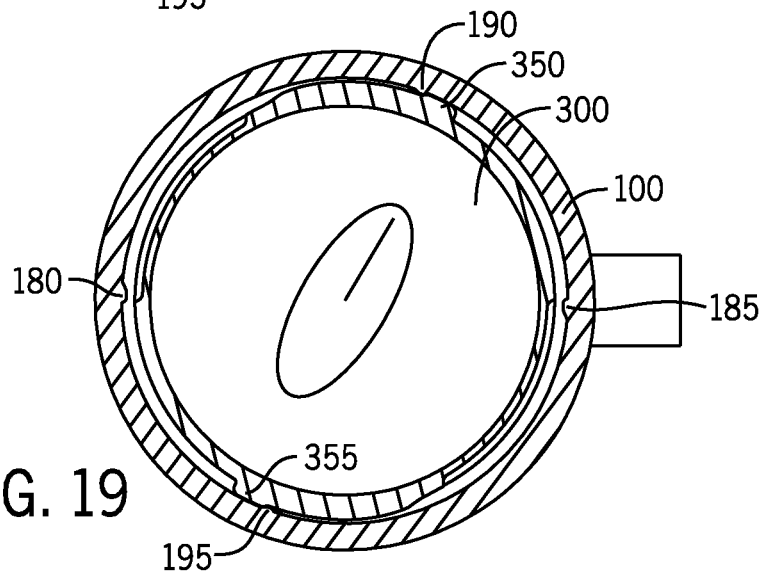
FIG. 19 is a sectional view showing the stopper and the lid body in the open configuration.
Figure 20:
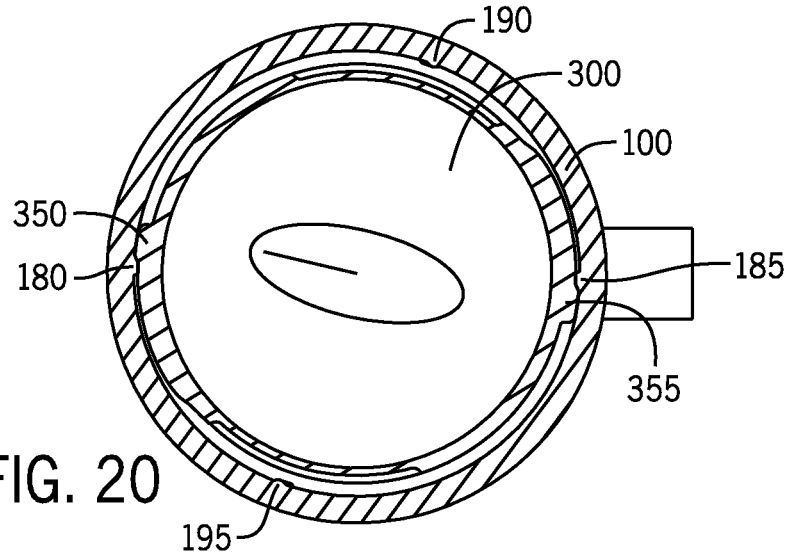
FIG. 20 is a bottom view showing the stopper and the lid body in the removable configuration.

The function and operation of the beverage container assembly 10 will now be described. As described above, the lid body 100 threadably engages or screws to the beverage container 20. The stopper 300 also threadably engages or screws to the lid body 100. When the stopper 300 is unscrewed or unthreaded from the lid body 100, such as shown in FIG. 15, the fluid passage 370 is opened.

The stopper 300 may be fully screwed or fully threaded to the lid body 100, such as shown in FIG. 3, to provide nearly complete closure of the beverage container assembly 10 to provide a generally leak-resistant or spill-resistant beverage container assembly 10. In order to open the beverage container 20 for drinking or pouring, the stopper 300 is unscrewed or unthreaded from the lid body 100 until the fluid passage 370 is opened. The stopper 300 may be fully or partially unscrewed or unthreaded from the lid body 100 in order to drink from or pour from the beverage container assembly 10.

The stopper 300 may be turned to the opening direction, which in this aspect, is in the left direction. However, the stopper 300 will only turn a finite amount of rotation in the closing or right direction, as the threads 350 of the stopper 300 will fully engage to the interior threads 165 of the lid body 100. Eventually, after sufficient turning in the closing or right direction, the stopper 300 will be fully seated against the lid body 100.

The lid body 100 is configured to removably connect to the container 20. In other aspects, the lid body 100 and container 20 may include other removable connection components or configurations, such as different complementary threads, snap engagement, press-fit engagement, bayonet engagement, a frictional configuration, etc.

The beverage container 20 may be made from any suitable material, including a generally rigid material, a generally flexible material, a generally insulated material, or a generally non-insulated material. Examples of beverage container 20 materials include metal (e.g., stainless steel), glass, rubber, silicone, plastic (e.g., food grade plastic), etc. or any combination thereof. An insulated material may include a double-wall vacuum insulated construction or foam insulation. In FIGS. 1-20, the beverage container 20 is made from stainless steel.

The lid body 100 and stopper 300 will generally be made from any suitable material, including a generally rigid material, a generally flexible material, a generally insulated material, or a generally non-insulated material. Example of materials for the lid body 100 and stopper 300 include moldable food-grade plastics, thermoplastics, etc. or any combination thereof. The stopper 300 and/or lid body 100 may include an insulated construction.

Figure 22:
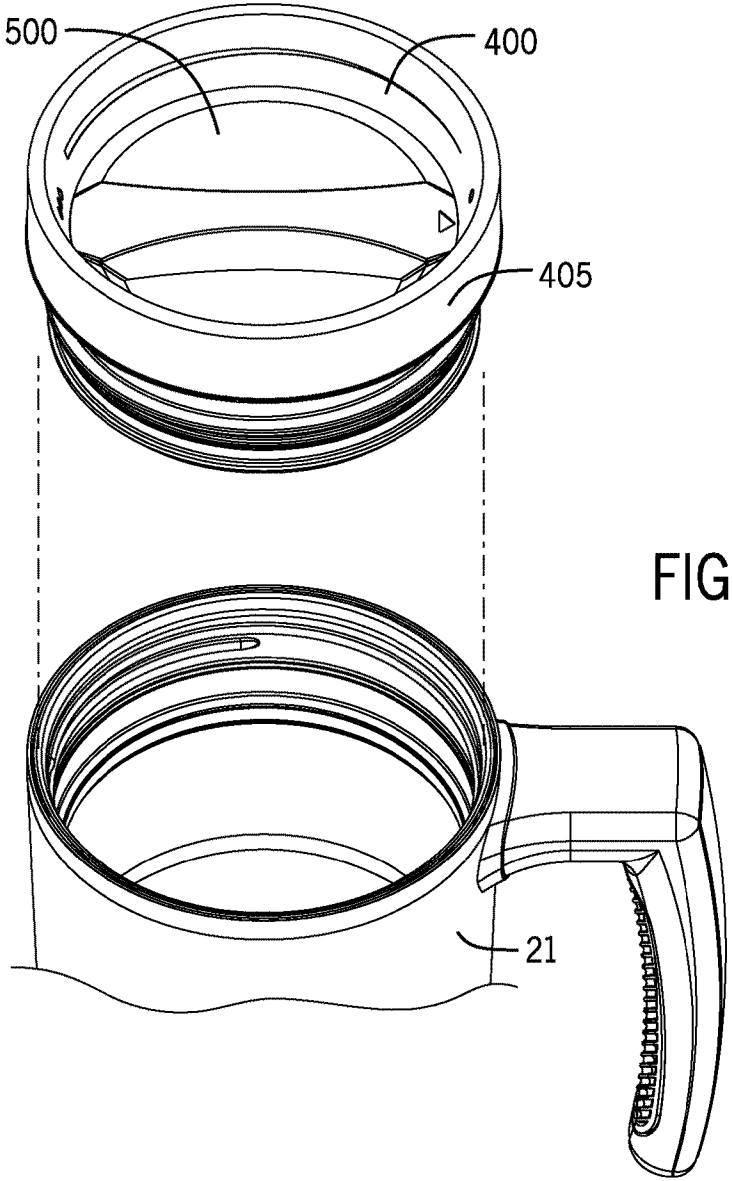
FIG. 22 is a perspective view of the second lid body and the second stopper.
Figure 21:
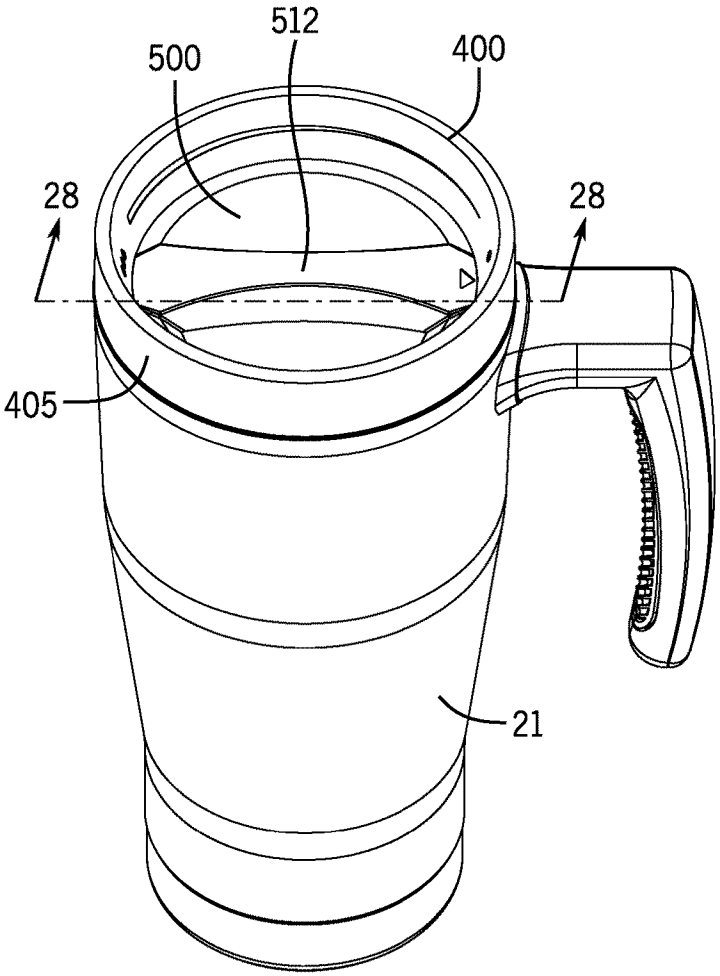
FIG. 21 is a perspective view a second beverage container assembly.
Figure 23:
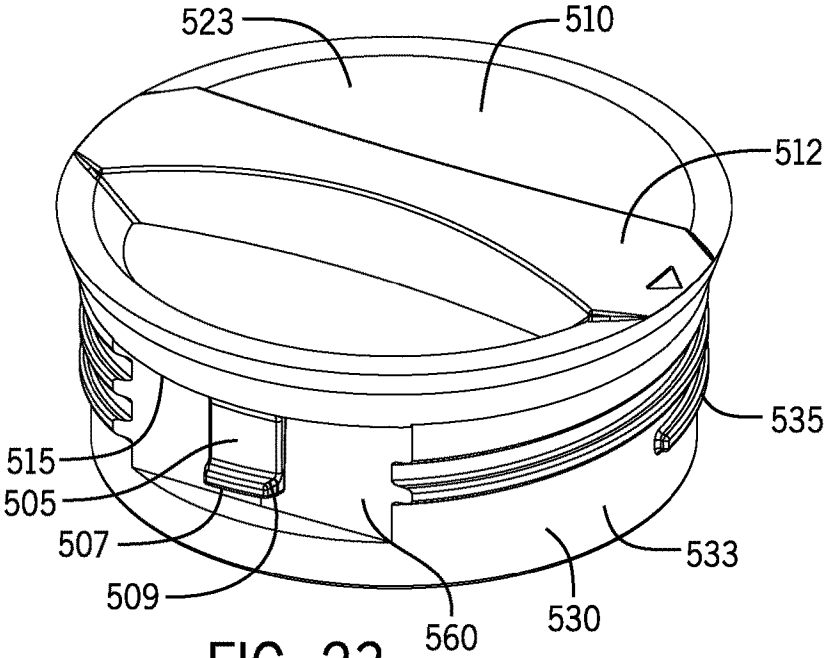
FIG. 23 is a perspective view of the second stopper.
Figure 24:
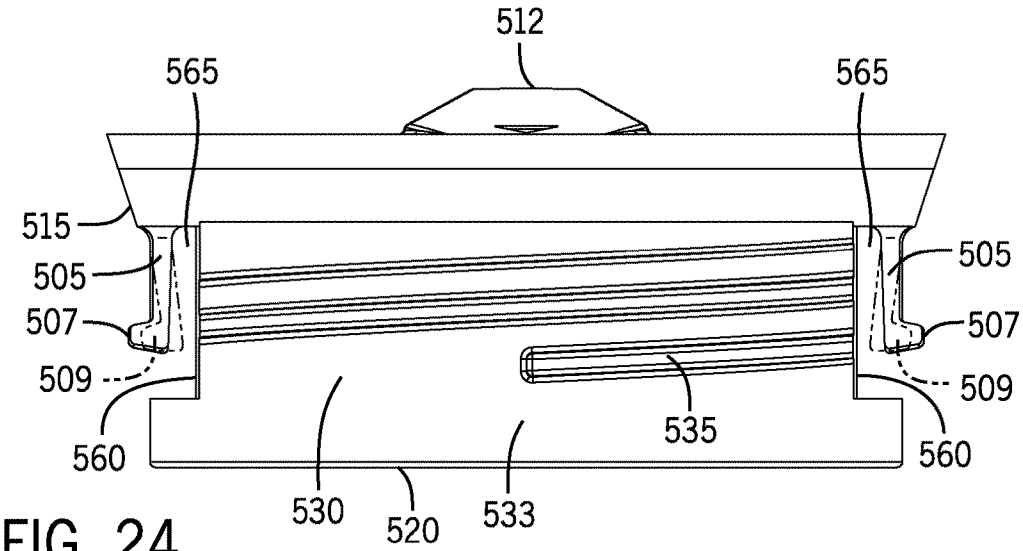
FIG. 24 is a side view of the second stopper.

Further beverage container assemblies according to the present disclosure will now be described. A second lid body 400 and a second stopper 500 are shown in FIGS. 21-41. A third lid body 600 and a third stopper 700 are shown in FIGS. 42-57. A fourth lid body 800 and a fourth stopper 900 are shown in FIGS. 58-68. A fifth lid body 1000 and a fifth stopper 1100 are shown in FIGS. 69-79. The respective stoppers 500, 700, 900, and 1100 threadably engage into, to, or over their respective lid bodies 400, 600, 800, and 1000 to control a flow of a drinking fluid. The respective lid bodies 400, 600, 800, and 1000 threadably engage to the beverage container 20, a beverage container 21 shown in FIG. 21 or 22, other containers. The lid bodies 400, 600, 800, and 1000 and their respective stoppers 500, 700, 900, and 1100 generally operate similarly to the lid body 100 and stopper 300, except where noted.

The second lid body 400 and the second stopper 500 will now be described with reference to FIGS. 21-41:

The second lid body 400 includes an upper rim 405 around a central opening 410. The upper rim 405 may come in contact with a mouth of a user when the user wishes to drink. The upper rim 405 leads to or defines the central opening 410 that is generally open to receive the second stopper 500.

The second stopper 500 includes an upper surface 510 generally opposite of a lower surface 520. The upper surface 510 includes an optional handle portion 512. The stopper 500 includes a central portion 523 that is generally solid without any openings or passages for fluid flow. The size and shape of the second stopper 500 is configured to close the central opening 410 of the second lid body 400.

A sidewall 530 of the second stopper 500 joins the upper surface 510 and the lower surface 520. An outer surface 533 of the sidewall 530 includes outer threads 535 that threadably engage with inner threads 465 of the second lid body 400. In this aspect, the second lid body 400 and the second stopper 500 are double-threaded to ease alignment.

A fluid passage 495 is formed between the second lid body 400 and the second stopper 500. As the second stopper 500 rotates to a closed position, the fluid passage 495 is blocked. As the second stopper 500 rotates to an open position, the fluid passage 495 is opened to provide fluid flow.

The outer threads 535 are separated by depressions 560. The depressions 560 are breaks, openings, voids, etc. in the outer threads 535 of the second stopper 500. The depressions provide increased fluid flow when the second stopper 500 is opened. The depressions 560 provide a region or space on the exterior of the stopper 500 having a smaller external diameter than a remainder of the sidewall. The depressions 560 are oppositely disposed on the exterior of the second stopper 500. The depressions 560 are approximately 180 degrees from each other. Although the second stopper 500 is illustrated with two depressions 560, in other aspects, the second stopper 500 may include one depression 560 or three or more depressions 560.

The second stopper 500 includes one or more flexible arms 505. In this aspect, the second stopper 500 includes two flexible arms 505 at generally opposite positions, i.e., 180 degrees apart. In this aspect, the second stopper 500 includes one flexible arm 505 over each of the depressions 560.

Figure 26:
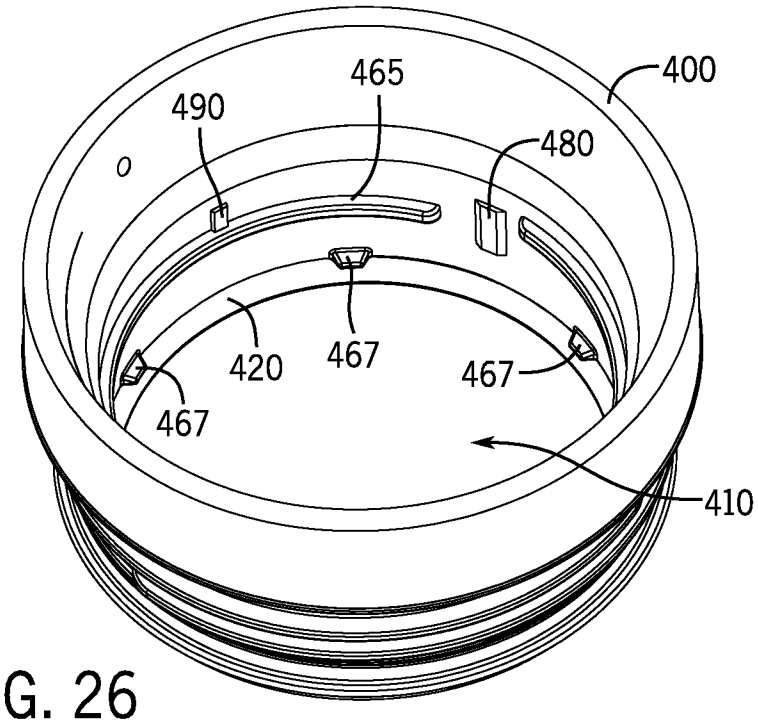
FIG. 26 is an upper perspective view of the second stopper.
Figure 25:
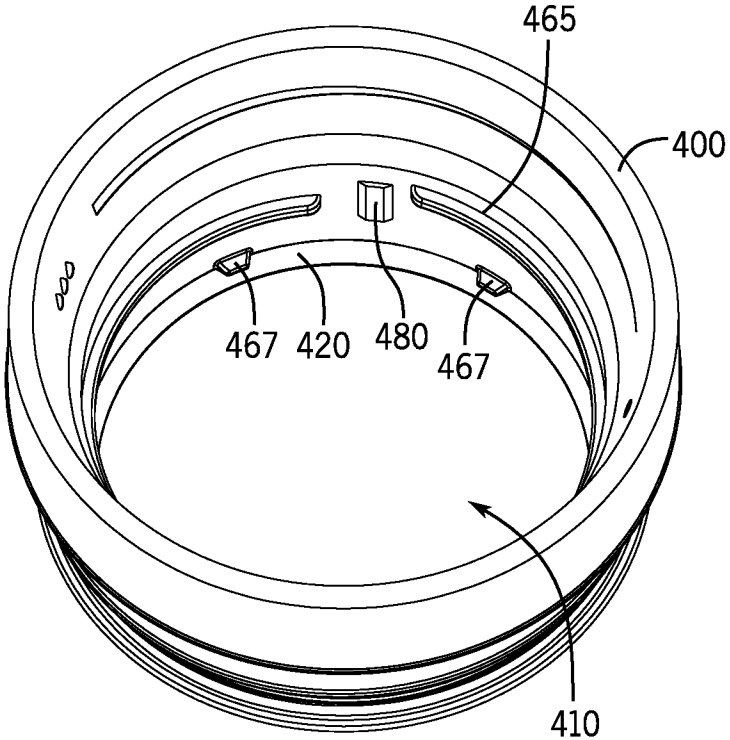
FIG. 25 is an upper perspective view of the second stopper.
Figure 27:
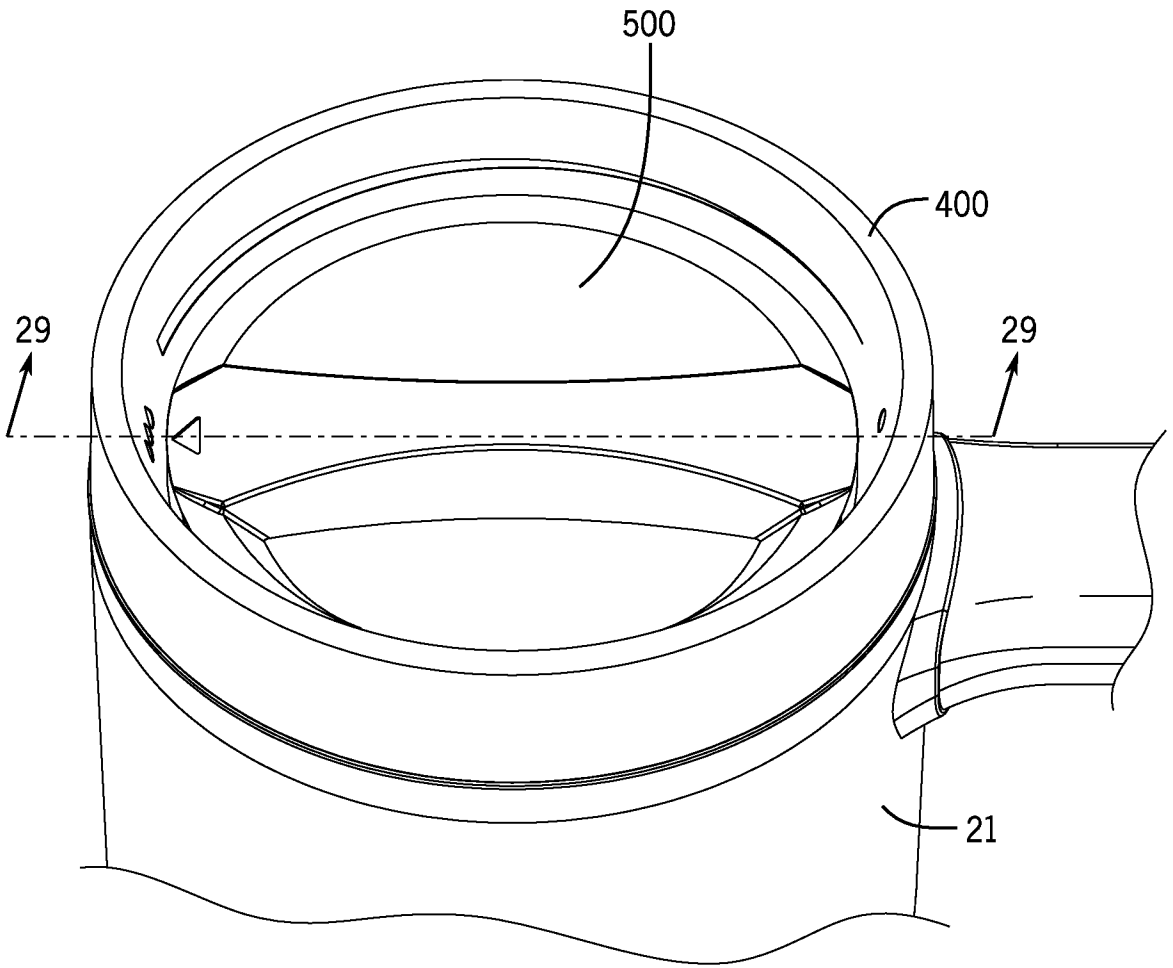
FIG. 27 is an upper perspective view of the second stopper engaged to the container.
Figure 28:
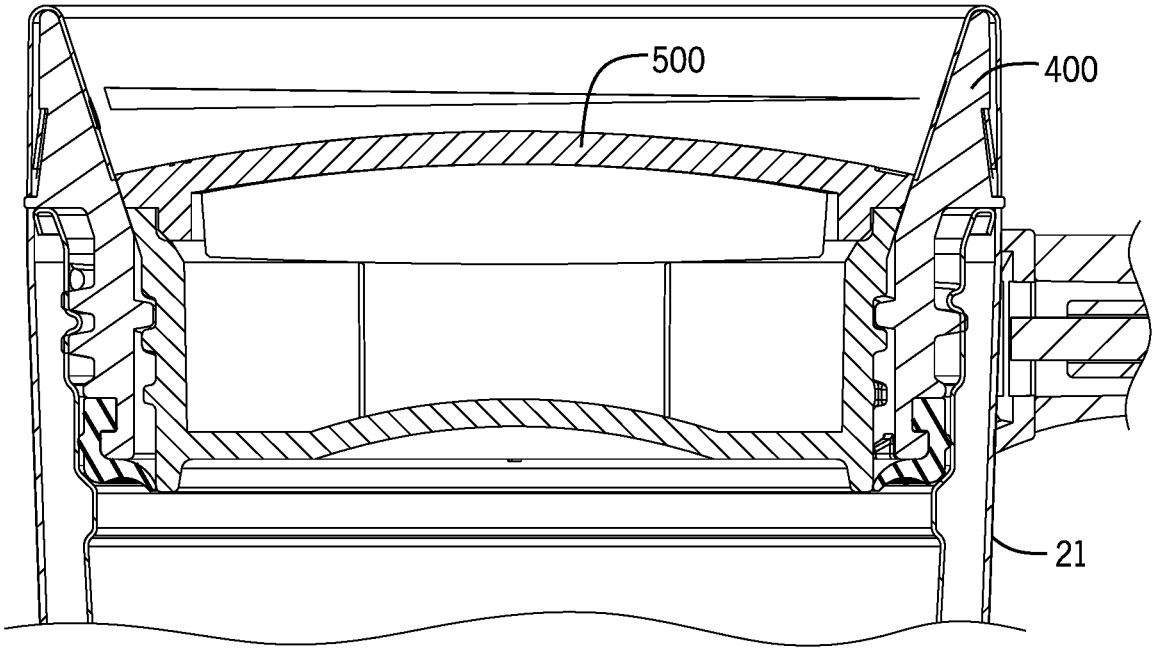
FIG. 28 is a sectional view of the second lid body and the second stopper.
Figure 29:
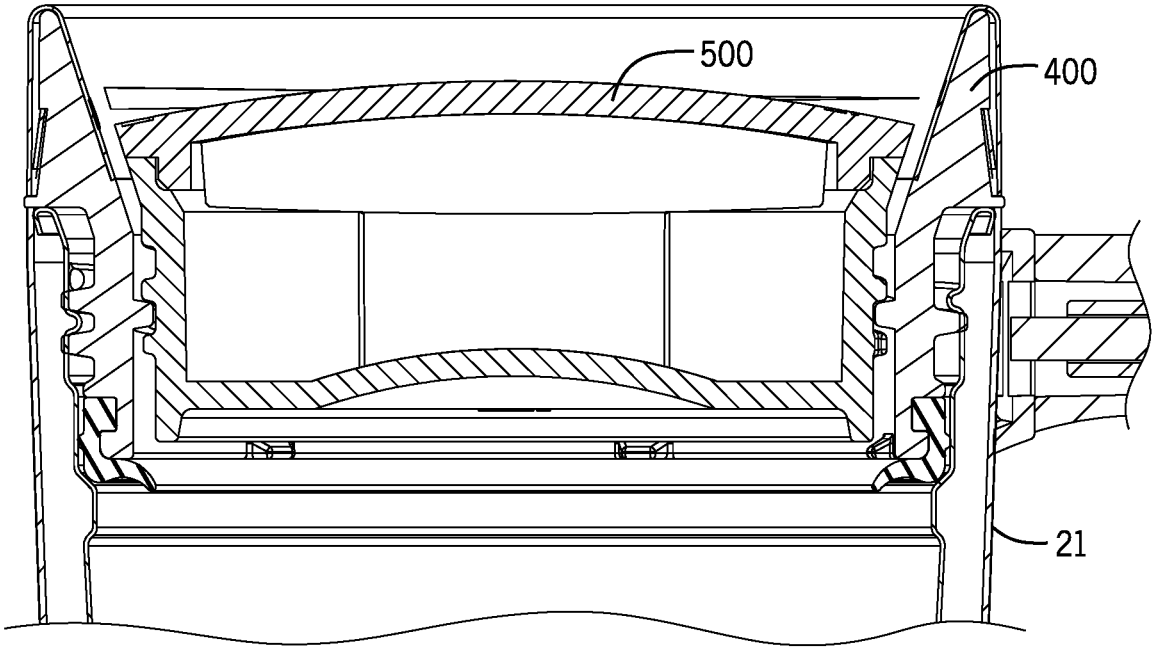
FIG. 29 is a sectional view of the second lid body and the second stopper.
Figure 30:
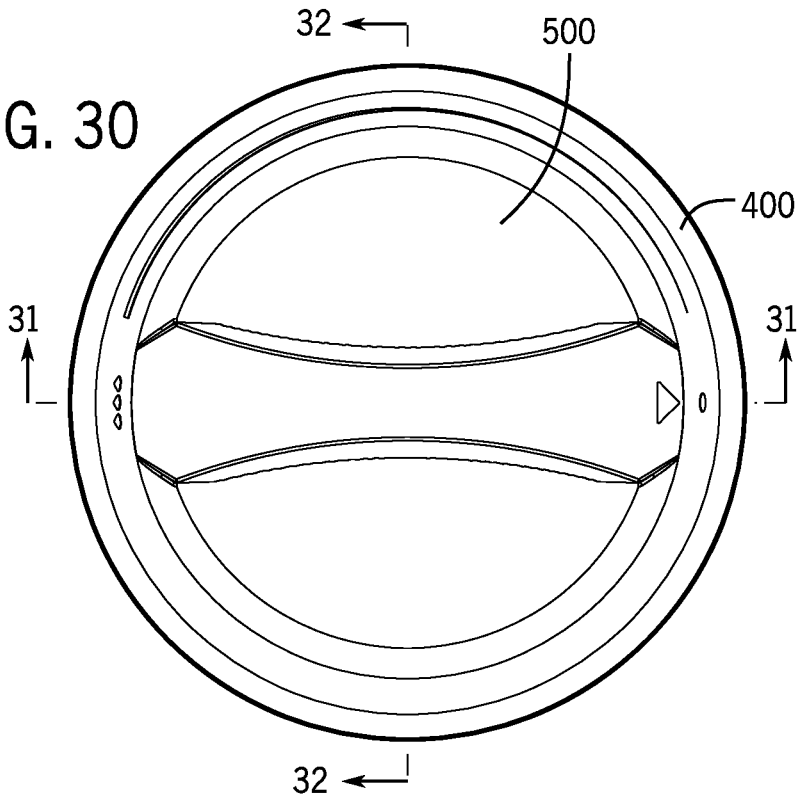
FIG. 30 is a top-down view of the second stopper in the closed position.
Figure 31:
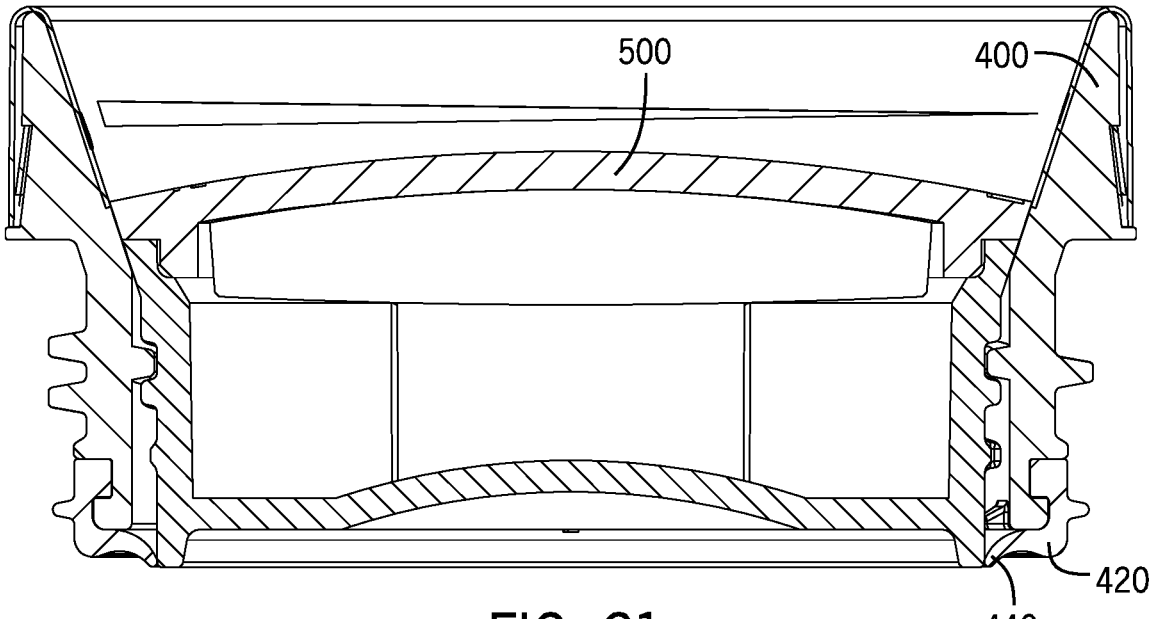
FIG. 31 is a sectional view of the second lid body and the second stopper in the closed position.
Figure 32:
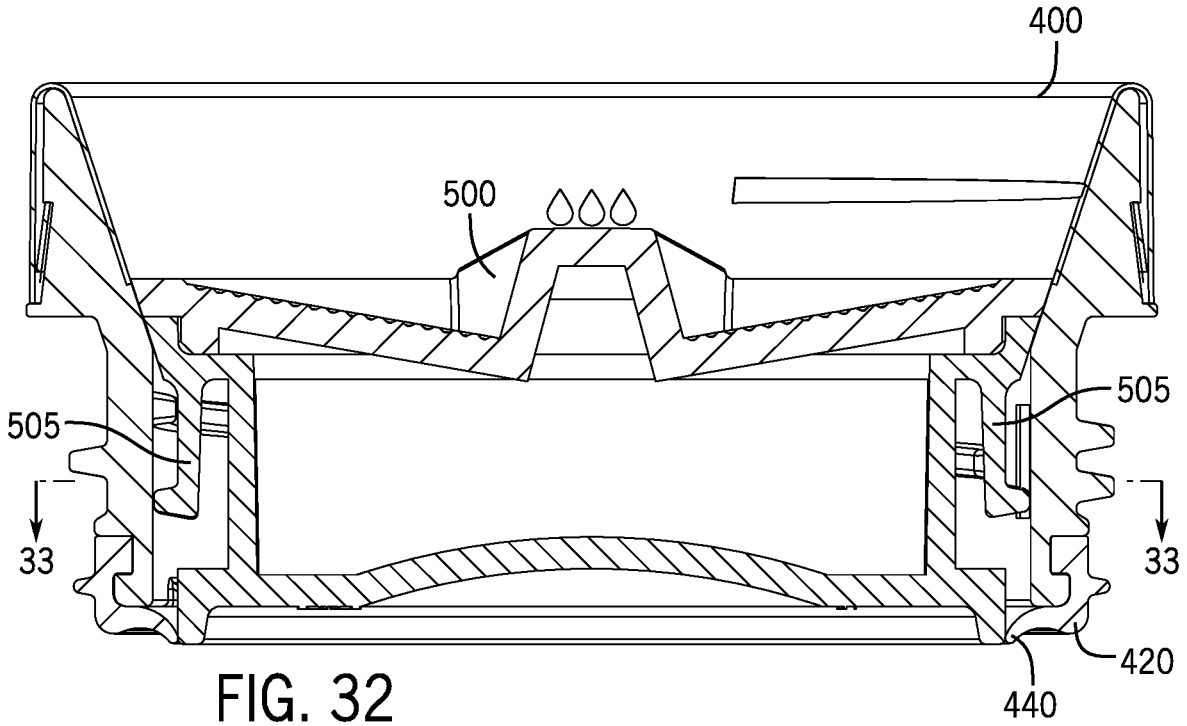
FIG. 32 is a sectional view of the second lid body and the second stopper in the closed position.
Figure 33:
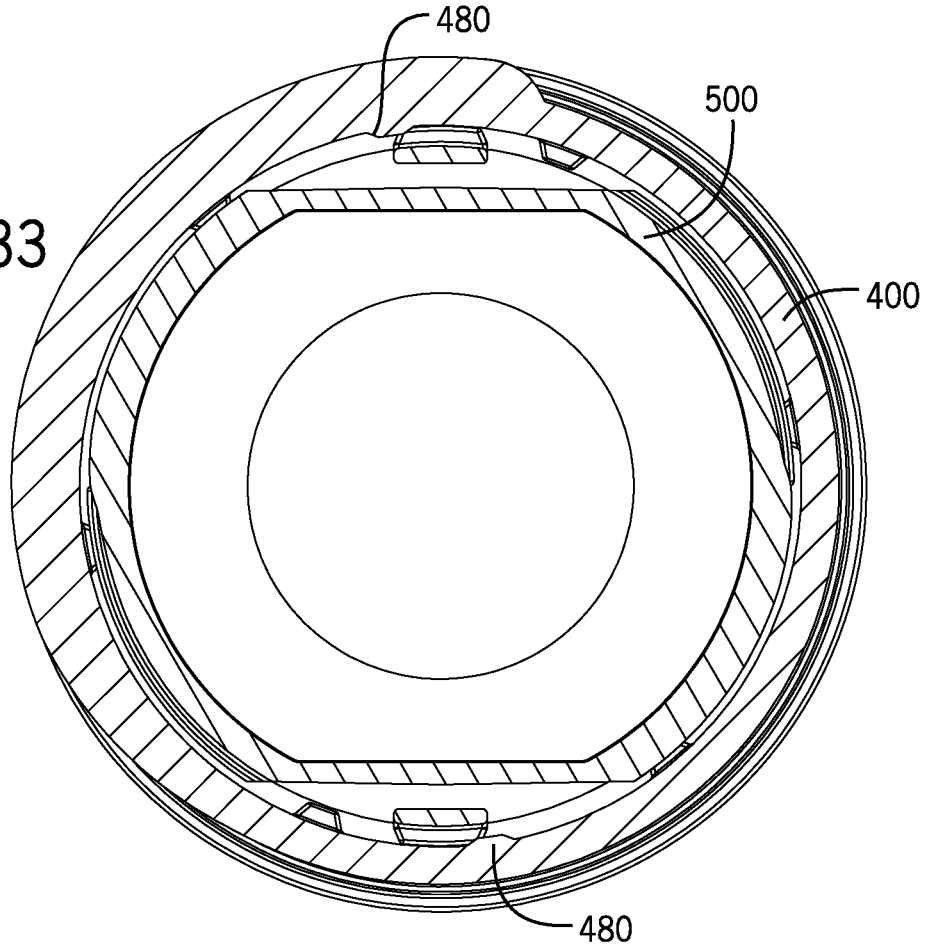
FIG. 33 is a sectional view of the second lid body and the second stopper in the closed position.
Figure 34:
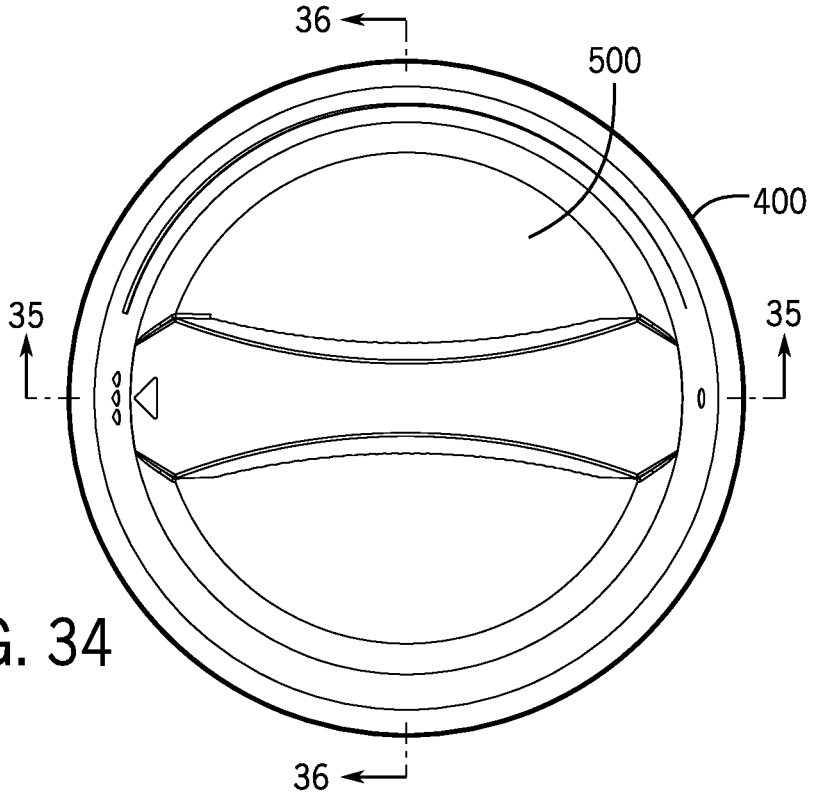
FIG. 34 is a top-down view of the second stopper in the open position.
Figure 35:
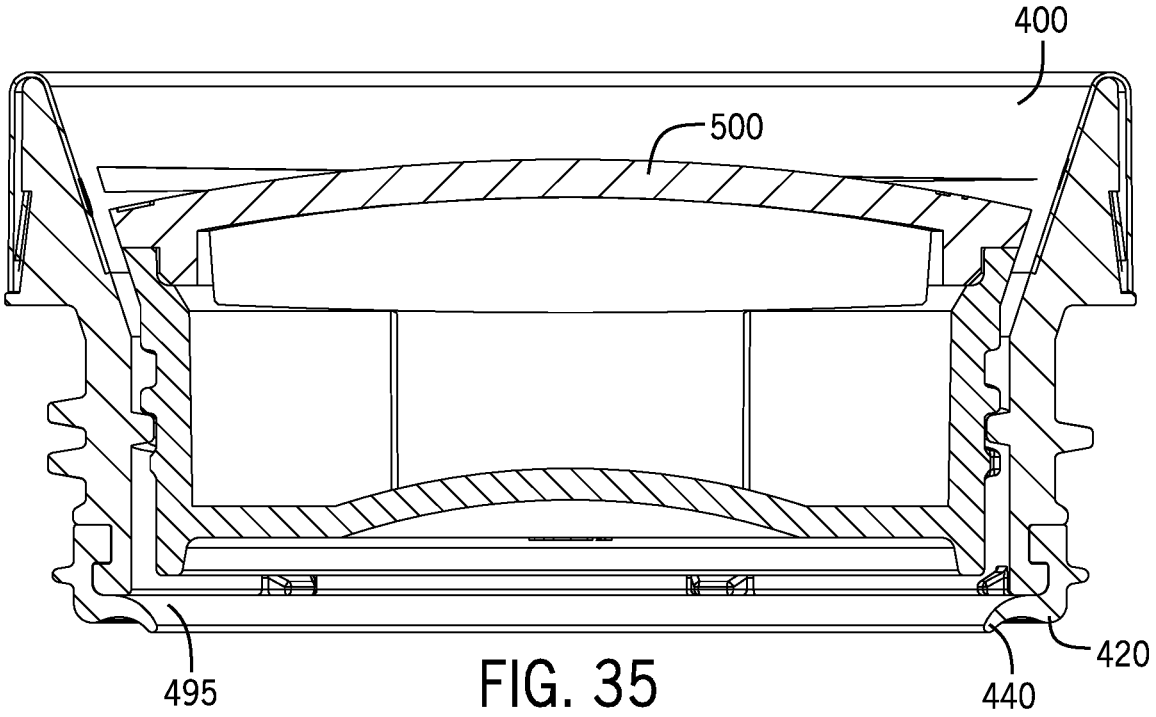
FIG. 35 is a sectional view of the second lid body and the second stopper in the open position.
Figure 36:
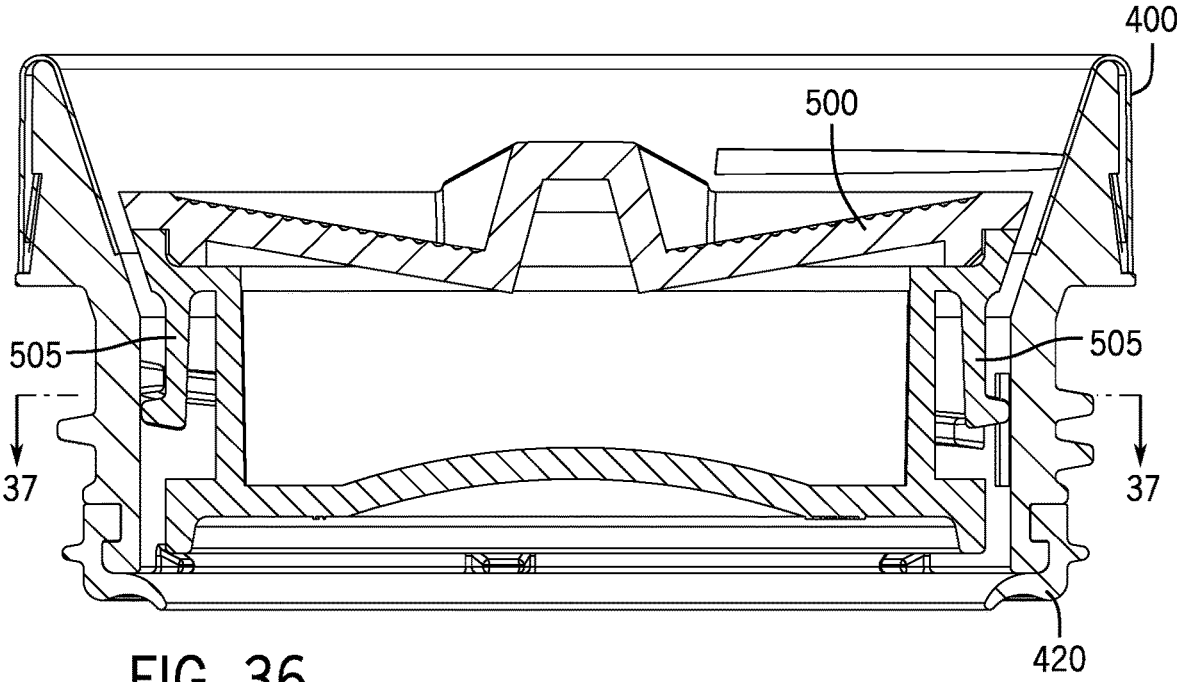
FIG. 36 is a sectional view of the second lid body and the second stopper in the open position.
Figure 37:
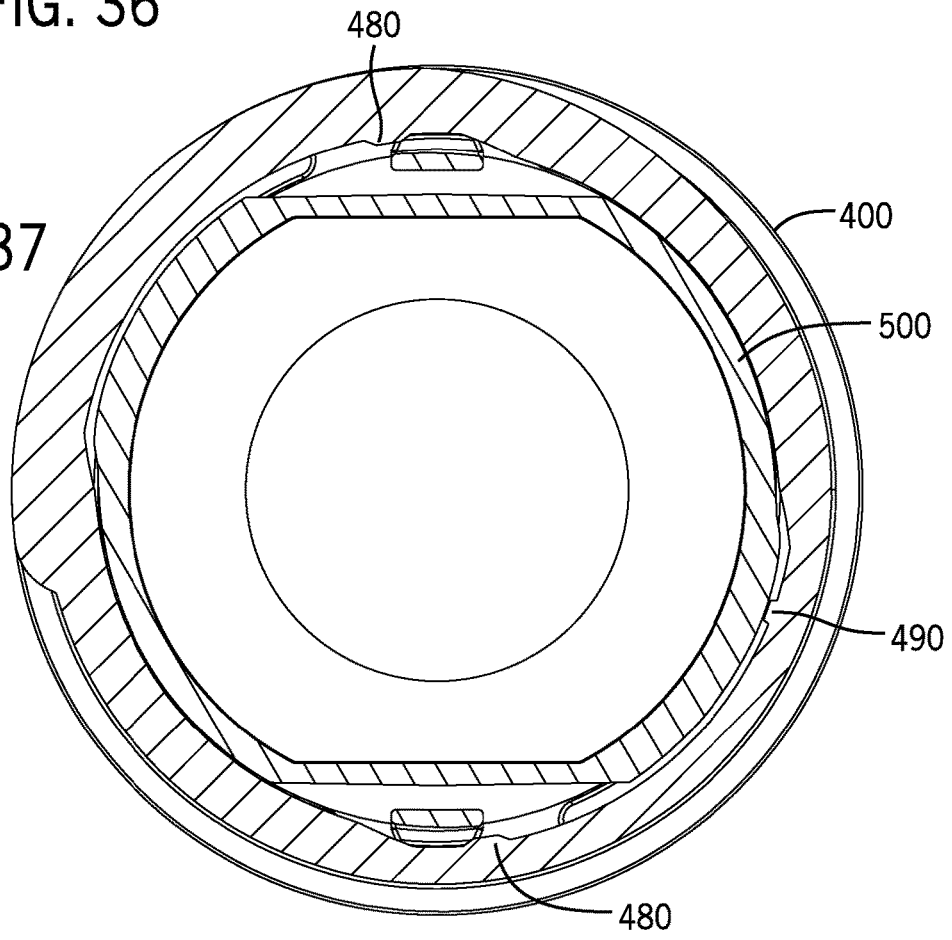
FIG. 37 is a sectional view of the second lid body and the second stopper in the open position.
Figure 39:
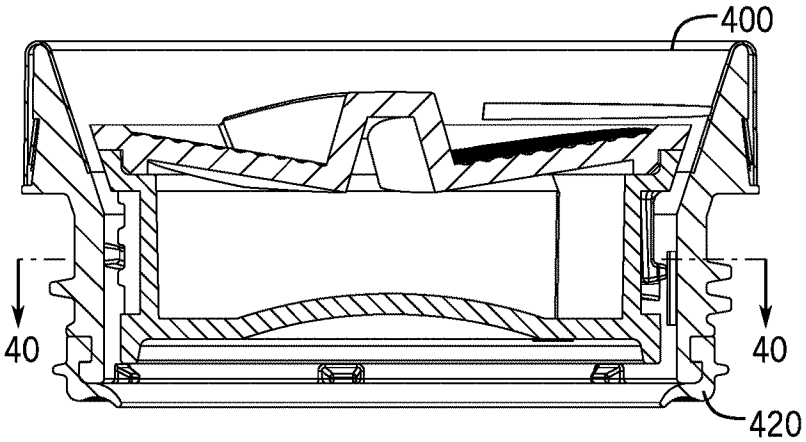
FIG. 39 is a sectional view of the second lid body and the second stopper in the removable position.
Figure 40:
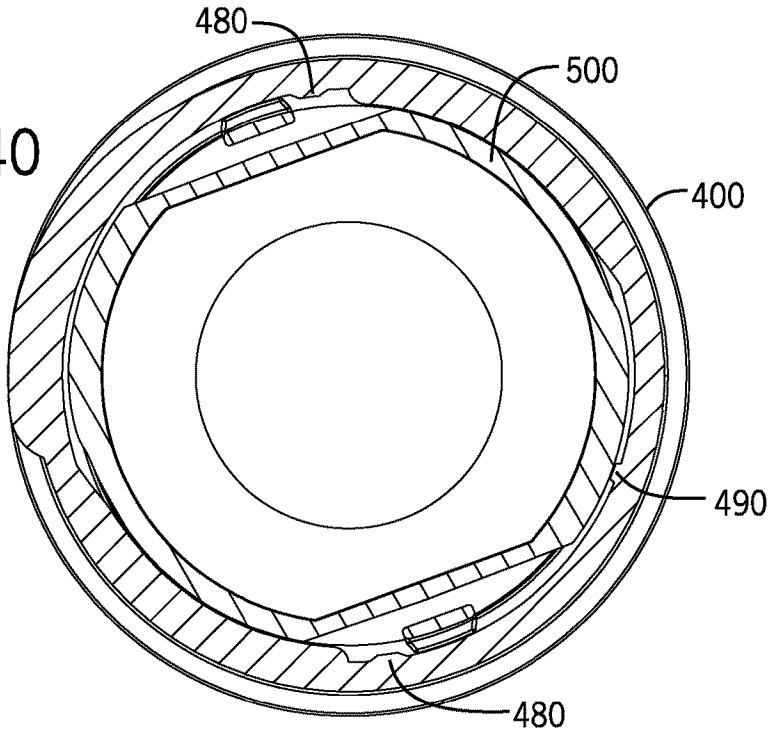
FIG. 40 is a sectional view of the second lid body and the second stopper in the removable position.
Figure 38:
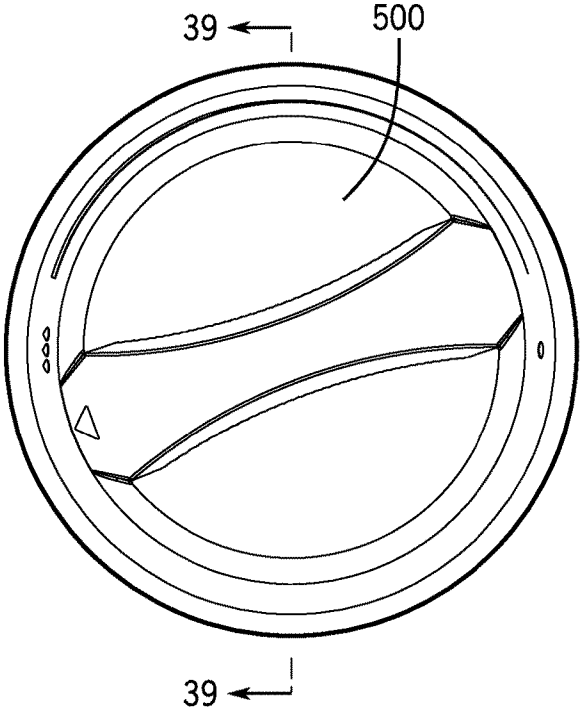
FIG. 38 is a top-down view of the second stopper in the removable position.
Figure 41:
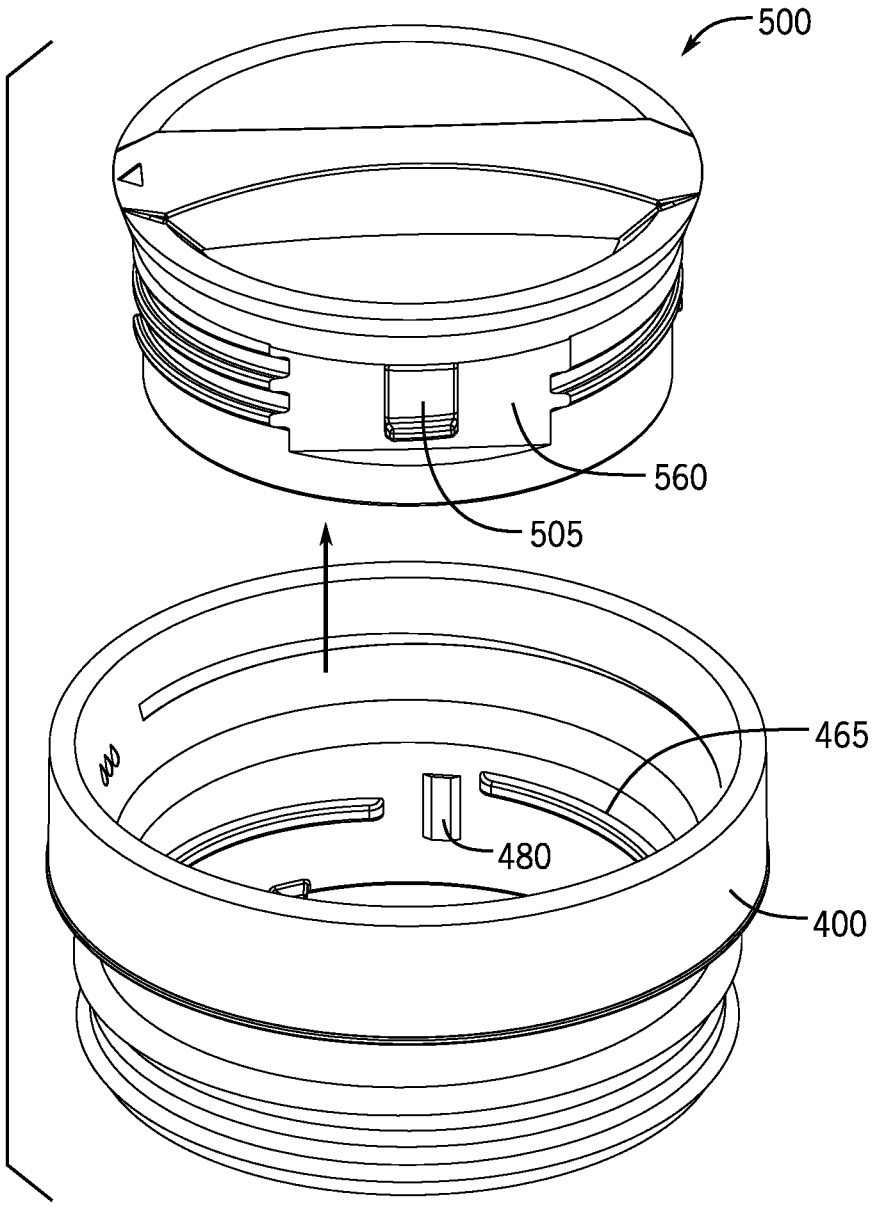
FIG. 41 is a perspective view showing the second stopper separating from the second lid body
Figure 42:
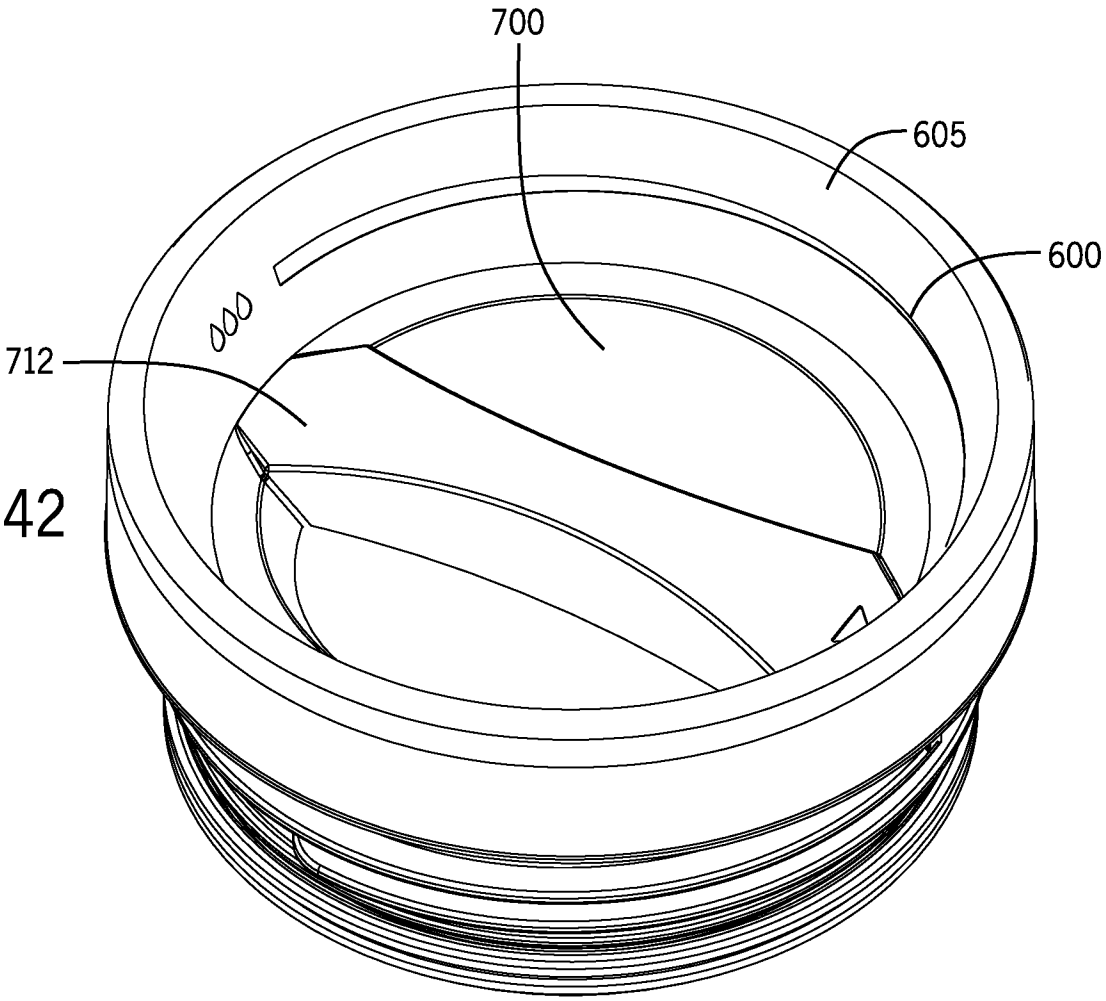
FIG. 42 is a perspective view of the third lid body and the third stopper.

An inner surface 460 of the second lid body 400 includes the inner threads 465, which threadably engage with the outer threads 535 of the second stopper 500. The inner surface 460 of the second lid body 400 includes at least two different types or style of protrusions with different physical or structural characteristics that operate in different manners when contacted by the flexible arms 505. With reference to FIGS. 25 and 26, in this aspect, the inner surface 460 includes two soft protrusions 480 and one hard protrusion 490. When the one or more flexible arms 505 passes over either of the two soft protrusions 480, the interaction provides an audible or tactile indication that the second stopper 500 is now in an open position for drinking. In order for the one or more flexible arms 505 to rotate past the hard protrusion 490, the user must rotate the second stopper 500 with added force.

In order to remove the second stopper 500 from the second lid body 400, the user must rotate the second stopper 500 past the hard protrusion 490. This requires more turning force than was needed for the second stopper 500 to rotate past the two soft protrusions 480. Thus, an indication is provided to the user that they are moving from the open position of the second stopper 500 to removable position of the second stopper 500. If the user tries to drink when the second stopper 500 is in the removable position, it is possible for excessive leaking.

In this aspect, the second stopper 500 is free to keep rotating until removed from the second lid body 400. The two soft protrusions 480 provide an indication that the second stopper 500 is in an open position for drinking, while the hard protrusion 490 provides an indication that the 500 is now in a removable position. As described above, the user must apply a greater rotational force to the second stopper 500 in order for the one or more flexible arms 505 to rotate past the hard protrusion 490 than the rotational force needed for the one or more flexible arms 505 to rotate past the two soft protrusions 480.

In this aspect, the hard protrusion 490 is generally larger, protrudes further than the two soft protrusions 480, or has a contact surface with a sharper angle. As shown in FIGS. 25 and 26, the two soft protrusions 480 have a gentler slope than the hard protrusion 490.

The one or more flexible arms 505 extend downward from an upper perimeter 515 of the second stopper 500. In this aspect, the one or more flexible arms 505 are integral with the upper perimeter 515 of the second stopper 500 The one or more flexible arms 505 includes a tab portion 507 that extends outward (away from a central axis of the second stopper 500). Lateral sides 509 of the one or more flexible arms 505 contact the two soft protrusions 480 and the hard protrusion 490. A space 565 is formed between the one or more flexible arms 505 and the depressions 560. The space 565 provides room for the one or more flexible arms 505 to deflect inward when contacting the two soft protrusions 480 and the hard protrusion 490.

Bumps 467 are positioned on the inner surface 460 of the lid body 400, which helps to maintain the proper position of the gasket 420. The bumps 467 may prevent an inward sealing portion 440 from rolling or flexing upward. The bumps 467 may further assist in aligning the second stopper 500 with the lid body 400. The bumps 467 may reduce accidental cross-threading if the second stopper 500 is accidentally inserted into the second lid body 400 at too much of an angle.

The third lid body 600 and the third stopper 700 will now be described with reference to FIGS. 42-57:

The third lid body 600 includes an upper rim 605 around a central opening 610. The upper rim 605 may come in contact with a mouth of a user when the user wishes to drink. The upper rim 605 leads to or defines the central opening 610 that is generally open to receive the third stopper 700.

The third stopper 700 includes an upper surface 710 generally opposite of a lower surface 720. The upper surface 710 includes an optional handle portion 712. The third stopper 700 includes a central portion 723 that is generally solid without any openings or passages for fluid flow. The size and shape of the third stopper 700 is configured to close the central opening 610 of the third lid body 600.

A sidewall 730 of the third stopper 700 joins the upper surface 710 and the lower surface 720. An outer surface 733 of the sidewall 730 includes outer threads 735 that threadably engage with inner threads 665 of the third lid body 600. In this aspect, the third lid body 600 and the third stopper 700 are single threaded.

A fluid passage 695 is formed between the third lid body 600 and the third stopper 700. As the third stopper 700 rotates to a closed position, the fluid passage 695 is blocked. As the third stopper 700 rotates to an open position, the fluid passage 695 is opened to provide fluid flow.

The outer threads 735 are separated by depressions 760. The depressions 760 are breaks, openings, voids, etc. in the outer threads 735 of the third stopper 700. The depressions provide increased fluid flow when the third stopper 700 is opened. The depressions 760 provide a region or space on the exterior of the stopper 700 having a smaller external diameter than a remainder of the sidewall 730. The depressions 760 are oppositely disposed on the exterior of the third stopper 700. The depressions 760 are approximately 180 degrees from each other. Although the third stopper 700 is illustrated with two depressions 760, in other aspects, the third stopper 700 may include one depression 760 or three or more depressions 760.

The third stopper 700 includes one or more flexible arms 705. In this aspect, the third stopper 700 includes two flexible arms 705 at generally opposite positions, i.e., 180 degrees apart. In this aspect, the third stopper 700 includes one flexible arm 705 over each of the depressions 760.

Figure 43:
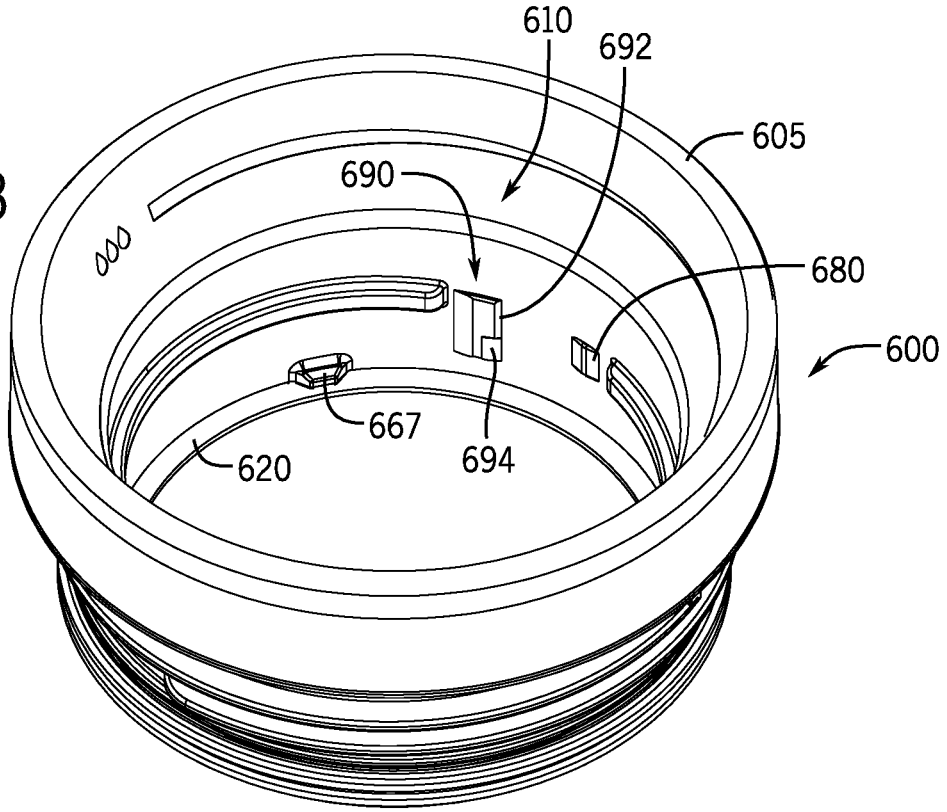
FIG. 43 is a perspective view of the third lid body.
Figure 44:
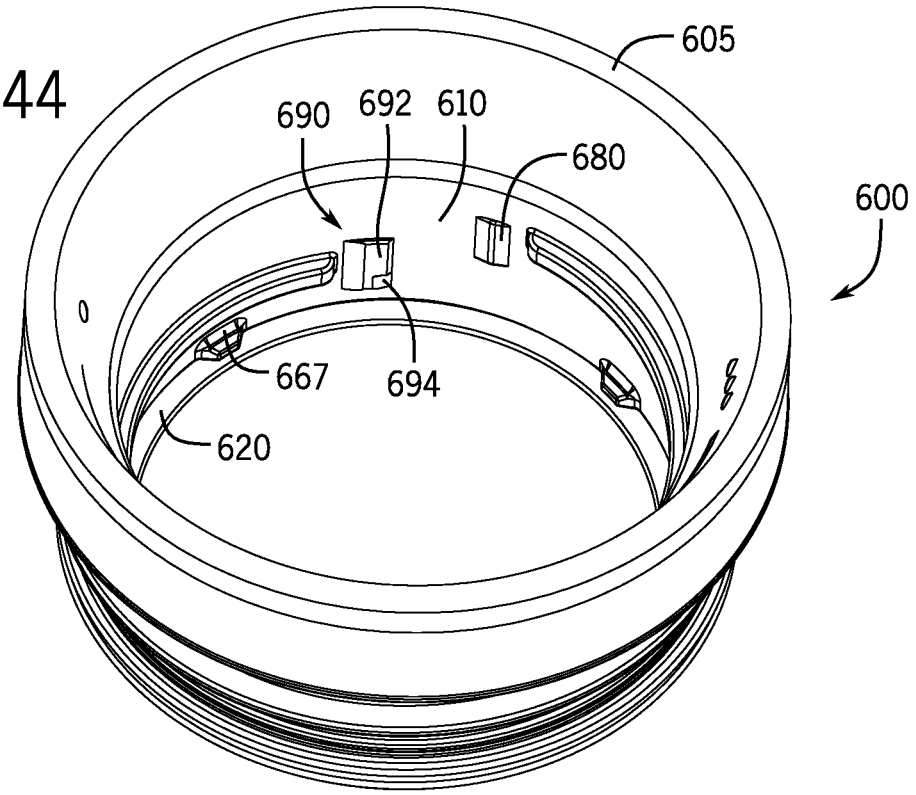
FIG. 44 is a perspective view of the third lid body.
Figure 45:
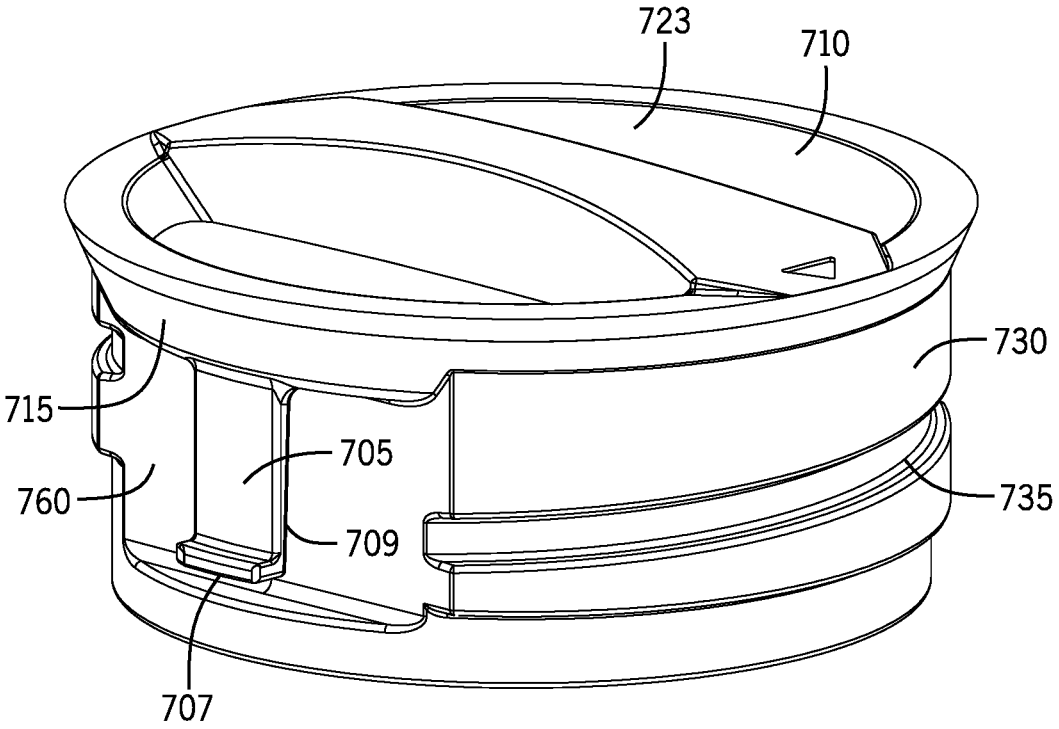
FIG. 45 is a perspective view of the third stopper.
Figure 46:
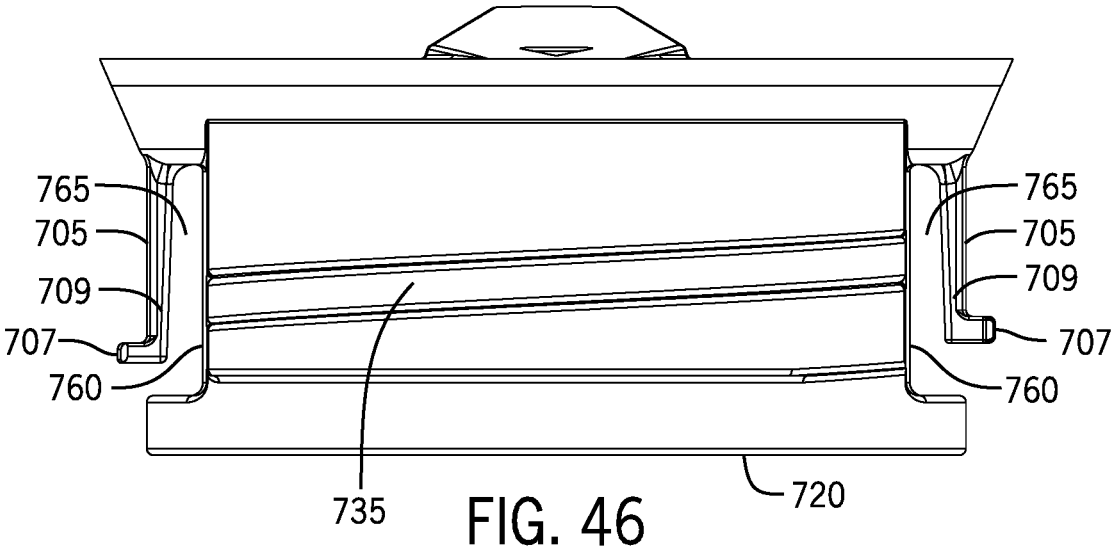
FIG. 46 is a side view of the third stopper.
Figure 47:
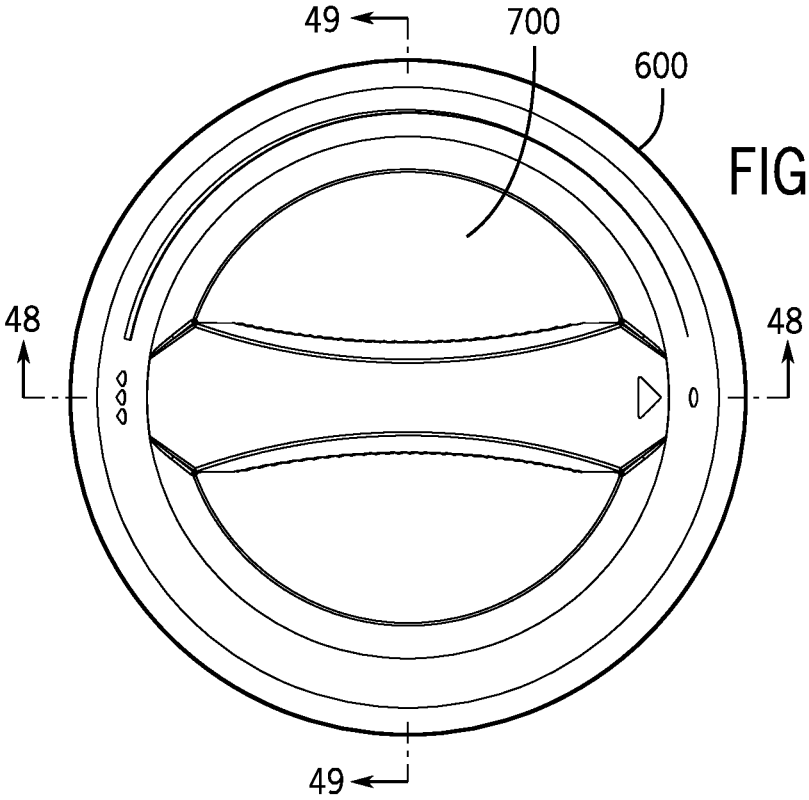
FIG. 47 is an upper view of the third stopper engaged to the third lid body in the closed position.
Figure 48:
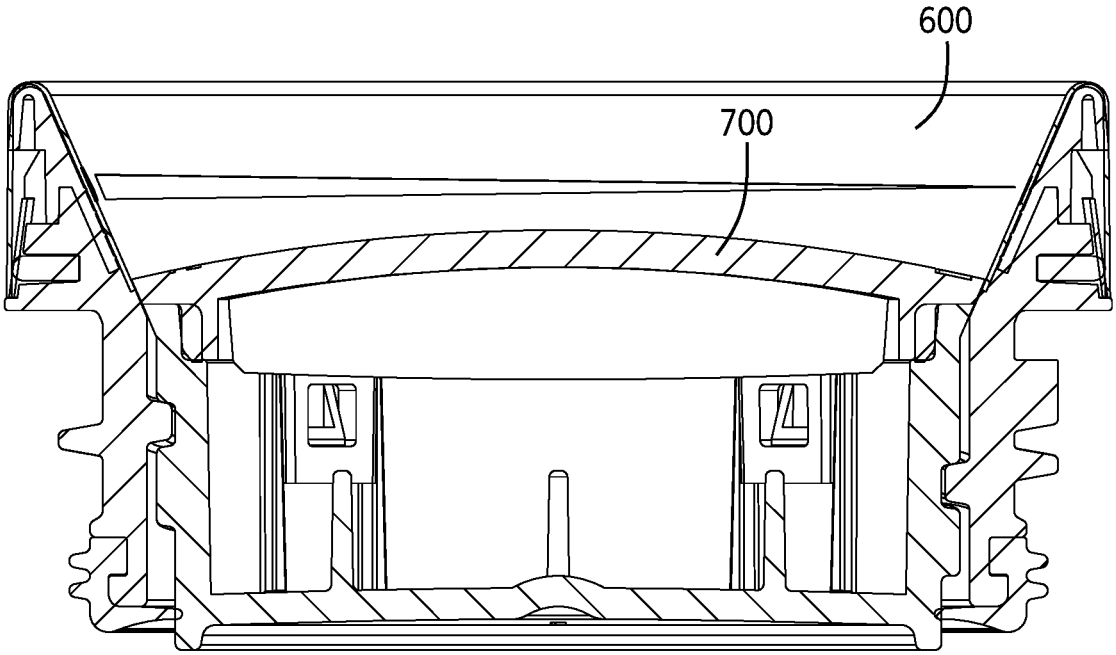
FIG. 48 is a sectional view of the third lid body and the third stopper in the closed position.
Figure 53:
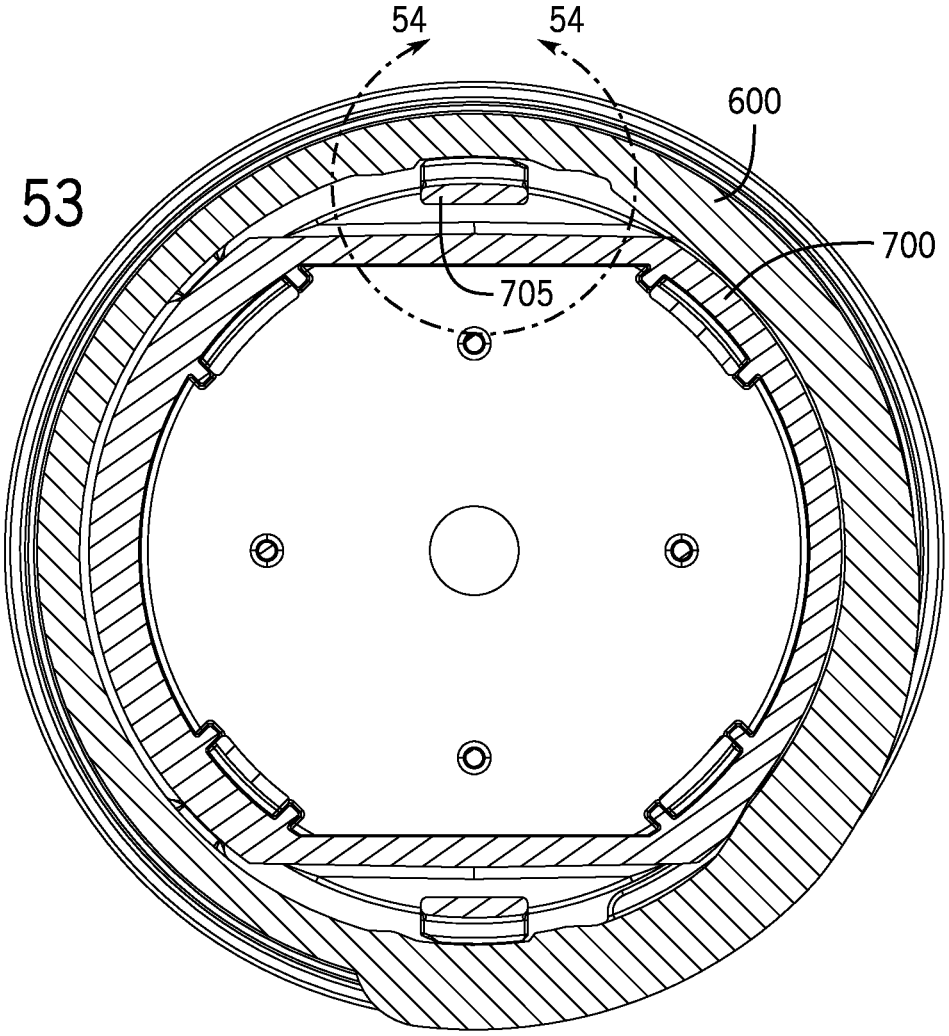
FIG. 53 is a sectional view of the third lid body and the third stopper in the open position.
Figure 54:
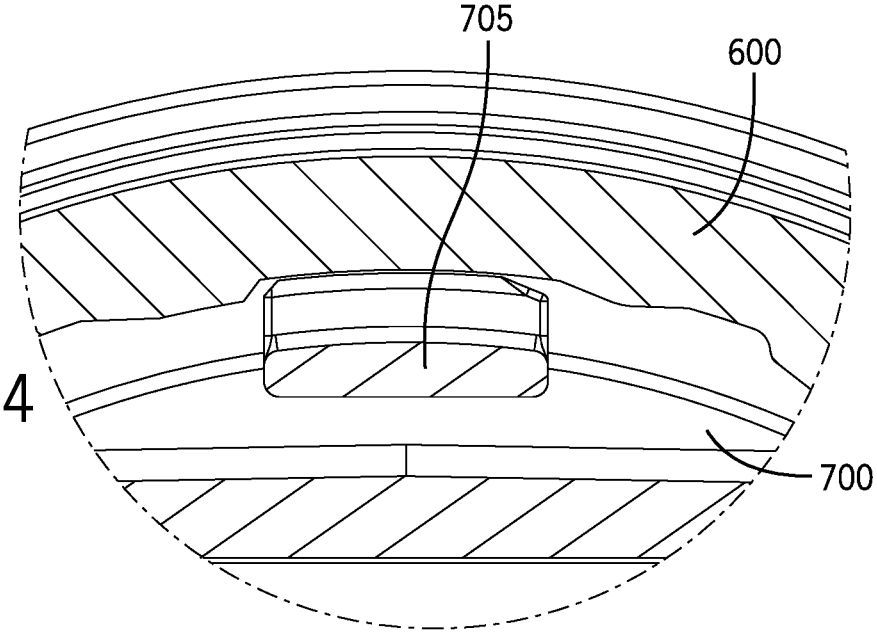
FIG. 54 a sectional view of the third lid body and the third stopper in the open position.
Figure 55:
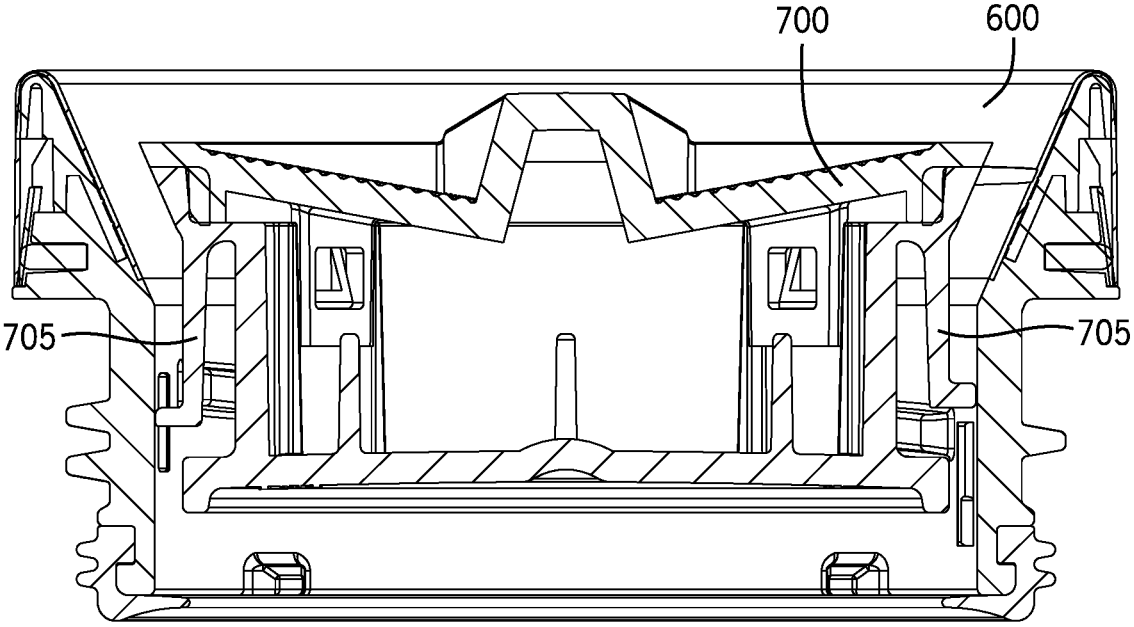
FIG. 55 is a sectional view of the third lid body and the third stopper in the removable position.
Figure 56:
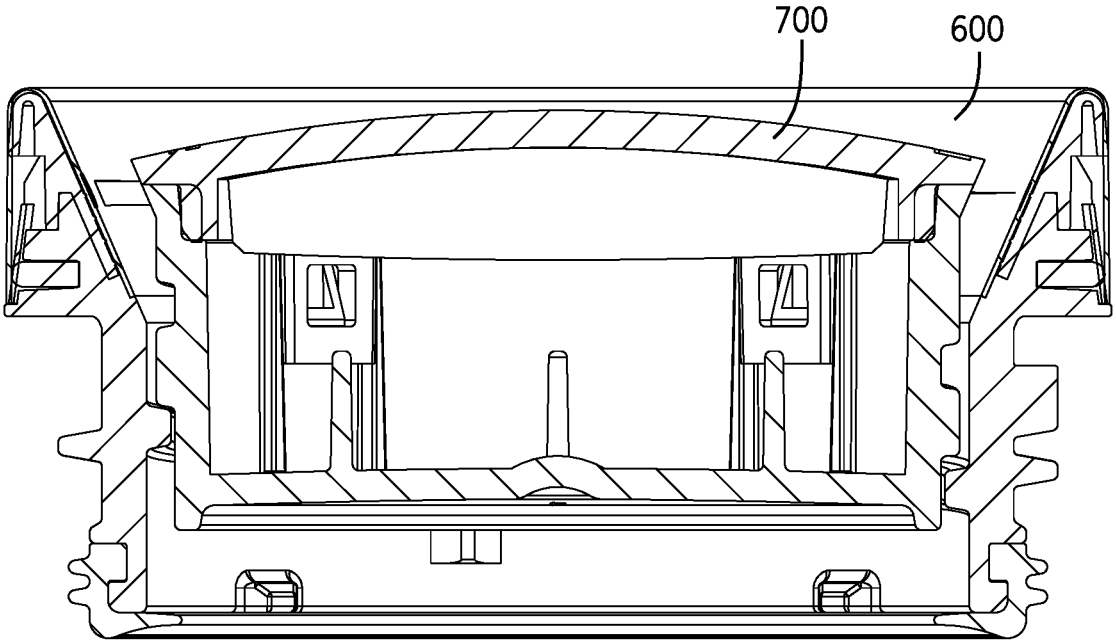
FIG. 56 is a sectional view of the third lid body and the third stopper in the removable position.
Figure 57:
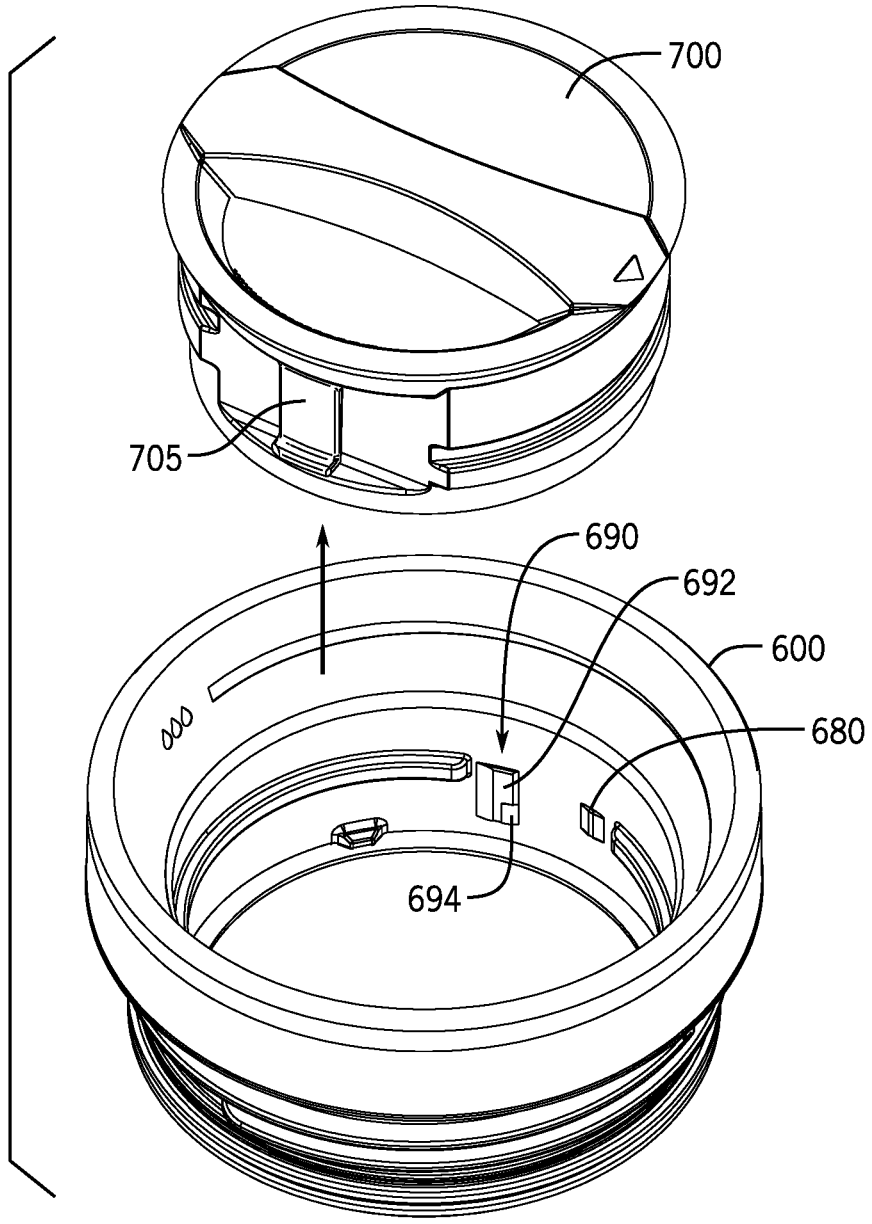
FIG. 57 is a perspective view of the fourth stopper separating form the fourth lid body.
Figure 59:
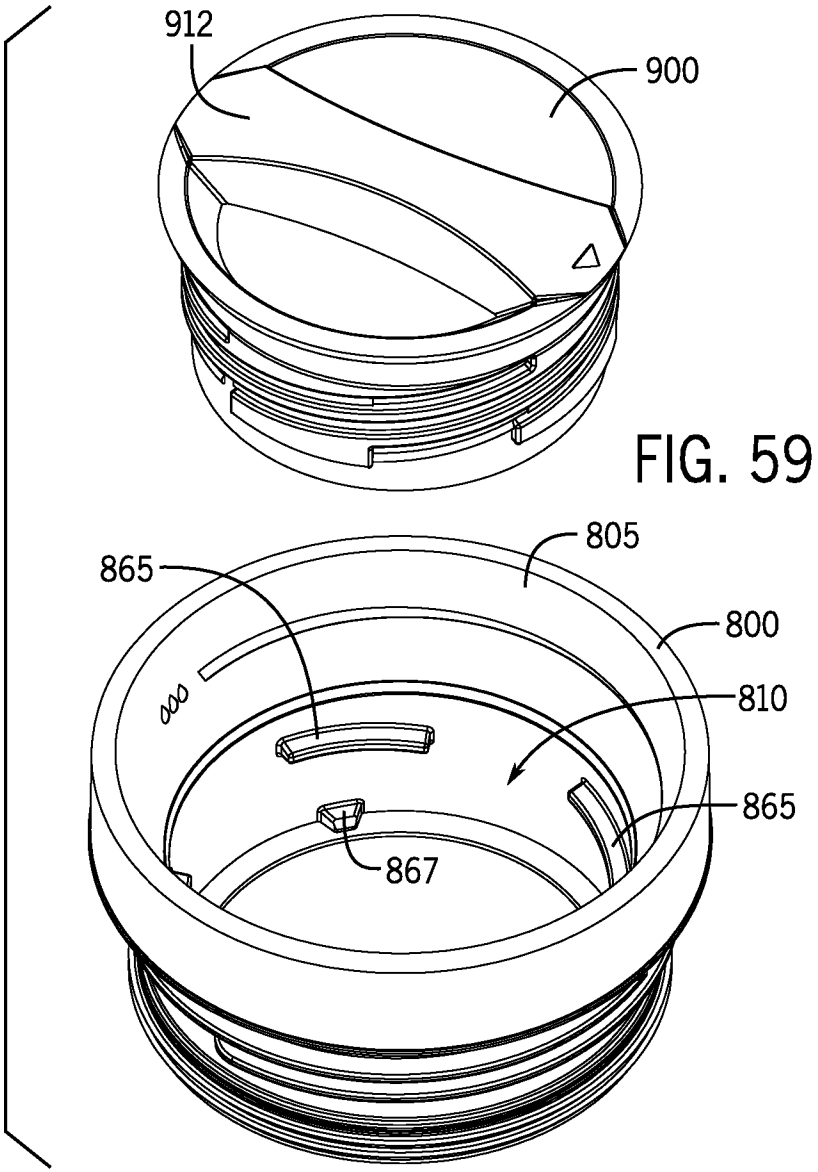
FIG. 59 is a perspective view of the fourth stopper engaged to the fourth lid body.
Figure 58:
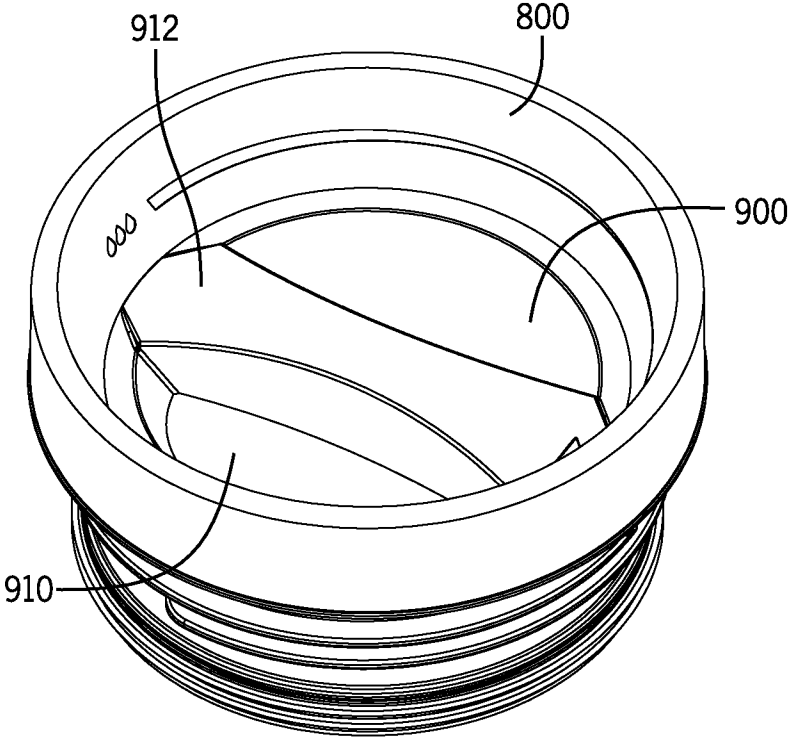
FIG. 58 is a perspective view of the fourth lid body and the fourth stopper.
Figure 60:
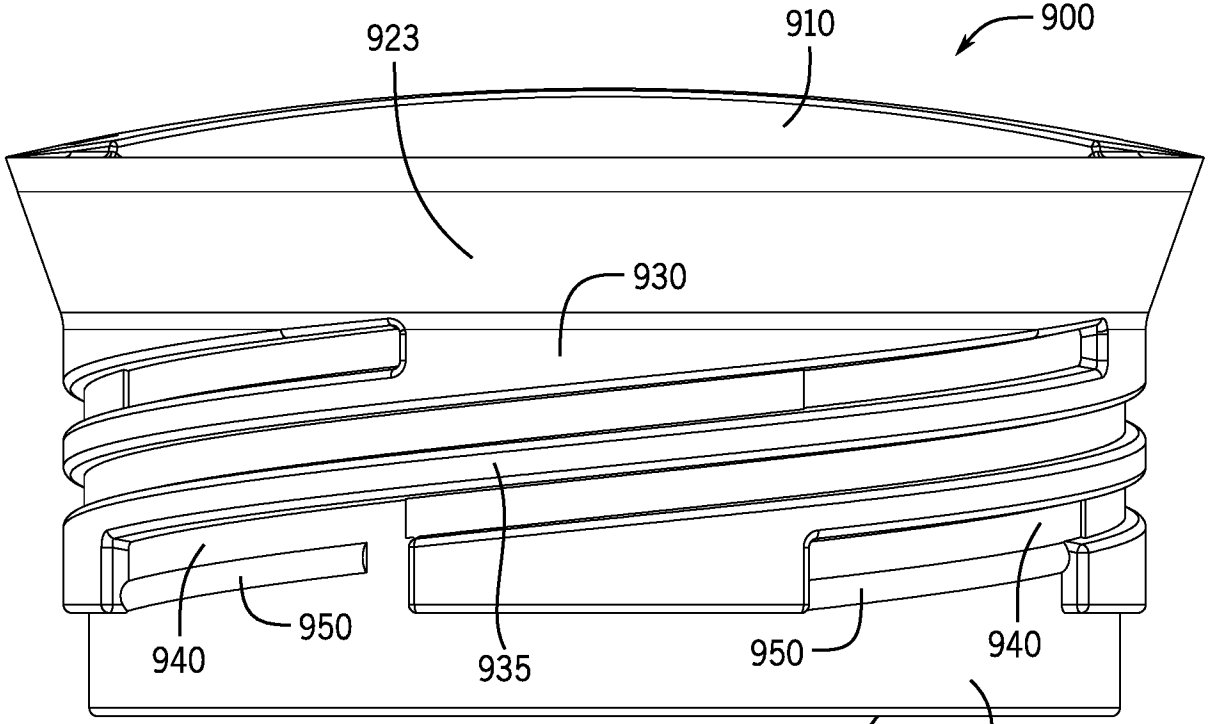
FIG. 60 is a side view of the fourth stopper.
Figure 61:
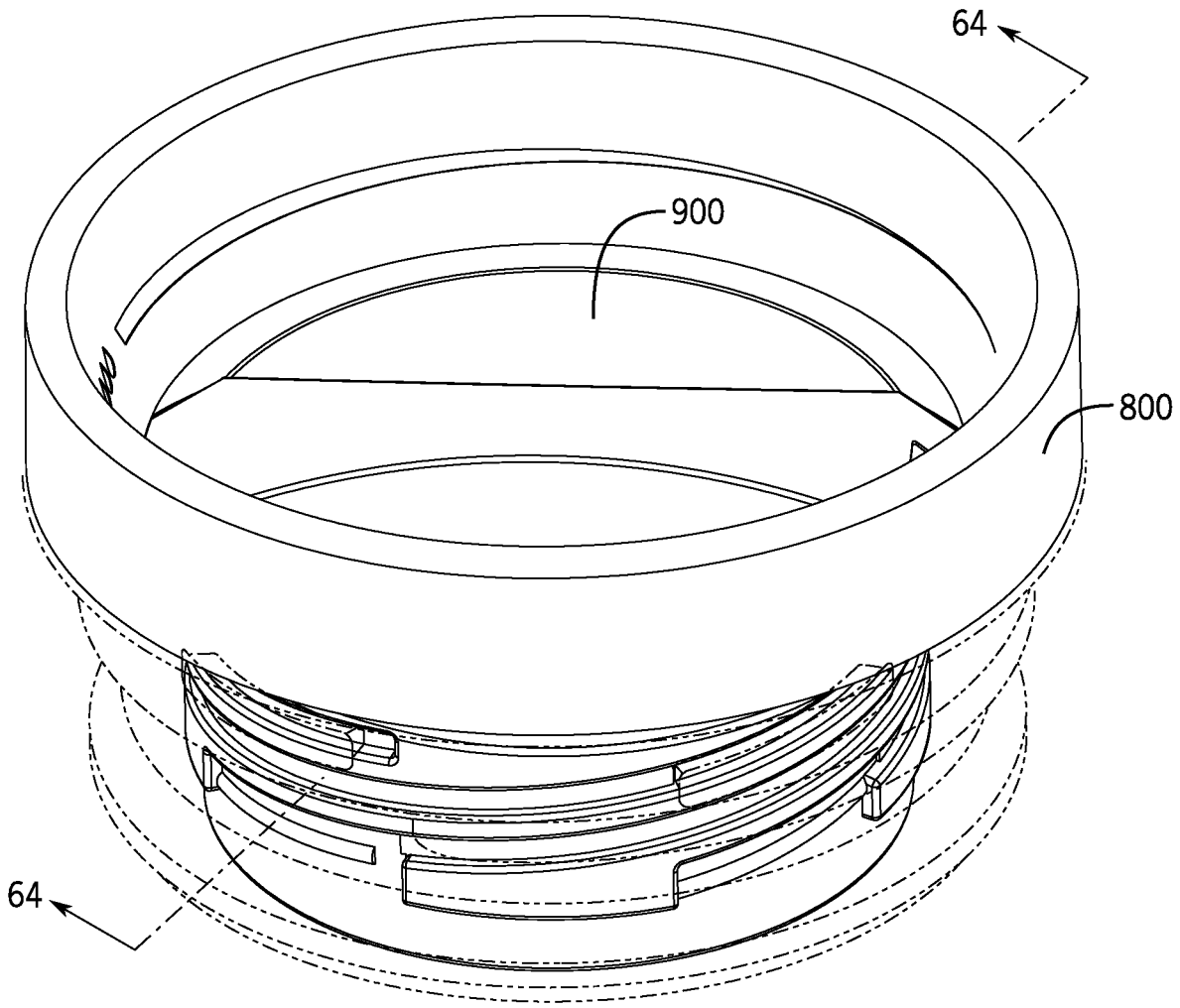
FIG. 61 is a perspective view of the fourth stopper engaged to the fourth lid body.
Figure 62:
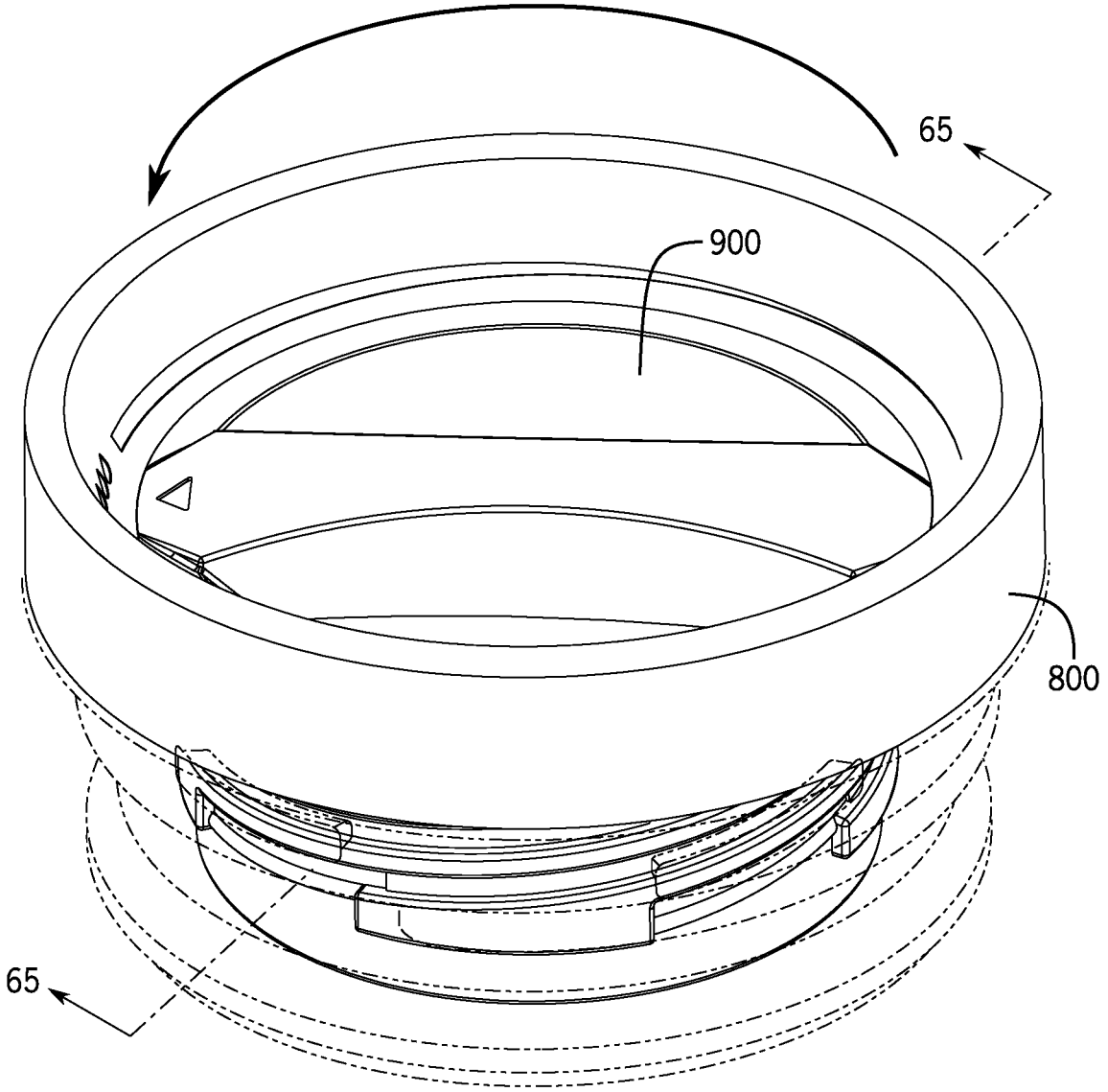
FIG. 62 is a perspective view of the fourth stopper engaged to the fourth lid body.
Figure 63:
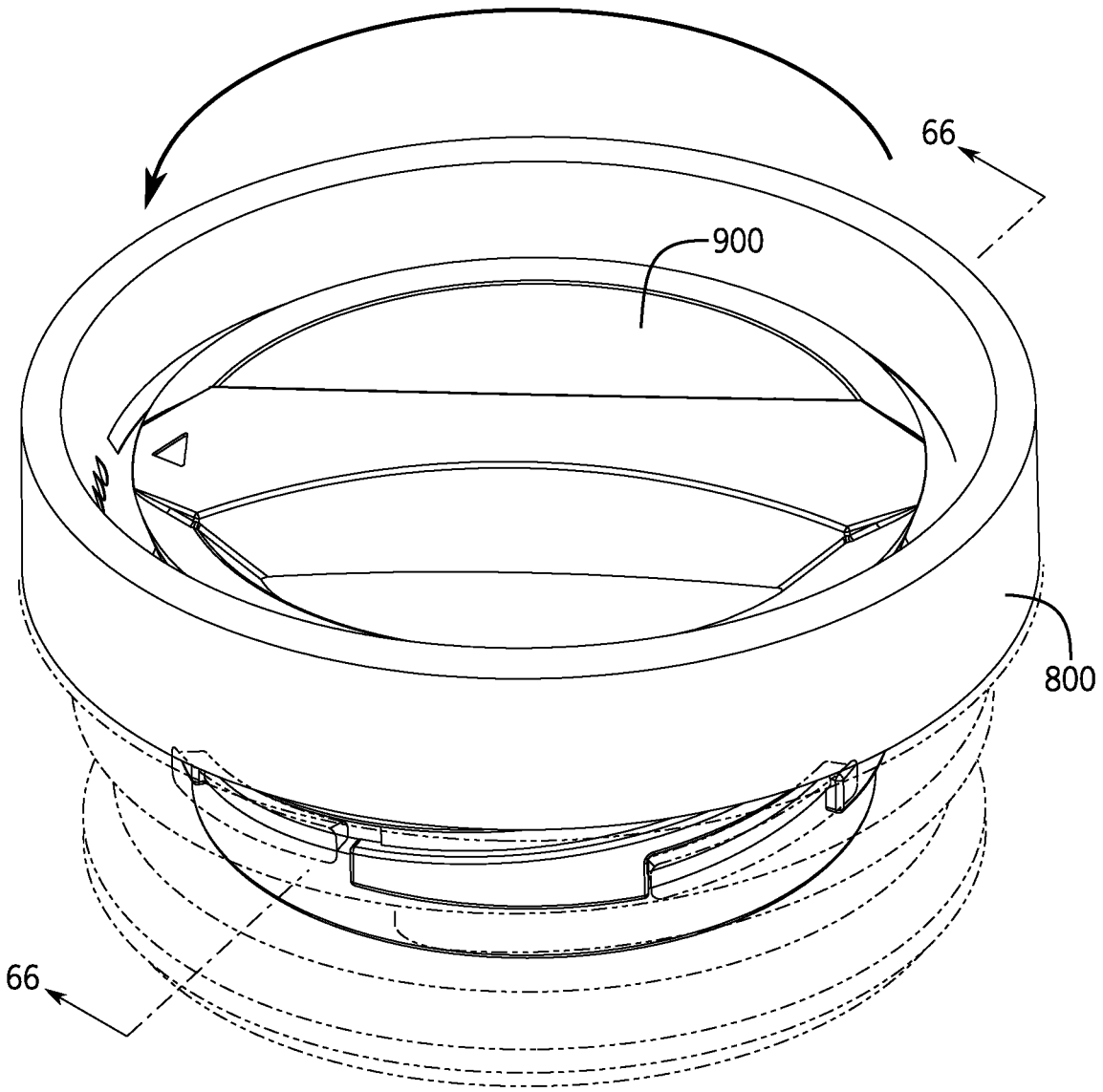
FIG. 63 is a perspective view of the fourth stopper engaged to the fourth lid body.
Figure 64:
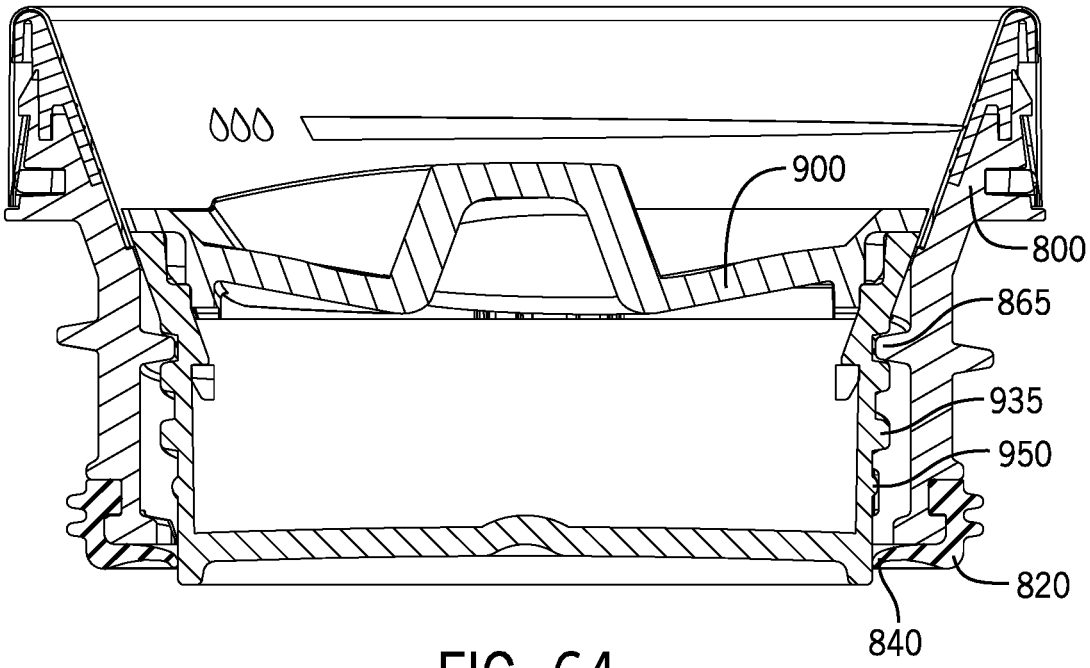
FIG. 64 is a sectional view of the fourth stopper engaged to the fourth lid body.

An inner surface 660 of the third lid body 600 includes the inner threads 665, which threadably engage with the outer threads 735 of the third stopper 700. The inner surface 660 of the lid body 600 includes at least two different types or style of protrusions with different physical or structural characteristics that operate in different manners when contacted by the flexible arms 705. With reference to FIGS. 43 and 44, in this aspect, the inner surface 660 includes one soft protrusion 680 and one combination protrusion 690 on opposite sides of the inner surface 660. Thus, in this aspect, there are two soft protrusions 680 and there are two combination protrusions 690.

In this aspect, the combination protrusion 690 includes multiple different zone or regions that interact or engage the one or more flexible arms 705 in different manners. In this aspect, the combination protrusions 690 include an upper region 692 and a lower region 694. The upper region 692, in this aspect, is generally larger, protrudes further than the lower region 694 or the soft protrusion 680, or has a contact surface with a sharper angle. As shown in FIGS. 43 and 44, the soft protrusion 680 and the lower region 694 have a gentler slope than compared to the upper region 692 of the combination protrusion 690.

During an opening rotation of the third stopper 700, the one or more flexible arms 705 may first contact the lower region 694 of the combination protrusion 690 to signal that the third stopper 700 is in an open position for drinking. As the rotation of the third stopper 700 continues in the opening direction, the one or more flexible arms 705 may next contact the upper region 692 to signal that the third stopper 700 is now in a removable position.

When the one or more flexible arms 705 passes over either of the two soft protrusions 680 or the lower regions 694, the interaction provides an audible or tactile indication that the third stopper 700 is now in an open position for drinking. In order for the one or more flexible arms 705 to continue rotate past the upper region 692 of the combination protrusion 690, the user must rotate the third stopper 700 with added force.

In order to remove the third stopper 700 from the third lid body 600, the user must rotate the third stopper 700 past the upper region 692 of the combination protrusion 690. This requires more turning force than was needed for the third stopper 700 to rotate past the soft protrusion 680 or the lower region 694. Thus, an indication is provided to the user that they are moving from the open position of the third stopper 700 to removable position of the third stopper 700. If the user tries to drink when the third stopper 700 is in the removable position, it is possible for excessive leaking. In this aspect, the third stopper 700 is free to keep rotating until removed. The soft protrusion 680 and the lower region 694 provides an indication that the third stopper 700 is in an open position for drinking, while the upper region 692 of the combination protrusion 690 provides an indication that the 700 is now in a removable position. As described above, the user must apply a greater rotational force to the third stopper 700 in order for the one or more flexible arms 705 to rotate past the upper region 692 of the combination protrusion 690 than the rotational force needed for the flexible arms 705 to rotate past the soft protrusion 680 or the lower region 694.

The one or more flexible arms 705 extend downward from an upper perimeter 715 of the third stopper 700. In this aspect, the one or more flexible arms 705 are integral with the upper perimeter 715 of the third stopper 700. The one or more flexible arms 705 includes a tab portion 707 that extends outward (away from a central axis of the third stopper 700). Lateral sides 709 of the one or more flexible arms 705 contact the two soft protrusion 680 and the combination protrusion 690. A space 765 is formed between the one or more flexible arms 705 and the depressions 760. The space 765 provides room for the one or more flexible arms 705 to deflect inward when contacting the two soft protrusion 680 and the combination protrusion 690.

Bumps 667 are positioned on the inner surface 660 of the lid body 600, which helps to maintain the proper position of the gasket 620. The bumps 667 may prevent an inward sealing portion 640 from rolling or flexing upward. The bumps 667 may further assist in aligning the third stopper 700 with the lid body 600. The bumps 667 may reduce accidental cross-threading if the third stopper 700 is accidentally inserted into the third lid body 600 at too much of an angle.

The fourth lid body 800 and the fourth stopper 900 will now be described with reference to FIGS. 58-68:

The fourth lid body 800 includes an upper rim 805 around a central opening 810. The upper rim 805 may come in contact with a mouth of a user when the user wishes to drink. The upper rim 805 leads to or defines the central opening 810 that is generally open to receive the fourth stopper 900.

The fourth stopper 900 includes an upper surface 910 generally opposite of a lower surface 920. The upper surface 910 includes an optional handle portion 912. The stopper 900 includes a central portion 923 that is generally solid without any openings or passages for fluid flow. The size and shape of the stopper 900 is configured to close the central opening 810 of the fourth lid body 800.

A sidewall 930 of the fourth stopper 900 joins the upper surface 910 and the lower surface 920. An outer surface 933 of the sidewall 930 includes outer threads 935 that threadably engage with inner threads 865 of the fourth lid body 800.

The fourth lid body 800 and the fourth stopper 900 operate together to reduce or avoid an accidental or inadvertent release of the fourth stopper 900 from the fourth lid body 800.

In this this aspect, ridges 950 are formed at lower regions of the outer threads 935. The ridges 950 help prevent the accidental or inadvertent release of the fourth stopper 900 from the fourth lid body 800. The ridges 950 include raised humps or bumps that provide resistance against the complete separation of the fourth stopper 900 from the fourth lid body 800. In order to separate the fourth stopper 900 from the fourth lid body 800, the user must push the ridges 950, via the fourth stopper 900, past the inner threads 865 of the fourth lid body 800. The ridges 950 protrude or extend less from the sidewall 900 than the outer threads 935.

The fourth stopper 900 will continue to rotate in an opening direction without separating from the fourth lid body 800 until the user applies a separating force—for example pressing upward on the lower surface 920 of the fourth stopper 900 or pulling the upper surface 910 of the fourth stopper 900 upward. The separating force is needed to move ridges 950 on the sidewall 930 of the fourth stopper 900 past the inner threads 865 of the fourth lid body 800.

In order to remove the fourth stopper 900 from the fourth lid body 800, the user must apply a sufficient separating force to the fourth stopper 900. When the fourth stopper 900 is pushed or pulled upward with sufficient separating force, the inner threads 865 of the fourth lid body 800 move from thread channels 940 of the outer threads 935, over the ridges 950, and to released position below the ridges 950 proximate a lower rim 921 of the fourth stopper 900.

In another aspect, the outer threads 935 may vary in size to provide varying resistance and/or friction to turning the fourth stopper 900. In one aspect, the outer threads 935 may narrow as the fourth stopper 900 approaches the fully closed position.

Figure 65:
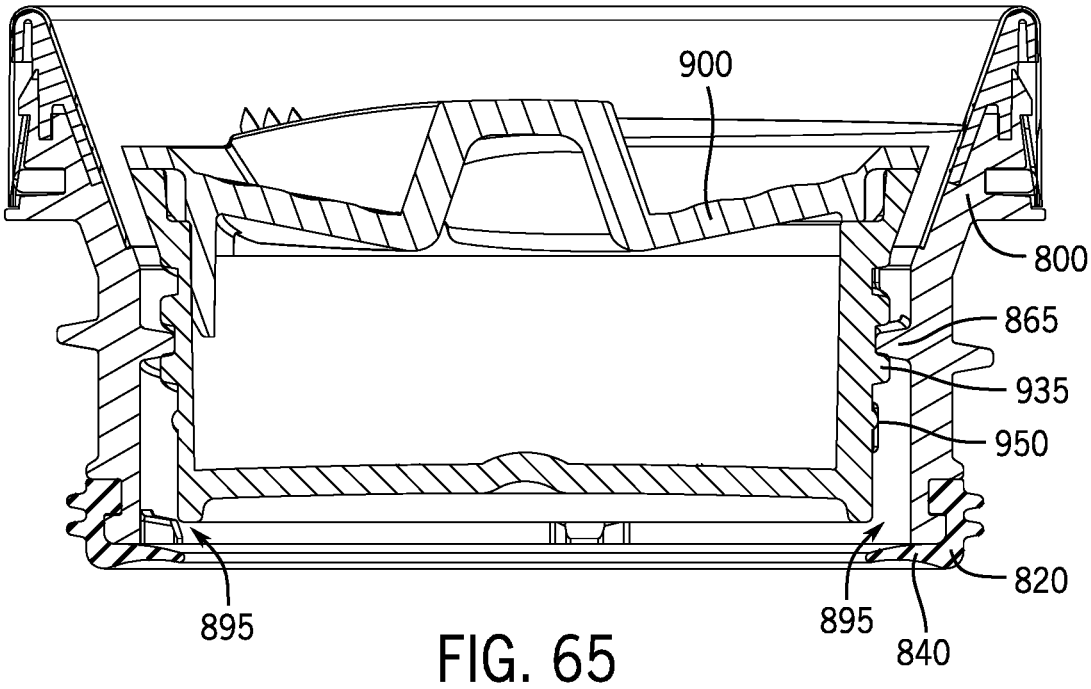
FIG. 65 is a sectional view of the fourth stopper engaged to the fourth lid body
Figure 68:
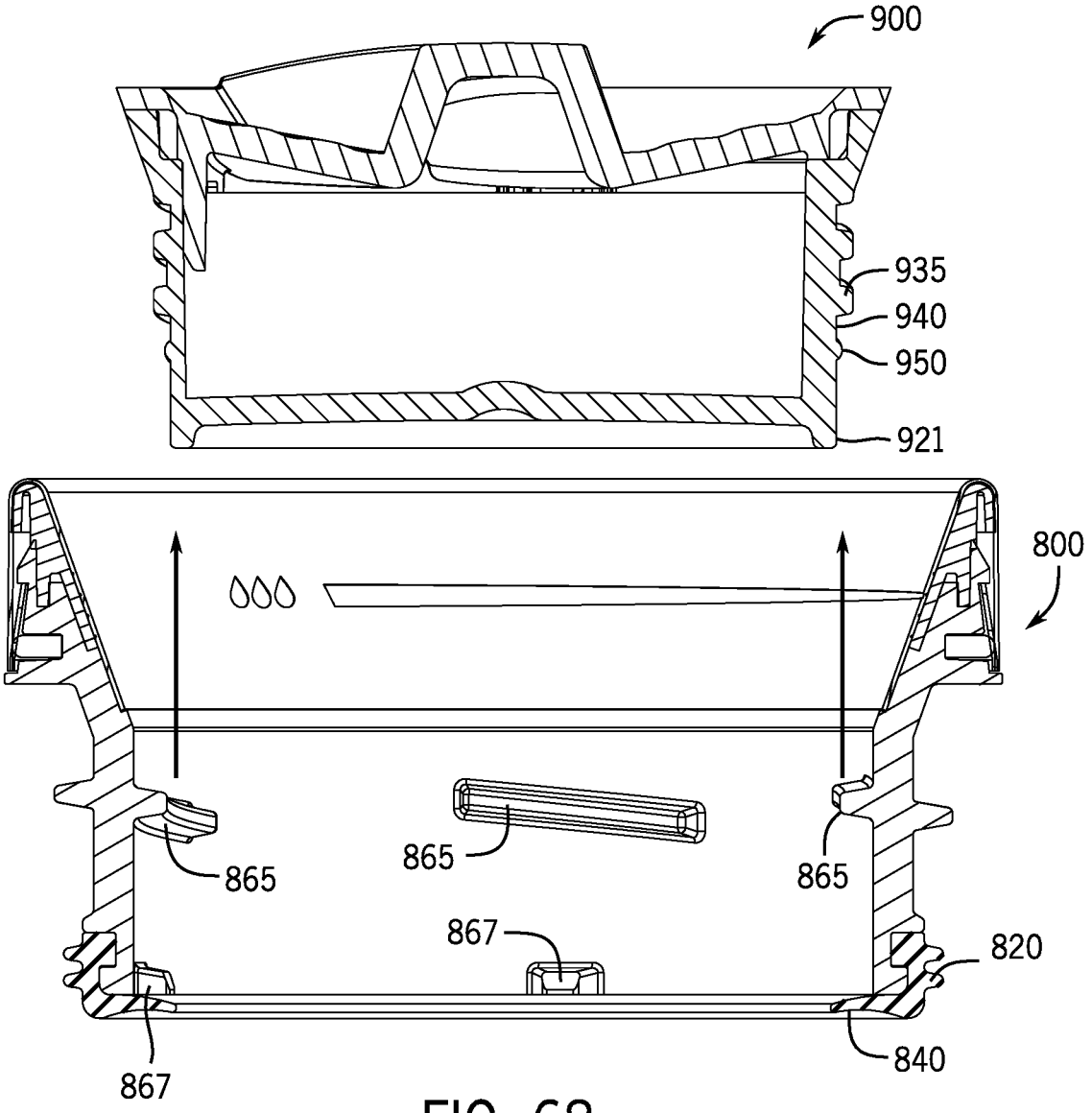
FIG. 68 is a perspective view of the third stopper separating from the third lid body.
Figure 69:
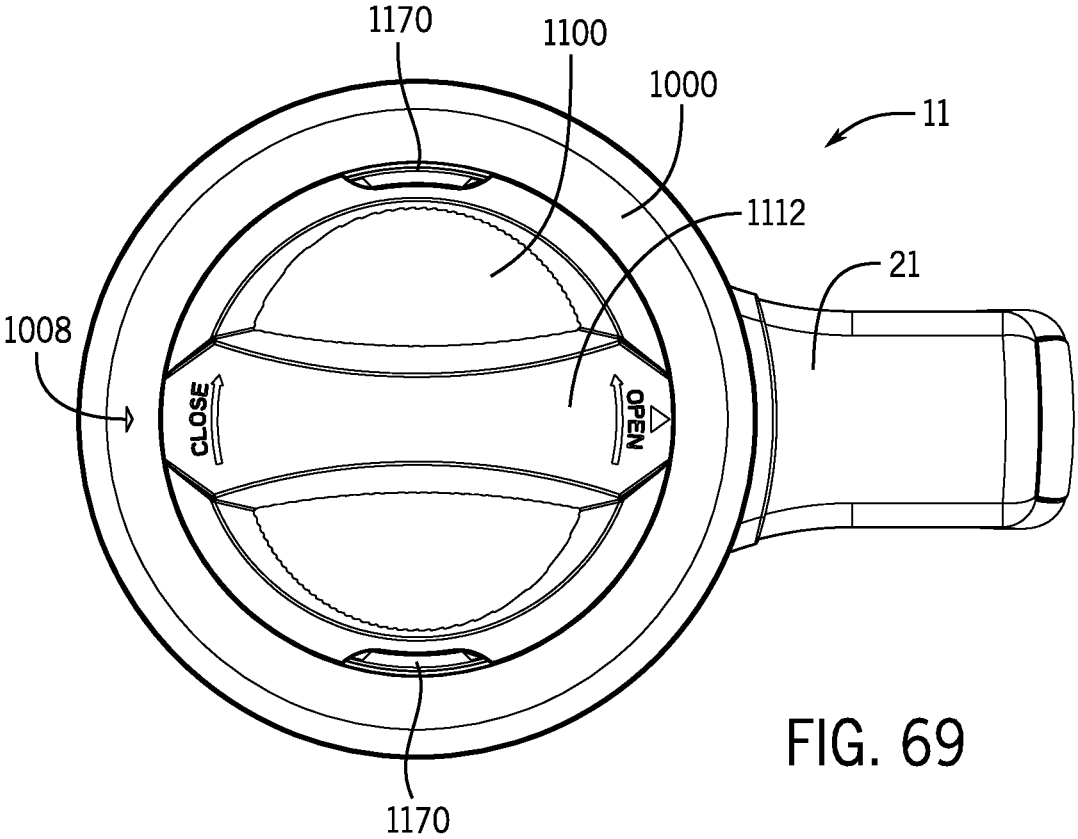
FIG. 69 is top view of the beverage container assembly with the fifth stopper and the fifth lid body.
Figure 70:
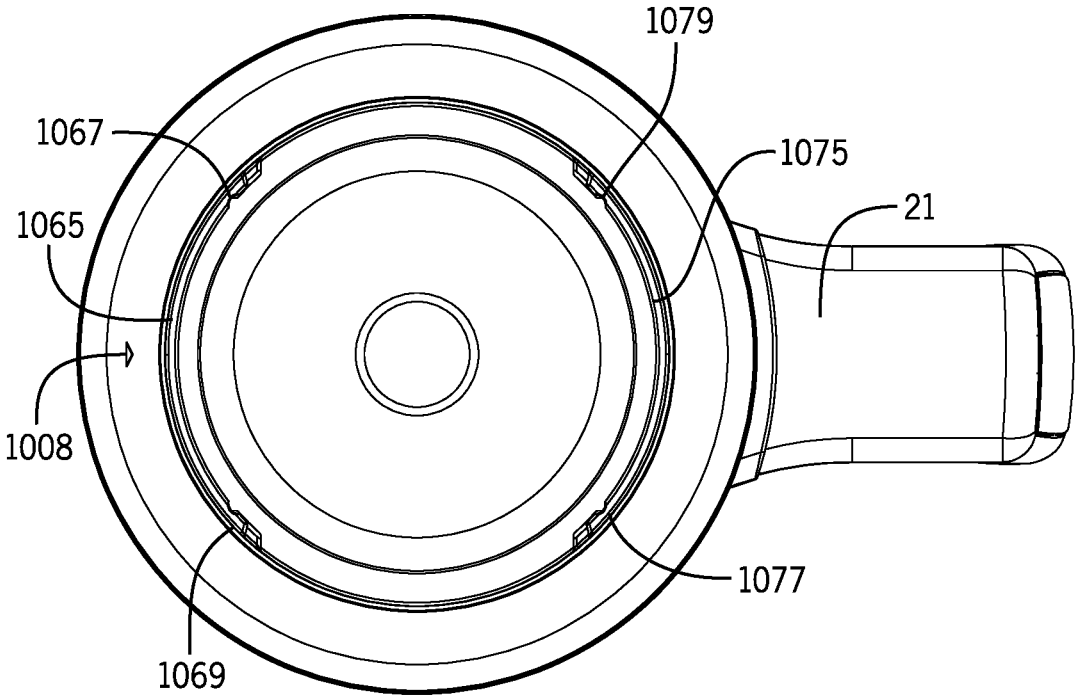
FIG. 70 is top view of the beverage container assembly with the fifth lid body engaged and the fifth stopper removed.
Figure 71:
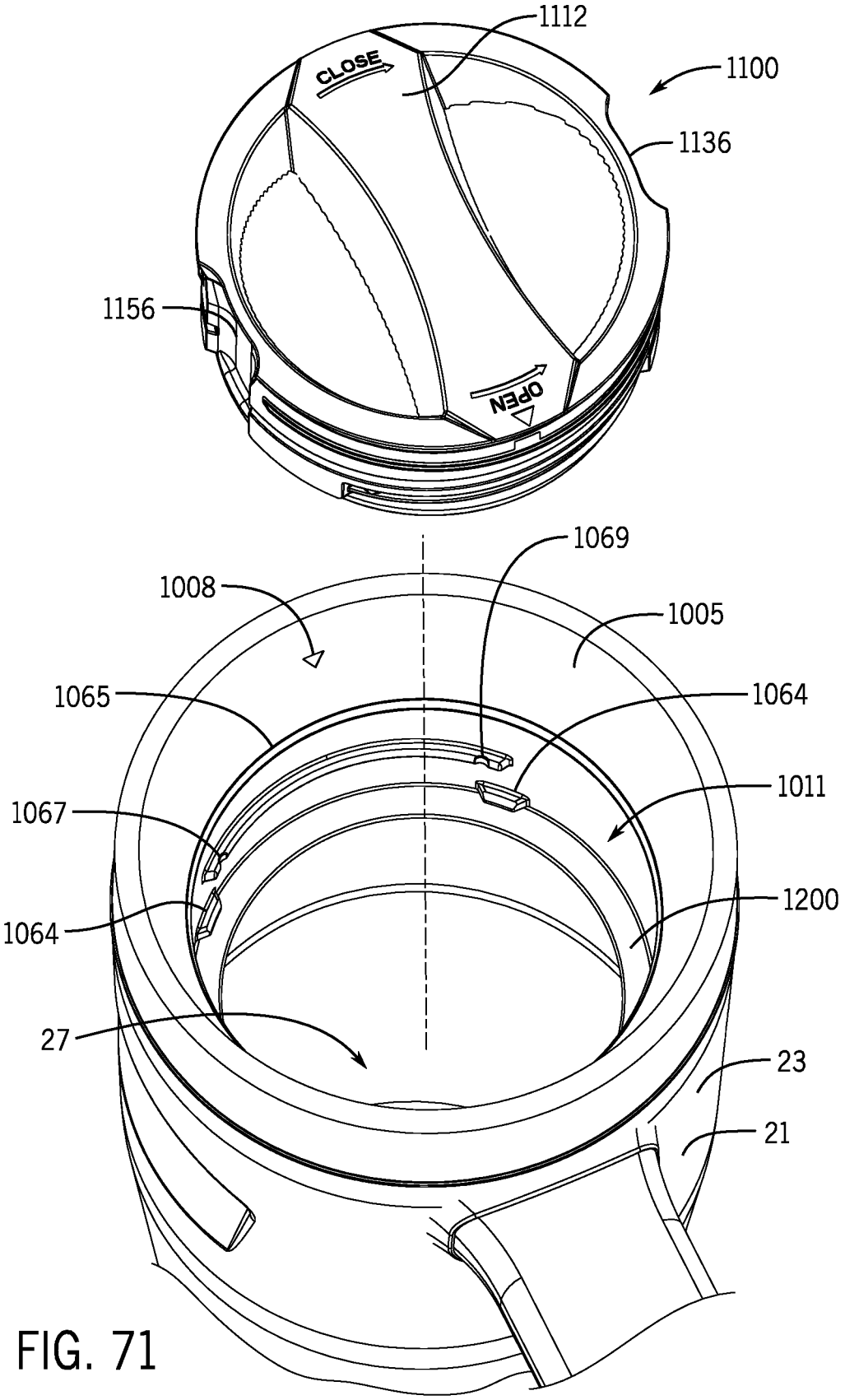
FIG. 71 is an exploded view of the beverage container assembly with the fifth stopper and the fifth lid body.

A fluid passage 895 is formed between the fourth lid body 800 and the fourth stopper 900. As the fourth stopper 900 rotates to a closed position, the fluid passage 895 is blocked. As the fourth stopper 900 rotates to an open position, as shown in FIG. 65, the fluid passage 895 is opened to provide fluid flow.

An inner surface 860 of the fourth lid body 800 includes the inner threads 865, which threadably engage with the outer threads 935 of the fourth stopper 900. The inner threads 865 are separated by are breaks, openings, spaces, voids, etc. In this aspect, the inner threads 865 includes four segments, and the outer threads 935 include four ridges 950. In other aspects, fewer or additional ridges 950 and/or segments of inner threads 865 may be utilized.

Bumps 867 are positioned on the inner surface 860 of the lid body 800, which helps to maintain the proper position of the gasket 820. The bumps 867 may prevent an inward sealing portion 840 from rolling or flexing upward. The bumps 867 may further assist in aligning the fourth stopper 900 with the lid body 800. The bumps 867 may reduce accidental cross-threading if the fourth stopper 900 is accidentally inserted into the fourth lid body 800 at too much of an angle.

A beverage container assembly 11 will now be described with references to FIGS. 69-79. The beverage container assembly 11 includes the beverage container 21, a fifth lid body 1000, and a fifth stopper 1100. The fifth lid body 1000 and the fifth stopper 1100 may be combined into a lid or lid assembly 1040.

The beverage container 21 includes walls 23 defining an interior volume 27 to hold a beverage. The fifth stopper 1100 threadably engages into a central opening 1011 of the fifth lid body 1000. The fifth stopper 1100 controls a flow of a drinking fluid through fluid passages 1170 between the fifth lid body 1000 and the fifth stopper 1100. A combination of the fifth lid body 1000 and the fifth stopper 1100 are inserted into an upper opening 31 of the beverage container 21 to provide a selective closure to the beverage container 21. The fluid passages 1170 are formed as openings between the fifth lid body 1000 and the fifth stopper 1100.

Figure 77:
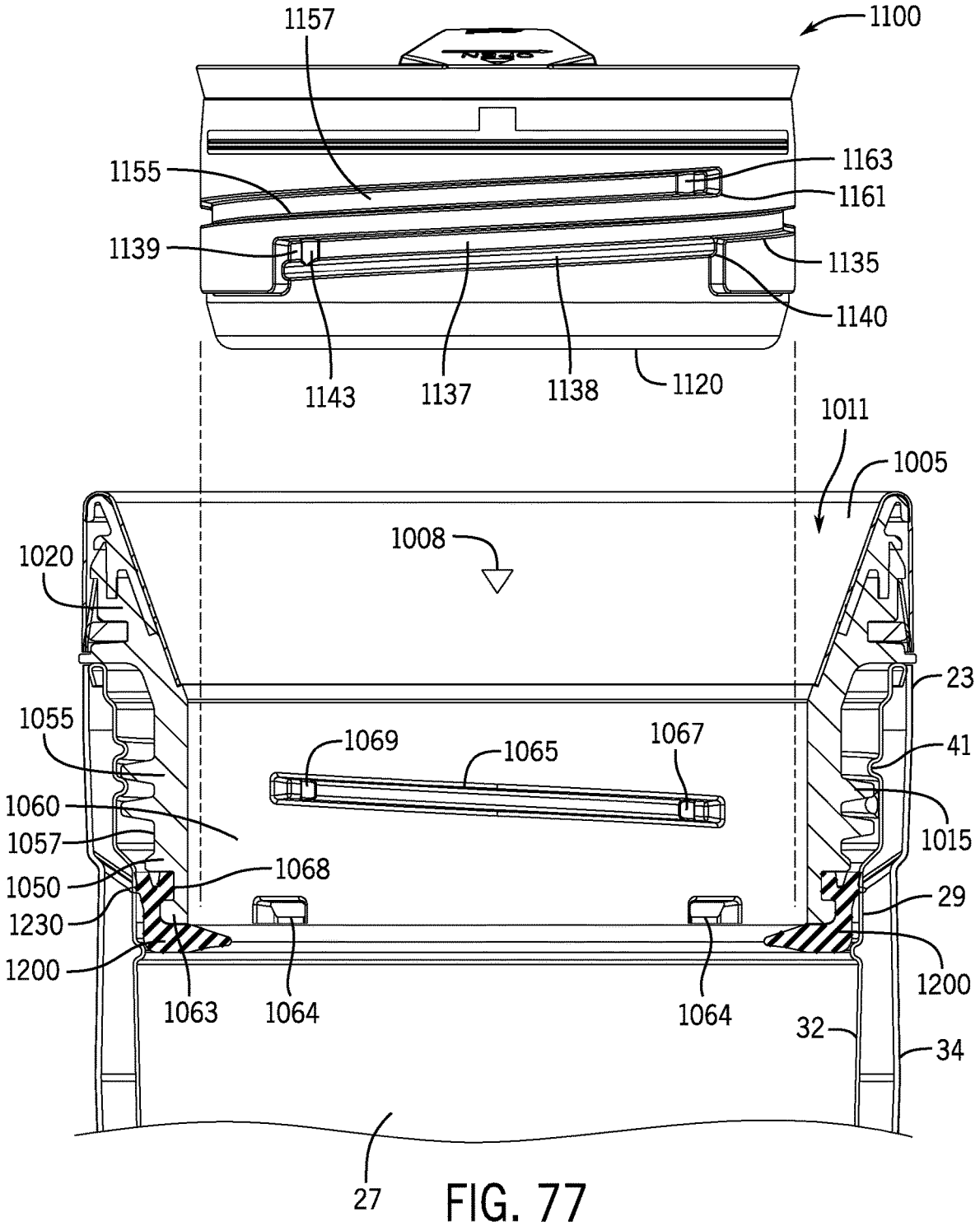
FIG. 77 is a sectional view of the beverage container assembly with the fifth stopper and the fifth lid body.
Figure 78:
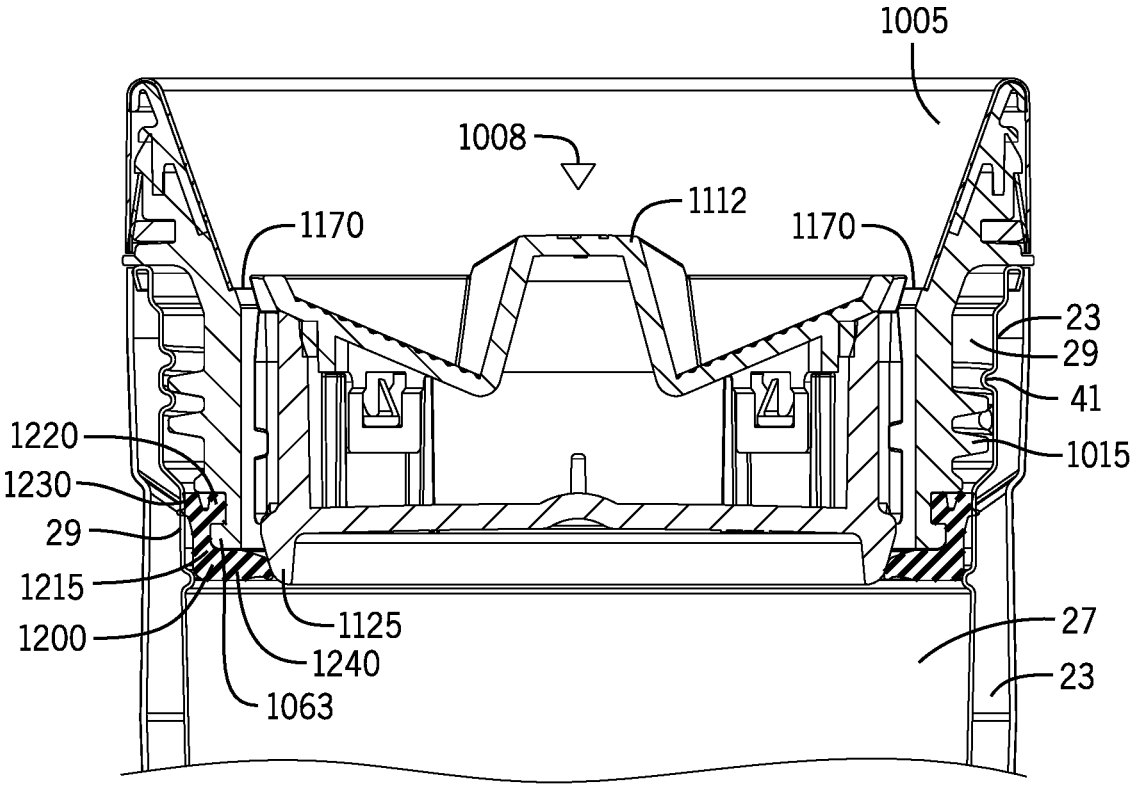
FIG. 78 is a sectional view of the beverage container assembly with the fifth stopper and the fifth lid body.
Figure 79:
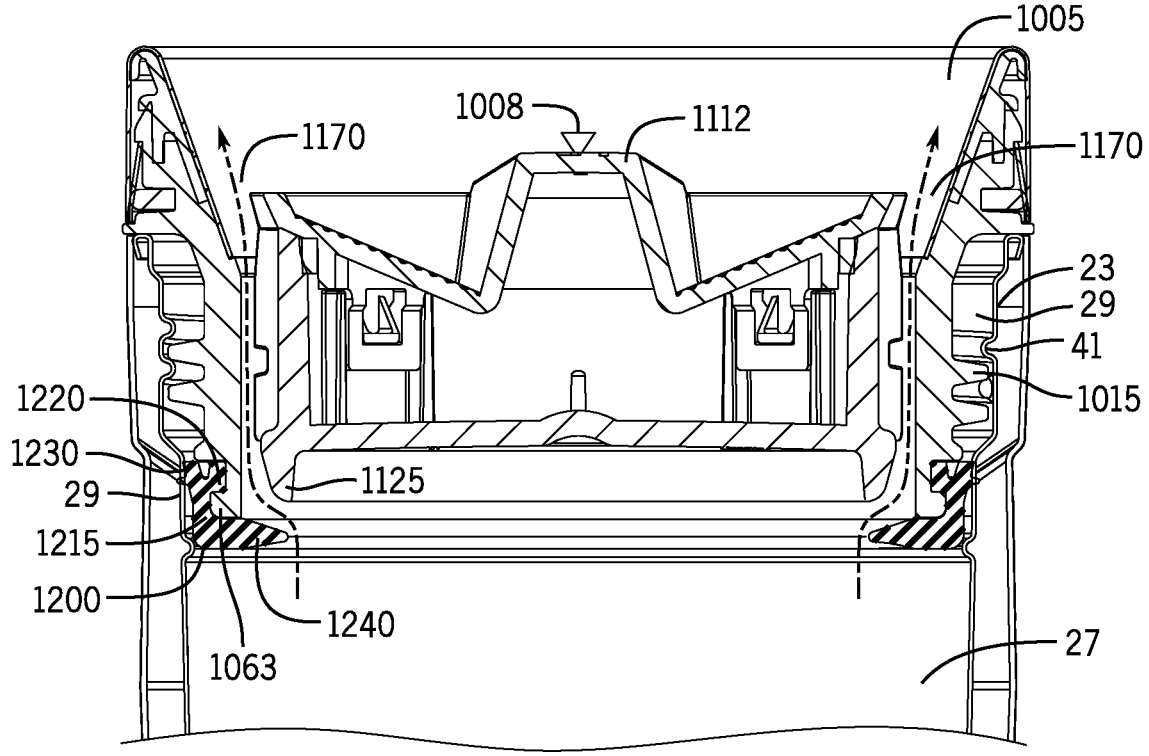
FIG. 79 is a sectional view of the beverage container assembly with the fifth stopper and the fifth lid body.

With respect to FIGS. 77-79, sectional views of the beverage container 21 is shown. In this aspect, an insulated beverage container 21 is illustrated, however, other types of beverage containers may be used with the fifth lid body 1000 and the fifth stopper 1100 described herein. With reference to FIG. 77, the beverage container 21 includes an inner shell 32 and an outer shell 34. The inner shell 32 and the outer shell 34 are welded or otherwise joined to form a thermally insulated space in the beverage container 21 to maintain a temperature of the beverage. In other aspects the inner shell 32 and the outer shell 34 may be welded to one or more bottom layers. In other aspects, the beverage container 21 includes a non-insulated construction or other insulated constructions. In other aspects, the beverage container 21 may be formed from stainless steel, other metals and metal alloys, plastics, and the like.

In this aspect, the fifth lid body 1000 threadably engages to the beverage container 21. With reference to FIGS. 78 and 79, the walls 23 of an upper portion of the beverage container 21 include an inner surface 29 having interior threads 41. The interior threads 41 of the beverage container 21 receive exterior threads 1015 of the fifth lid body 1000 to engage the fifth lid body 1000 to the beverage container 21. The fifth lid body 1000 is inserted into the upper opening 31 of the beverage container 21. The exterior threads 1015 of the fifth lid body 1000 threadably engage with the interior threads 41 of the beverage container 21 to screw the fifth lid body 1000 into and/over the upper opening 31 of the beverage container 21. As the fifth lid body 1000 is screwed to the upper opening 31, a gasket 1200 of the fifth lid body 1000 is urged against the inner surface 29 of the beverage container 21. The engagement of the gasket 1200 to the inner surface 29 generally seals the engagement between the fifth lid body 1000 and the beverage container 21.

The fifth lid body 1000 will now be described with reference to FIG. 77. The fifth lid body 1000 includes an upper rim 1005 around the central opening 1011. The upper rim 1105 may come in contact with a mouth of a user when the user wishes to drink from the beverage container assembly 11. The upper rim 1005 leads to or defines the central opening 1011 that is generally open to receive the fifth stopper 1100.

The fifth lid body 1000 includes an upper portion 1020 generally opposite of a lower portion 1050. The lower portion 1050 includes a sidewall 1055. The sidewall 1055 includes an outer surface 1057 and an inner surface 1060. In this aspect, the exterior threads 1015 are formed or positioned on the outer surface 1057 of the sidewall 1055.

The gasket 1200 is engaged to a bottom perimeter 1063 of the fifth lid body 1000. In this aspect, bumps 1064 are positioned on the inner surface 1060 of the fifth lid body 1000 adjacent the bottom perimeter 1063. An outer groove 1068 assists in holding the gasket 1200 to the fifth lid body 1000.

The inner surface 1060 of the fifth lid body 1000 includes a first inner thread 1065 and a second inner thread 1075, which threadably engage with outer threads 1115 of the fifth stopper 1100. The first inner thread 1065 and the second inner thread 1075 extend inward from the inner surface 1060. In this aspect, the inner surface 1060 includes two inner threads, the first inner thread 1065 and the second inner thread 1075, while in other aspects, the inner surface 1060 may include a single inner thread or three or more inner threads. In this aspect, the first inner thread 1065 includes a first notch 1067 and a second notch 1069, while the second inner thread 1075 includes a first notch 1077 and a second notch 1079.

The fifth stopper 1100 will now be described with reference to FIGS. 72-74. The fifth stopper 1100 includes an upper surface 1110 generally opposite of a lower surface 1120. The upper surface 1110 includes an optional handle portion 1112. The fifth stopper 1100 includes a central portion 1123 that is generally solid without any openings or passages for fluid flow. The size and shape of the fifth stopper 1100 is configured to close the central opening 1011 of the fifth lid body 1000. A sidewall 1130 joins the upper surface 1110 and the lower surface 1120. A lower outer perimeter 1125 is formed between the sidewall 1130 and the lower surface 1120.

An outer surface 1133 of the sidewall 1130 includes a first outer thread 1135 and a second outer thread 1155 that threadably engage with the first inner thread 1065 and the second inner thread 1075 of the fifth lid body 1000. In this aspect, the first outer thread 1135 includes a first depression 1137 and the second outer thread 1155 includes a second depression 1157. When the fifth lid body 1000 is engaged to the fifth stopper 1100, the first inner thread 1065 of the fifth lid body 1000 travels in the first depression 1137 and the second inner thread 1075 travels in the second depression 1157.

The first depression 1137 includes a first end 1139 and a second end 1141. Protrusions 1143 are positioned in the first depression 1137 close to the first end 1139 and the second end 1141. Similarly, the second depression 1157 includes a first end 1159 and a second end 1161. Protrusions 1163 are positioned in the second depression 1157 close to the first end 1159 and the second end 1161. The protrusions 1143 and 1163 include members positioned in, partially to fully blocking, or extending transverse to the respective depression 1137 and 1157. The protrusions 1143 and 1163 of the fifth stopper 1100 operate with the first inner thread 1065 and the second inner thread 1075 of the fifth lid body 1000 to provide an audible and/or tactile indication that the fifth stopper 1100 is fully closed and/or fully open. In this aspect, the protrusions 1143 and 1163 are generally perpendicular to a length of their respective depression 1137 and 1157.

The fluid passages 1170 are formed between the fifth lid body 1000 and the fifth stopper 1100. The fifth stopper 1100 controls a flow of a drinking fluid through the fluid passages 1170. As the fifth stopper 1100 rotates to a closed position, the fluid passages 1170 are blocked. As the fifth stopper 1100 rotates to an open position, the fluid passages 1170 are opened.

The gasket 1200 extends around an outer diameter of the fifth lid body 1000. The gasket 1200 is positioned below the bottom perimeter 1063 and is engaged to the outer groove 1068 of the fifth lid body 1000. The gasket 1200 includes a gasket body 1205 defining a central opening. The gasket 1200 includes an engaging portion 1220 that fits into or engages to the outer groove 1068 of the fifth lid body 1000.

The gasket 1200 includes an outward sealing portion 1230 to seal against the inner surface 29 of the beverage container 21 and an inward sealing portion 1240 to seal against the fifth stopper 1100. As such, in this aspect, the gasket 1200 seals against two different components. In this aspect, the gasket 1200 seals against two different components in opposing directions. In this aspect, a groove 1215 is formed between the inward sealing portion 1240 and the engaging portion 1220. The groove 1215 fits over the bottom perimeter 1063 of the fifth lid body 1000.

The inward sealing portion 1240 forms a fin or wiper that bends or deflects to seal against the fifth stopper 1100. The inward sealing portion 1240 may also provide a vent to reduce vacuum build-up in the container 21.

With reference to FIGS. 78 and 79, in this aspect, the outward sealing portion 1230 seals against the inner surface 29 of the beverage container 21. With continued reference to reference to FIGS. 78 and 79, in this aspect, the inward sealing portion 1240 seals against the outer perimeter 1125 of the fifth stopper 1100. The bumps 1064, positioned on the inner surface 1060 of the fifth lid body 1000, help to maintain the proper position of the gasket 1200. The bumps 1064 may prevent the inward sealing portion 1240 from rolling or flexing upward. In other aspects, the inward sealing portion 1240 may also seal against one or both of the lower surface 1120 of the fifth stopper 1100 or the outer surface 1133 of the fifth stopper 1100.

The bumps 1064 may further assist in aligning the fifth stopper 1100 with the fifth lid body 1000. The bumps 1064 may reduce accidental cross-threading if the fifth stopper 1100 is accidentally inserted into the fifth lid body 1000 at too much of an angle.

In this aspect, the first inner thread 1065 is positioned on the inner surface 1060 of the fifth lid body 1000 approximately 180 degrees apart from the second inner thread 1075.

The fifth stopper 1100 rotates relative to the fifth lid body 1000 to move or change between a closed configuration, an open configuration, and removable configuration. In the closed configuration, the fifth stopper 1100 is generally sealed against the fifth lid body 1000 and fluid cannot generally flow through the fluid passages 1170. In the open configuration, the fifth stopper 1100 has been unthreaded sufficiently to open the fluid passages 1170 and permit fluid flow through the fluid passages 1170. In the removable configuration, the fifth stopper 1100 has been unthreaded sufficiently to disengage the first outer thread 1135 and the second outer thread 1155 of the fifth stopper 1100 from the first inner thread 1065 and the second inner thread 1075 of the fifth lid body 1000, and the fifth stopper 1100 may be removed from the fifth lid body 1000, as described below.

As the fifth stopper 1100 rotates toward the closed configuration, the protrusion 1143 near the first end 1139 snaps or clicks into the first notch 1067, while the protrusion 1163 near the first end 1159 snaps or clicks into the first notch 1077 to signal to the user that the fifth stopper 1100 has moved to the closed configuration. Similarly, as the fifth stopper 1100 rotates toward the fully open configuration, the protrusion 1143 near the second end 1141 snaps or clicks into the second notch 1069, while the protrusion 1163 near the second end 1161 snaps or clicks into the second notch 1079 to signal to the user that the fifth stopper 1100 has moved to the closed configuration.

The first outer thread 1135 of the fifth stopper 1100 includes an engagement and disengagement region 1138. Similarly, the second outer thread 1155 includes an engagement and disengagement region 1158. The disengagement regions 1138 and 1158 may include a portion of the outer threads 1135 and 1155 with a reduced height, reduced width, tapered shape, and/or gaps between thread segments, etc. that provides for the first inner thread 1065 and the second inner thread 1075 of the fifth lid body 1000 to be engaged and disengaged from the first outer thread 1135 and the second outer thread 1155. For example, when the disengagement regions 1138 and 1158 are centered or aligned with the first inner thread 1065 and the second inner thread 1075, the user may pull upward on the fifth stopper 1100, which may pull the disengagement regions 1138 and 1158 over the first inner thread 1065 and the second inner thread 1075 of the fifth lid body 1000 to separate or disengage the fifth stopper 1100 from the fifth lid body 1000. For example, a user may push downward on the fifth stopper 1100, which may push the engagement regions 1138 and 1158 over the first inner thread 1065 and the second inner thread 1075 of the fifth lid body 1000 to engage the fifth stopper 1100 to the fifth lid body 1000. When the fifth stopper 1100 is engaged to or disengaged from the fifth lid body 1000, one or both of the fifth stopper 1100 and the fifth lid body 1000 and/or the first inner thread 1065, the second inner thread 1075, the disengagement regions 1138 and 1158 may temporarily bend or deform to permit the movement. In this aspect, with respect to FIGS. 72-74 the engagement and disengagement regions 1138 and 1158 includes a reduced height and width as compared to the remainder of the first outer thread 1135 and the second outer thread 1155. In this aspect, the engagement and disengagement region 1138 extends approximately from the first end 1139 of the first outer thread 1135 to a transition point 1140.

One or more indicators may be positioned on the fifth lid body 1000 and/or the fifth stopper 1100 to indicate to the user which direction to rotate the fifth stopper 1100 in order to open or close the beverage container assembly 11. The one or more indicators may also indicate that the fifth stopper 1100 is positioned in a removable configuration—where the fifth stopper 1100 may be removed from the fifth lid body 1000. In this aspect, an indicator 1008, in the form of an "arrow", is positioned on an upper surface of the upper rim 1005 of the fifth lid body 1000 to indicate proper alignment for engagement of the fifth stopper 1100 to the fifth lid body 1000. The indicator 1008 may include other symbols, words, indicia, markings, etc. In this aspect, the fifth stopper 1100 includes text and arrows to indicate to the user which rotational direction results in closing of the beverage container assembly 11 and which rotational direction results in opening of the beverage container assembly 11.

As the fifth stopper 1100 is rotated from the closed position to the open configuration, the protrusions 1143 and 1163 generally simultaneously click out of the notches 1067 and 1077 to indicate that the fifth lid body 1000 is now in the open configuration. In this aspect, the user generally exerts more force to rotate the protrusions 1143 and 1163 to or from the notches 1067, 1069, 1077, and 1079, which provides a reminder or indication to the user regarding which configuration the fifth stopper 1100 is in. The interaction of the protrusions 1143 and 1163 with the notches 1067, 1069, 1077, and 1079 provides an audible, tactile, and/or otherwise noticeable sensation or feeling that the fifth stopper 1100 has moved from the closed configuration to the open configuration or from the open configuration to the closed configuration.

Figure 72:
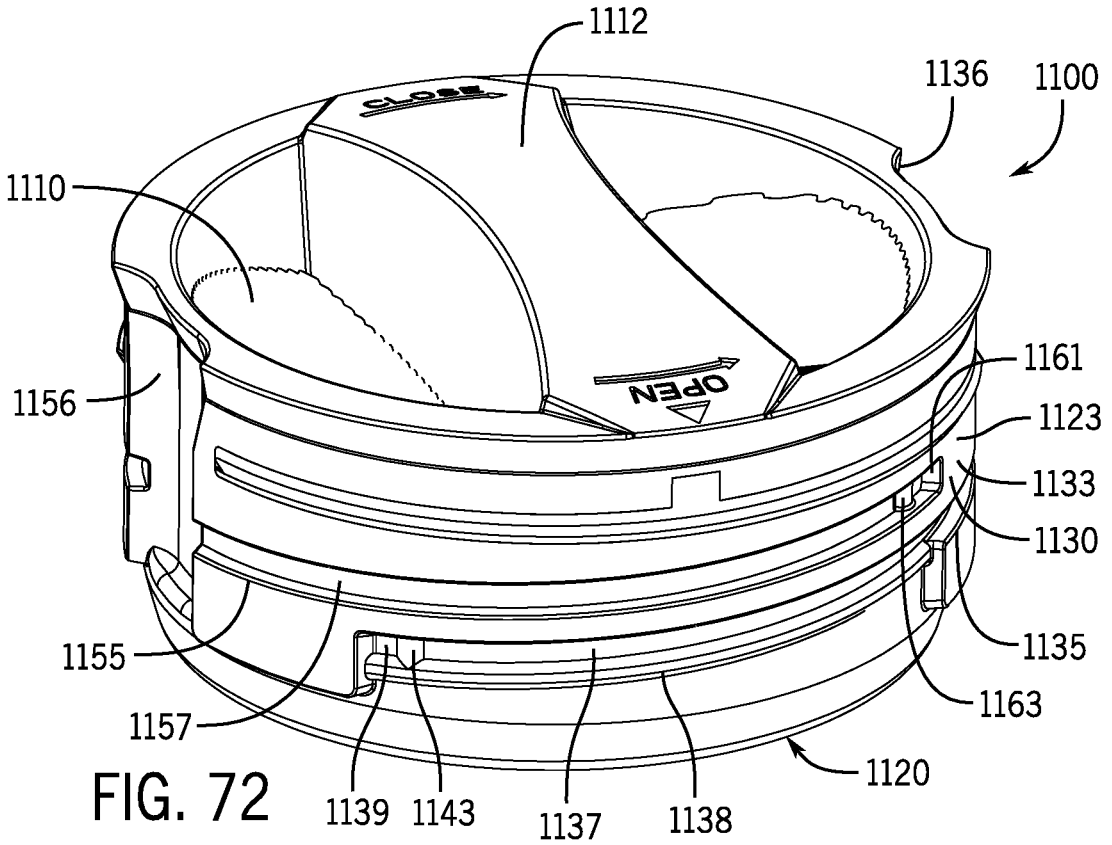
FIG. 72 is a perspective view of the fifth stopper.
Figure 73:
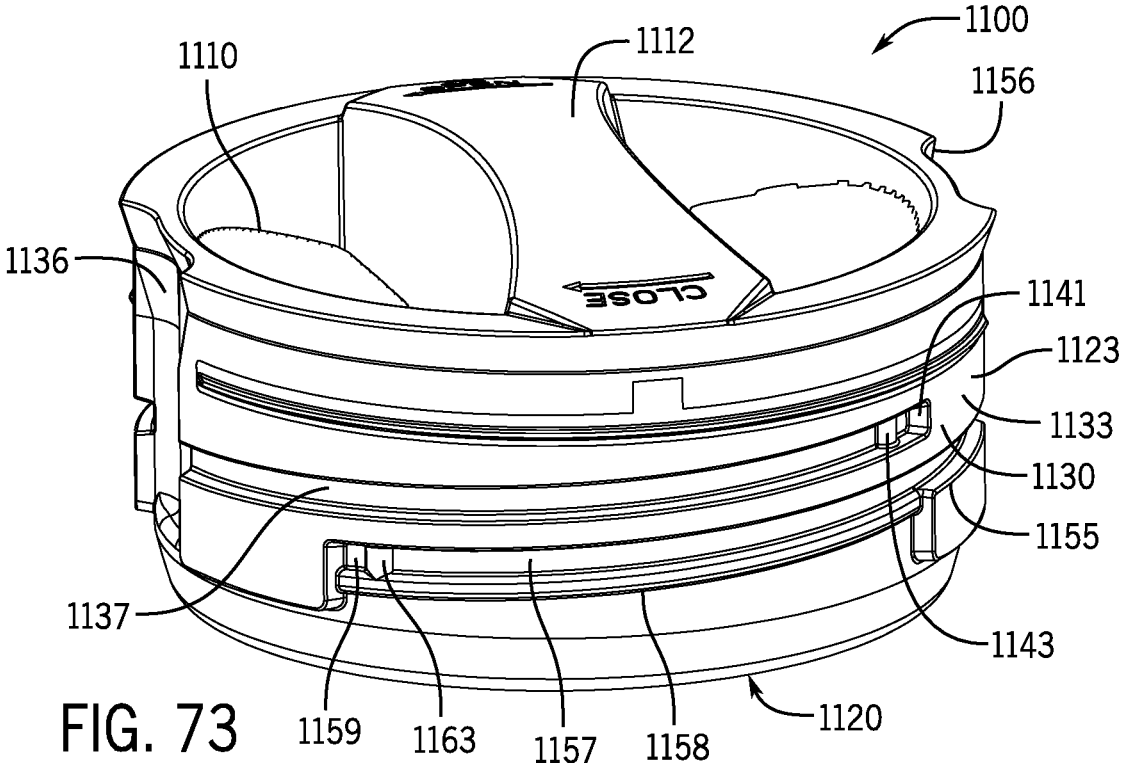
FIG. 73 is a perspective view of the fifth stopper.
Figure 74:
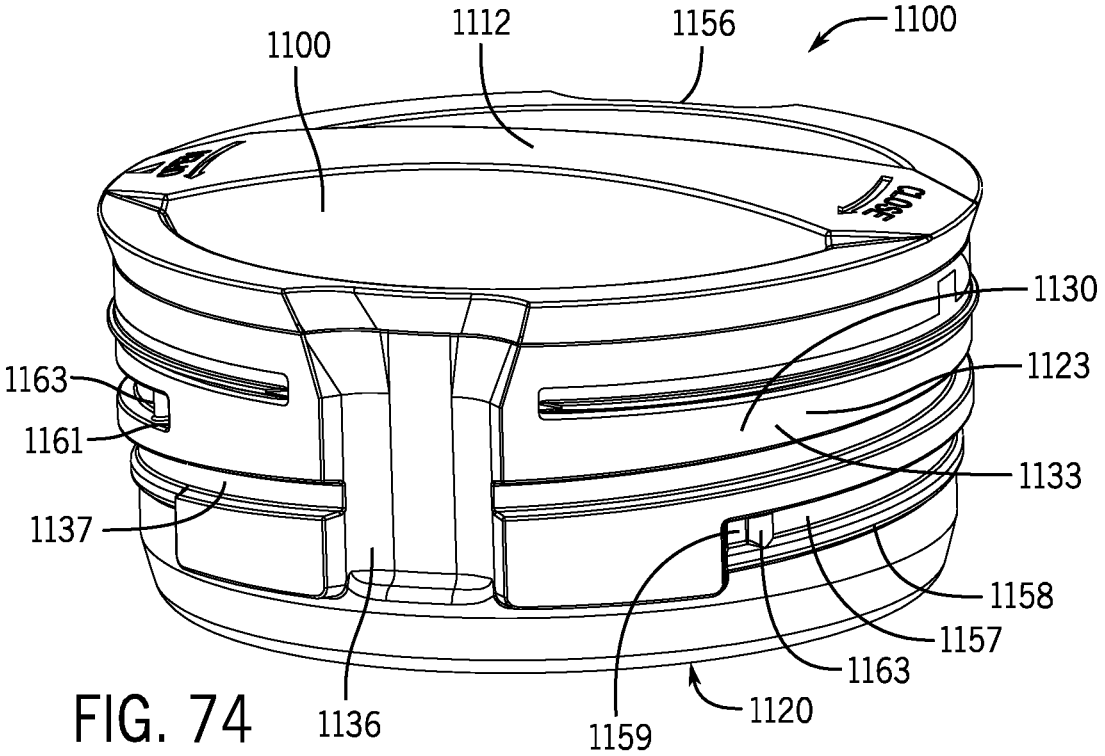
FIG. 74 is a perspective view of the fifth stopper.
Figure 75:
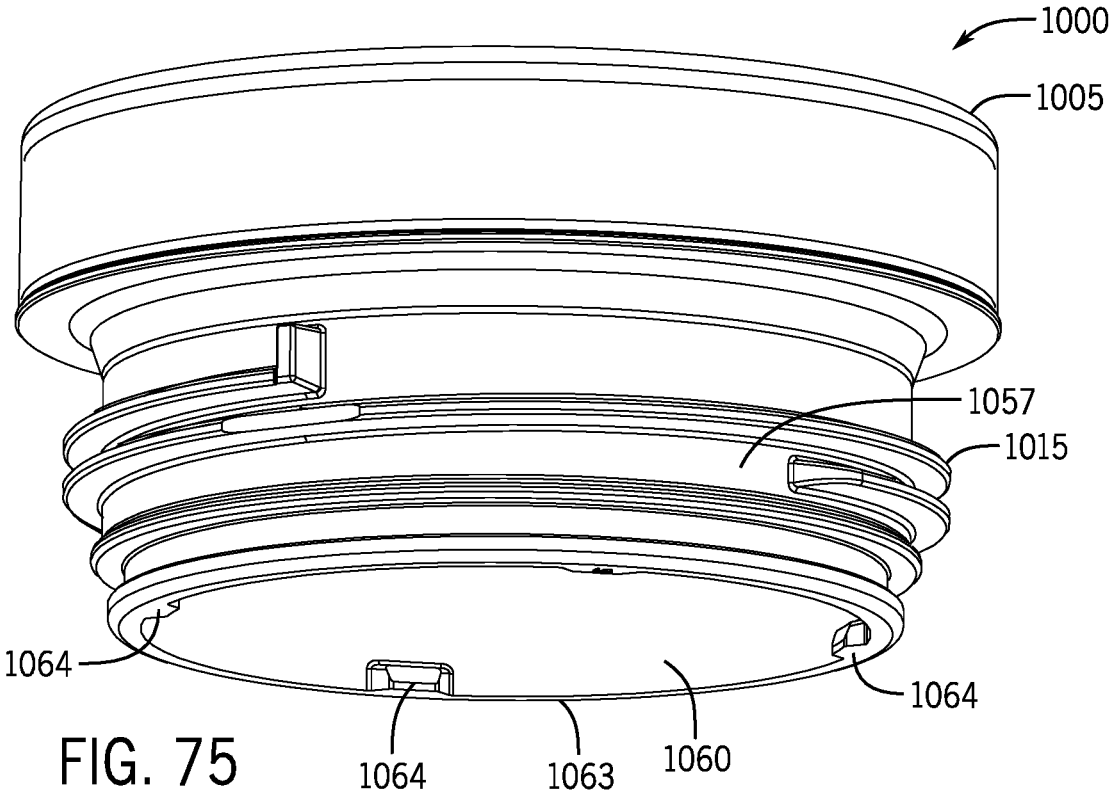
FIG. 75 is a perspective view of the fifth lid body.
Figure 76:
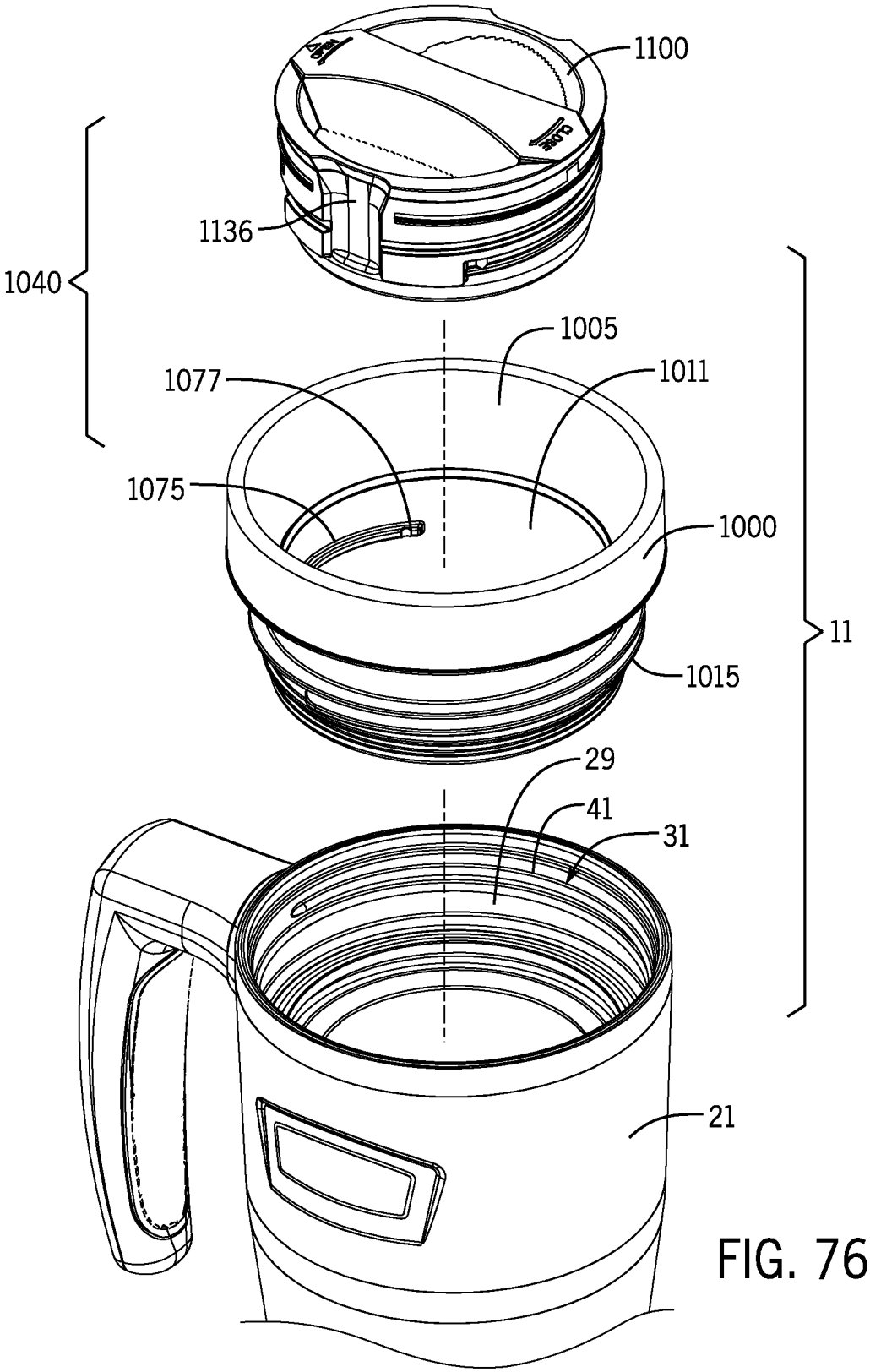
FIG. 76 is an exploded view of the beverage container assembly with the fifth stopper and the fifth lid body.

With reference to FIGS. 72 and 73, in this aspect, the first outer thread 1135 includes a first well 1136, and the second outer thread 1155 includes a second well 1156. The first well 1136 and the second well 1156 are breaks, depression, openings, voids, etc. in the first outer thread 1135 and the second outer thread 1155, respectively. The first well 1136 and the second well 1156 provide the passage of fluid when the fifth stopper 1100 is opened. The first well 1136 and the second well 1156 provide a region or space on the exterior of the fifth stopper 1100 having a small external diameter than an external diameter of the first outer thread 1135 and the second outer thread 1155. The first well 1136 and the second well 1156 may connect or join the upper surface 1110 and the lower surface 1120. The first well 1136 and the second well 1156, in conjunction with the upper rim 1005, form the fluid passages 1170. The first well 1136 and the second well 1156 are oppositely disposed on the exterior of the fifth stopper 1100. In this aspect, the first well 1136 and the second well 1156 are approximately 180 degrees from each other. Although the fifth lid body 1000 is illustrated with the two wells 1136 and 1156, in other aspects, the fifth stopper 1100 may include only one of the wells 1136 and 1156 or may include an additional well.

The function and operation of the beverage container assembly 11 will now be described. As described above, the fifth lid body 1000 threadably engages or screws to the beverage container 21. The fifth stopper 1100 also threadably engages or screws to the fifth lid body 1000. When the fifth stopper 1100 is unscrewed or unthreaded from the fifth lid body 1000, such as shown in FIG. 15, the first well 1136 and the second well 1156 are opened to permit fluid passage.

The fifth stopper 1100 may be fully screwed or fully threaded to the fifth lid body 1000, such as shown in FIG. 79, to provide nearly complete closure of the beverage container assembly 11 to provide a generally leak-resistant or spill-resistant beverage container assembly 11. In order to open the beverage container 21 for drinking or pouring, the fifth stopper 1100 is unscrewed or unthreaded from the fifth lid body 1000 until the fifth stopper 1100 uncovers the first well 1136 and the second well 1156. The fifth stopper 1100 may be only partially unscrewed or unthreaded from the fifth lid body 1000 in order to drink from or pour from the beverage container assembly 11.

The fifth stopper 1100 may be turned to the opening direction, which in this aspect, is in the left direction. However, the fifth stopper 1100 will only turn a finite amount of rotation in the closing or right direction, as the fifth stopper 1100 will fully engage to the fifth lid body 1000.

Eventually, after sufficient turning in the closing or right direction, the fifth stopper 1100 will be fully seated against the fifth lid body 1000.

The fifth lid body 1000 is configured to removably connect to the container 21. In other aspects, the fifth lid body 1000 and container 21 may include other removable connection components or configurations, such as different complementary threads, snap engagement, press-fit engagement, bayonet engagement, a frictional configuration, etc.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A lid for a beverage container, comprising:

a lid body configured to fit an opening of a beverage container;

a stopper configured to threadably engage with the lid body, wherein the stopper rotates relative to the lid body between a closed configuration, an open configuration, and a removable configuration;

a fluid passage between the lid body and the stopper, wherein the fluid passage is closed when the stopper and the lid body are in the closed configuration, and wherein the fluid passage is open when the stopper and the lid body are in the open configuration; and wherein an inner surface of the lid body includes one or more inner threads, which threadably engage with one or more outer threads of the stopper, wherein the one or more inner threads or the one or more outer threads include a first notch, wherein the other of the one or more inner threads or the one or more outer threads include a first protrusion, and the first protrusion is configured to engage the first notch.

2. The lid for a beverage container according to claim 1, wherein the rotation of the stopper relative to the lid body positions the first protrusion in the first notch to indicate that that the stopper is in the closed or the removable configuration.

3. The lid for a beverage container according to claim 1, wherein the one or more outer threads include an engagement and disengagement region, wherein the region includes a thread with reduced height, reduced width, or tapered shape.

4. The lid for a beverage container according to claim 1, wherein the stopper has the outer threads including a first outer thread and a second outer thread, wherein the lid body has the inner threads including a first inner thread and a second inner thread, wherein the first outer thread engages with the first inner thread and the second outer thread engages with the second inner thread, wherein the first inner thread includes the first notch and a second notch, and the second inner thread includes a third notch and a fourth notch, the first outer thread include the first protrusion and a second protrusion, and the second outer thread includes a third protrusion and a fourth protrusion.

5. The lid for a beverage container according to claim 4, wherein the first outer thread includes a first depression and the second outer thread includes a second depression, the first inner thread configured to travel in the first depression and the second inner thread configured to travel in the second depression.

6. The lid for a beverage container according to claim 5, wherein the first protrusion is positioned in the first depression close to a first end of the first depression and the second protrusion is positioned in the first depression close to a second end of the first depression, and the third protrusion is positioned in the second depression close to a first end of the second depression, and the fourth protrusion is positioned in the second depression close to a second end of the second depression.

7. The lid for a beverage container according to claim 6, wherein the stopper is configured to rotate toward the closed configuration, wherein the first protrusion near the first end of the first depression snaps or clicks into the first notch of the first inner thread, and the third protrusion near the first end of the second depression snaps or clicks into the third notch of the second inner thread to signal to a user that the stopper has moved to the closed configuration.

8. The lid for a beverage container according to claim 7, wherein the stopper is configured to rotate toward the open configuration, wherein the second protrusion near the second end of the first depression snaps or clicks into the second notch of the first outer thread and the fourth protrusion near the second end of the second depression snaps or clicks into the fourth notch of the second outer thread to signal to the user that the stopper has moved to the removable configuration.

9. The lid for a beverage container according to claim 4, wherein the first outer thread includes a first engagement and disengagement region, and the second outer thread includes a second engagement and disengagement region, wherein the stopper is configured to disengage or engage the lid body when the first disengagement region is centered or aligned with the first inner thread and the second disengagement region is centered or aligned with the first inner thread.

10. The lid for a beverage container according to claim 1, further comprising a gasket that is engaged to the lid body, the gasket includes an outward sealing portion to seal against an inner surface of the beverage container; and the gasket includes an inward sealing portion to seal against the stopper.

11. The lid for a beverage container according to claim 10, wherein a groove is formed between the inward sealing portion and an engaging portion of the gasket, and the groove fits over a bottom perimeter of the lid body.

12. The lid for a beverage container according to claim 1, wherein the rotation of the stopper relative to the lid body provides an indication that the stopper and the lid body are in the open configuration.

13. The lid for a beverage container according to claim 12, wherein the rotation of the stopper relative to the lid body provides a further indication that the stopper and the lid body are in the removable configuration.

14. The lid for a beverage container according to claim 12, wherein the indication is an audible indication, a tactile indication, or an increase in resistance.

15. The lid for a beverage container according to claim 12, wherein an inner surface of the lid body includes at least two different styles of protrusions with different physical or structural characteristics that interact or engage with the stopper.

* * * * *